US006642912B2

(12) United States Patent
Furutani

(10) Patent No.: US 6,642,912 B2
(45) Date of Patent: Nov. 4, 2003

(54) METHOD OF DRIVING AC-DISCHARGE PLASMA DISPLAY PANEL

(75) Inventor: Takashi Furutani, Tokyo (JP)

(73) Assignee: NEC Corporation, Tokyo (JP)

( * ) Notice: Subject to any disclaimer, the term of this patent is extended or adjusted under 35 U.S.C. 154(b) by 237 days.

(21) Appl. No.: 09/746,110

(22) Filed: Dec. 22, 2000

(65) Prior Publication Data

US 2001/0005190 A1 Jun. 28, 2001

(30) Foreign Application Priority Data

Dec. 22, 1999 (JP) ..... 11-364872

(51) Int. Cl.[7] ..... G09G 3/28
(52) U.S. Cl. ..... 345/68; 345/63; 345/66
(58) Field of Search ..... 345/60–63, 66–68

(56) References Cited

U.S. PATENT DOCUMENTS 6,097,358 A * 8/2000 Hirakawa et al. ..... 345/63
6,175,194 B1 * 1/2001 Saegusa et al. ..... 315/169.4
6,181,305 B1 * 1/2001 Nguyen et al. ..... 345/60
6,219,013 B1 * 4/2001 Amano ..... 345/60
6,252,568 B1 * 6/2001 Iseki et al. ..... 345/60
6,456,263 B1 * 9/2002 Hashimoto et al. ..... 345/60

* cited by examiner

*Primary Examiner*—Richard Hjerpe
*Assistant Examiner*—Duc Q Dinh
(74) *Attorney, Agent, or Firm*—Scully, Scott, Murphy & Presser

(57) ABSTRACT

A method of driving an ac-discharge type PDP is provided, which expands the permissible range of the voltage applied across the scan and data electrodes at writing discharge and which ensures desired writing discharge generation even if the writing voltage has a comparatively small amplitude. First, (a) a wall-charge adjustment step of storing first wall-charge of a first polarity near the respective scan electrodes and second wall-charge of a second polarity near the respective sustain electrodes is performed, where the second polarity is opposite to the first polarity. The first wall-charge of the first polarity stored near the respective scan electrodes generates an associate electric-field in the cells. The step (a) is performed by common application of at least one of a first wall-charge adjustment voltage pulse to the scan electrodes and a second wall-charge adjustment voltage pulse to the sustain electrodes. Thereafter, (b) a writing discharge generating step of generating writing discharge in the desired cells is performed. The step (b) is performed applying successively a scan voltage pulse to the scan electrodes and applying a data voltage pulse to the data electrodes according to desired image data. The main electric-field generated by the scan and data voltage pulses cooperates with the associate electric-field, thereby generating a desired writing voltage in the cells.

10 Claims, 49 Drawing Sheets

METHOD OF DRIVING AC-DISCHARGE PLASMA DISPLAY PANEL

BACKGROUND OF THE INVENTION

1. Field of the Invention

The present invention relates to a plasma display panel (PDP) and more particularly, to a method of driving a PDP of the ac discharge type having a preliminary discharge period for applying a preliminary discharge pulse or pulses to the scan electrodes and/or the sustain electrodes, a scan period for applying successively scan pulses to the individual scan electrodes, and a sustain period for applying sustain pulses to the scan and/or sustain electrodes.

2. Description of the Related Art

PDPs, which display images by utilizing light emission due to gas discharge, have ever been known as a display device that can be easily fabricated to have a large-sized flat screen. PDPs are divided into two types (i.e., the dc type and the ac type) according to the difference in the panel structure and operation principle. The dc-type PDPs have electrodes exposed to the discharge spaces while the ac-type PDPs have electrodes covered with dielectric.

The PDP according to the invention is of the ac-type and thus, only the ac-type PDPs will be explained below.

The ac-type PDPs have a typical configuration as shown in FIGS. 45, 46, and 47. FIG. 45 is a partially cutaway, perspective view showing the main elements or parts of the typical ac-type PDP, FIG. 46 is a cross-sectional view along the line XXXXVI—XXXXVI in FIG. 45, and FIG. 47 is a cross-sectional view along the line XXXXVII-XXXXVXI in FIG. 45.

As seen from FIGS. 45 to 47, the typical ac-type color PDP comprises two opposing dielectric substrates, i.e., a front substrate 51 and a rear substrate 52, that form a gap between them. The substrates 51 and 52 are typically made of glass. The following structure is provided in the gap.

Specifically, on the inner surface of the front substrate 51, scan electrodes 53 and sustain electrodes 54 are formed to be parallel to each other. The scan electrodes 53 and the sustain electrodes 54 constitute row electrodes. The electrodes 53 and 54 are covered with a dielectric layer 55*a* such as MgO. The dielectric layer 55*a* is covered with a protection layer 56.

On the inner surface of the rear substrate 52, data electrodes 57 are formed to be parallel to each other. The electrodes 57 are perpendicular to the row electrodes (i.e., the scan and sustain electrodes 53 and 54). The data electrodes 57 are covered with a dielectric layer 55*b* such as MgO. To convert the ultraviolet (UV) rays emitted by discharge to visible light, a phosphor layer 58 is formed on the layer 55*b*. The layer 58 includes three types of phosphor sublayers for three primary colors of red (R), green (G), and blue (B) arranged in the respective discharge cells, making it possible to display color images.

Partition walls 60 are provided in the gap between the front and rear substrates 51 and 52 to form the discharge cells, defining discharge spaces 59 for the respective cells. A gaseous mixture of at least two ones of He, Ne, Ar, Kr, Xe, $N_2$, $O_2$ and $CO_2$ is filled in the respective spaces 59 as the discharge gas.

FIG. 48 is a plan view showing the electrode structure of the color PDP shown in FIGS. 45 to 47.

As shown in FIG. 48, the count of the scan electrodes 53 extending along the rows of the PDP is m, where m is a natural number greater than unity. The scan electrodes 53 are referred as $S_i$ (i=1, 2, . . . , m). The count of the data electrodes 57 extending along the columns of the PDP is n, where n is a natural number greater than unity. The data electrodes 57 are referred as $D_j$ (j=1, 2, . . . , n). The discharge cells 61 are located at the respective intersections of the scan and data electrodes 53 and 57. Thus, the cells 61 are arranged in a matrix array.

The count of the sustain 54 extending along the rows of the PDP is m. Each of the sustain electrodes 54 and a corresponding, adjoining one of the scan electrodes 53, which are parallel to and apart from each other at a specific interval, forms an electrode pair. The sustain electrodes 54 are referred as $C_i$ (i=1, 2, . . . , m).

With the above-described ac-type color PDP, electric charge caused by discharge in the discharge spaces 59 is temporarily stored in the dielectric layers 55*a* and/or 55*b* and is eliminated therefrom. The electric charge (which may be termed simply "charge" hereinafter) stored in the layers 55*a* and 55*b* is termed the "wall charge". Generation and elimination of the discharge is controlled by adjusting or controlling the amount and/or distribution state of the "wall charge".

Next, an example of the conventional methods of driving the above-described ac-type PDP is explained below with reference to FIGS. 1 and 2.

FIG. 1 shows schematically the waveforms of the driving voltage applied to the respective electrodes. FIGS. 2A to 2F show schematically the distribution of the wall charge in the respective electrodes.

In FIG. 1, the period of time T2 in which the elimination pulse 105 and the preliminary discharge pulses 106 and 107 are applied is termed the "preliminary discharge period". The period of time T3 in which the scan pulse 108 and the data pulse 109 are applied is termed the "scan period". The period of time T4 in which the sustain pulse 110 is applied is termed the "sustain period". The combination of the "preliminary discharge period T2", the "scan period T3", and the "sustain period T4" is termed the "sub-field T1". In other words, the "sub-field T1" is formed by the preliminary discharge period T2, the scan period T3, and the sustain period T4.

The sub-field T1 corresponds to each cycle of the conventional driving method of the PDP explained here. Thus, the waveform diagram during one of the sub-fields T1 is shown in FIG. 1 and the change of the wall charge distribution during the same is shown in FIG. 2.

In the subsequent explanation in this specification, the rise of a positive pulse means the positive change of the voltage (i.e., the increase of the absolute value or amplitude of the voltage), and the fall of a positive pulse means the negative change of the voltage (i.e., the decrease of the absolute value or amplitude of the voltage). Also, the rise of a negative pulse means the negative change of the voltage (i.e., the increase of the absolute value or amplitude of the voltage), and the fall of a negative pulse means the negative change of the voltage (i.e., the decrease of the absolute value or amplitude of the voltage).

(1. Elimination of Sustain Discharge)

The rectangular elimination pulse 105 is applied to all the sustain electrodes 54 ($C_1$ to $C_m$). Thus, the ac discharge occurring in the light-emitting cells 61 due to the application of the rectangular sustain pulses 110 is stopped and at the same time, the wall charge stored in the dielectric layers 55*a* and 55*b* decreases or disappear. This operation to apply the elimination pulse 105 is termed the "sustain discharge elimination". FIG. 2A shows the state where the wall charge stored in the dielectric layers 55*a* and 55*b* has disappeared.

Several methods for the "sustain discharge elimination" have been known. In the method shown in FIG. 1, a narrow rectangular pulse is used as the elimination pulse 105. However, as the elimination pulse 105, a rectangular pulse 105*a* with a less amplitude and a greater width shown in FIG. 3 than the pulse 105 shown in FIG. 1 may be used. Also, a sawtooth-shaped pulse 105*b* with a linearly-increasing amplitude shown in FIG. 4 may be used as the elimination pulse 105.

(2. Preliminary Discharge)

After eliminating the sustain discharge by the pulse 105, a preliminary discharge pulse 106 is commonly applied to all the sustain electrodes 54 ($C_1$ to $C_m$) while a preliminary discharge pulse 107 is commonly applied to all the scan electrodes 53 ($S_1$ to $S_m$). At the rise time (i.e., at the leading edges) of the pulses 106 and 107, all the cells 61 are compulsively discharged. Thus, as shown in FIG. 2B, negative wall charge is generated and stored at the respective scan electrodes 53 while positive wall charge is generated and stored at the respective sustain electrodes 54. This discharge occurring at the leading edges of the pulses 106 and 107 is termed the "preliminary discharge".

At the subsequent fall time (i.e., at the trailing edges) of the pulses 106 and 107, discharge takes place in all the cells 61, thereby eliminating the wall charge stored in all the cells 61. The state of the wall charge distribution at this stage is shown in FIG. 2C. This discharge occurring at the fall time of the pulses 106 and 107 is termed the "preliminary discharge elimination".

The "preliminary discharge" and the "preliminary discharge elimination" facilitate the subsequent "writing discharge".

The "preliminary discharge elimination" eliminates the wall charge or decreases the wall charge to a level that prevents error discharge from occurring in the scan period T3 and the sustain period T4 prior to the writing discharge. Thus, the writing discharge is facilitated and at the same time, the error discharge due to the remaining wall charge in the unselected cells 61 is prevented in the periods T3 and T4.

In this example, the preliminary discharge is caused by the rise (i.e., the leading edge) of a rectangular pulse (106 or 107) applied commonly to the scan electrode 53 (S1 to Sm) and is eliminated by the fall (i.e., the trailing edge) of the same pulse. However, the preliminary discharge and its elimination maybe caused by separate pulses. For example, as shown in FIG. 5, the preliminary discharge is caused by a positive rectangular pulse 107*a* applied commonly to the scan electrode 53 ($S_1$ to $S_m$) and its elimination is caused by a negative rectangular pulse 107*b* applied commonly to the same.

Moreover, the preliminary discharge pulse is not limited to a rectangular pulse. The preliminary discharge pulse may have any waveform capable of causing the above-described preliminary discharge operation. For example, a sawtooth-shaped pulse 107*c* with a linearly-increasing amplitude shown in FIG. 6 may be used as the preliminary discharge pulse.

(3. Writing Discharge)

After the preliminary discharge is eliminated, the rectangular scan pulses 108 are successively applied to the scan electrodes 53 ($S_1$ to $S_m$) at different timing so as to scan them. At the same time as this, the rectangular data pulses 109 according to the image data to be displayed are applied to the data electrodes 57 ($D_1$ to $D_n$) in synchronization with the scan pulses 108. The cells 61 are turned on or off according to existence or absence of the corresponding data pulses 109. For example, if one of the cells 61 is applied with the data pulse 109 along with the scan pulse 108, discharge occurs in the space 59 of the cell 61 in question. On the other hand, no discharge occurs in the cells 61 applied with no data pulse 109. Thus, the image data to be displayed is written into the selected cells 61 according to the existence and absence of discharge in the spaces 59. This discharge is termed the "writing discharge".

(4. Sustain Discharge)

In the selected cells 61 where writing discharge has occurred, positive wall charge is stored in the dielectric layer 55*a* over the scan electrodes 53 and at the same time, negative wall charge is stored in the dielectric layer 55*b* over the data electrodes 57. As a result, the wall charge distribution in the selected cells 61 has a state shown in FIG. 2D. On the other hand, no writing discharge occurs in the unselected cells 61 and thus, the wall charge distribution is kept in the state shown in FIG. 2C.

In the selected cells 61, thereafter, the positive potential due to the positive wall charge stored in the dielectric layer 55*a* over the scan electrodes 53 is superposed the inter-electrode voltage between the sustain electrodes 54 and the corresponding scan electrodes 53 due to the first one of the sustain pulses 110, causing the "first sustain discharge".

When the first sustain discharge has occurred, the wall charge distribution changes to the state shown in FIG. 2E. Specifically, positive wall charge is stored in the dielectric layer 55*a* over the sustain electrodes 54 and at the same time, negative wall charge is stored in the same dielectric layer 55*a* over the scan electrodes 53. Thereafter, the potential difference due to the positive and negative wall charge stored in the dielectric layer 55*a* is superposed the inter-electrode voltage between the sustain electrodes 54 and the corresponding scan electrodes 53 due to the second one of the sustain pulses 110, causing the "second sustain discharge".

Because of the "second sustain discharge", the wall charge distribution changes to the state shown in FIG. 2F, where negative wall charge is stored in the dielectric layer 55*a* over the sustain electrodes 54 and positive wall charge is stored in the same dielectric layer 55*a* over the scan electrodes 53.

Thus, the potential difference due to the stored wall charge by the sustain discharge according to the k-th sustain pulse 110 is superposed the inter-electrode voltage between the sustain electrodes 54 and the corresponding scan electrodes 53 due to the (k+1)-th sustain pulse 110, causing the "(k+1)-th sustain discharge". As a result, the sustain discharge is continued.

Normally, the voltage value (i.e., amplitude) of the sustain pulses 110 is determined or adjusted in advance in such a way that the application of the pulse 110 alone without the inter-electrode voltage is unable to cause any discharge. Therefore, sustain discharge occurs in the cells 61 where writing discharge has occurred while sustain discharge does not occur in the cells 61 where writing discharge has not occurred.

Next, a method of displaying images with gradation is explained below with reference to FIG. 49.

A field T0 (e.g., 1/60 second), which is a period of time for displaying an image, is divided into several sub-fields. In the example in FIG. 49, the field T0 is divided into four sub-fields T1-1, T1-2, T1-3, and T1-4. Each of the sub-fields T1-1, T1-2, T1-3, and T1-4 has the configuration shown in FIG. 1; i.e., each sub-field T1-1, T1-2, T1-3, or T1-4 comprises the preliminary discharge period T2, the scan period T3, and the sustain period T4. In each sub-field T1-1, T1-2, T1-3, or T1-4, the operation to display or not to display an image is adjustable independently. Also, the count of the sustain pulses 110 included in each sub-field T1-1, T1-2, T1-3, or T1-4 is different from each other and thus, it provides different brightness levels.

In the field T0 comprising the four sub-fields T1-1, T1-2, T1-3, and T1-4, for example, the individual sub-fields T1-1, T1-2, T1-3, and T1-4 are designed to provide different brightness levels having a ratio of 1:2:4:8. In this case, due to selection and combination of the sub-fields T1-1, T1-2, T1-3, and T1-4 that provide different brightness levels, images can be displayed at 16 brightness levels. When none of the sub-fields is selected, the brightness level is set as 0. The brightness level is set as 15 when all the sub-fields is selected.

With the above-described conventional ac-type PDP, the voltage applied across the scan electrodes 53 and the data electrodes 57 at the writing discharge (which may be termed the "writing voltage" hereinafter) has a narrow permissible range that provides normal and desired operation of the PDP. Thus, if the permissible range of the writing voltage in the respective cells 61 fluctuates due to parameter variation in the fabrication process sequence of the PDP, there arises a problem that a part of the cells 61 emit light in error and another part of the cells 61 emit no light in error. This means that the PDP does not display correct images as desired.

Therefore, there has been the strong need to develop the technique that makes it possible to cause desired writing discharge even if the writing voltage is lowered.

The above need may be solved by the method to use the superposed wall discharge stored in the dielectric layer over the scan electrodes or the data electrodes. In this case, however, the storing behavior of the wall charge in the dielectric layer over the scan or data electrodes is difficult to be controlled. Thus, there arises a problem that too much wall discharge is stored, thereby causing error discharge. Alternately, there arises a problem that too little wall discharge is stored and thus, a desired writing voltage is unable to be generated.

SUMMARY OF THE INVENTION

Accordingly, an object of the present invention to provide a method of driving an ac-discharge type PDP that expands the permissible range of the voltage applied across the scan and data electrodes at writing discharge.

Another object of the present invention to provide a method of driving an ac-discharge type PDP that ensures desired writing discharge generation even if the writing voltage has a comparatively small amplitude.

Still another object of the present invention to provide a method of driving an ac-discharge type PDP that displays desired images correctly at high quality even if the writing voltage has a comparatively small amplitude.

A further object of the present invention to provide a method of driving an ac-discharge type PDP that prevents error discharge.

A still further object of the present invention to provide a method of driving an ac-discharge type PDP that controls easily and correctly the storing behavior of the wall charge in the dielectric layer over the scan or data electrodes.

The above objects together with others not specifically mentioned will become clear to those skilled in the art from the following description.

According to the present invention, a method of driving an ac-discharge PDP is provided. The PDP comprises scan electrodes and sustain electrodes extending in parallel in a first direction and data electrodes extending in a second direction. The scan electrodes, the sustain electrodes, and the data electrodes form cells arranged regularly for displaying images using discharge-induced emission.

The method comprises:

(a) a wall-charge adjustment step of storing first wall-charge of a first polarity near the respective scan electrodes and second wall-charge of a second polarity near the respective sustain electrodes, where the second polarity is opposite to the first polarity;

the first wall-charge of the first polarity stored near the respective scan electrodes generating an associate electric-field in the cells;

the wall-charge adjustment step being performed by (i) applying commonly a first wall-charge adjustment voltage pulse to the scan electrodes, or (ii) applying commonly a second wall-charge adjustment voltage pulse to the sustain electrodes, or (iii) applying commonly a first wall-charge adjustment voltage pulse to the scan electrodes and applying commonly a second wall-charge adjustment voltage pulse to the sustain electrodes; and (b) a writing discharge generating step of generating writing discharge in the desired cells;

the writing discharge generation step being performed after the wall-charge adjustment step by applying successively a scan voltage pulse to the scan electrodes and applying a data voltage pulse to the data electrodes according to desired image data;

the scan voltage pulse and the data voltage pulse generating a main electric-field in the cells;

the main electric-field cooperating with the associate electric-field, thereby generating a writing voltage in the cells.

With the method according to the first aspect of the present invention, prior to the writing discharge generation step of generating the writing discharge in the desired cells, the wall-charge adjustment step of storing the first wall-charge of the first polarity near the respective scan electrodes and the second wall-charge of the second polarity near the respective sustain electrodes is performed. Thus, before the writing discharge generation step begins, the first wall-charge is stored near the respective scan electrodes and the second wall-charge is stored near the respective sustain electrodes, generating the associate electric-field in the cells.

On the other hand, in the writing discharge generation step, the scan voltage pulse is successively applied to the scan electrodes and the data voltage pulse is applied to the data electrodes according to the desired image data, generating the main electric-field in the cells. The main electric-field cooperates with the associate electric-field, thereby generating the writing voltage in the cells.

As a result, the writing discharge is generated or caused by the sum of the main electric-field and the associate electric-field, which ensures desired writing discharge generation even if the writing voltage has a comparatively small amplitude. In other words, the permissible range of the voltage applied across the scan and data electrodes at the writing discharge is expanded. Consequently, desired images are displayed correctly (without any error discharge) at high quality even if the writing voltage has a comparatively small amplitude.

Moreover, the wall-charge adjustment step is performed by application of at least one of the first and second wall-charge adjustment voltage pulses and therefore, the amount of the first wall charge and that of the second wall charge can be well adjusted or controlled by changing/adjusting the waveform, amplitude, width, and/or polarity of the at least one of the first and second wall-charge adjustment voltage pulses. This means that the desired writing discharge is caused more easily compared with the case where the wall-charge adjustment step is not included.

In a preferred embodiment of the method according to the invention, at least one of the first and second wall-charge adjustment voltage pulses is prepared independent of a preliminary discharge pulse for generating preliminary discharge. The at least one of the first and second wall-charge adjustment voltage pulses is applied after the preliminary discharge pulse is applied.

In another preferred embodiment of the method according to the invention, at least one of the first and second wall-charge adjustment voltage pulses is prepared to be combined with a preliminary discharge pulse for generating preliminary discharge. The at least one of the first and second wall-charge adjustment voltage pulses is applied after the preliminary discharge pulse is applied.

It is preferred that at least one of the first and second wall-charge adjustment voltage pulses has a part whose amplitude varies. More preferably, the at least one of the first and second wall-charge adjustment voltage pulses has a part whose amplitude varies approximately linearly.

In still another preferred embodiment of the method according to the invention, an associate scan voltage pulse is commonly applied to the sustain electrodes in the writing discharge generation step. The associate scan voltage pulse serves to decrease or eliminate the second wall-charge stored near the respective sustain electrodes in the cells, preventing error discharge.

In a further preferred embodiment of the method according to the invention, a wall-charge elimination voltage pulse is commonly applied to the scan electrodes after the writing discharge generation step is finished. The wall-charge elimination voltage pulse serves to decrease or eliminate the first and second wall-charge left near the respective scan and sustain electrodes in the cells where no writing discharge has occurred, preventing light from being emitted in error.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
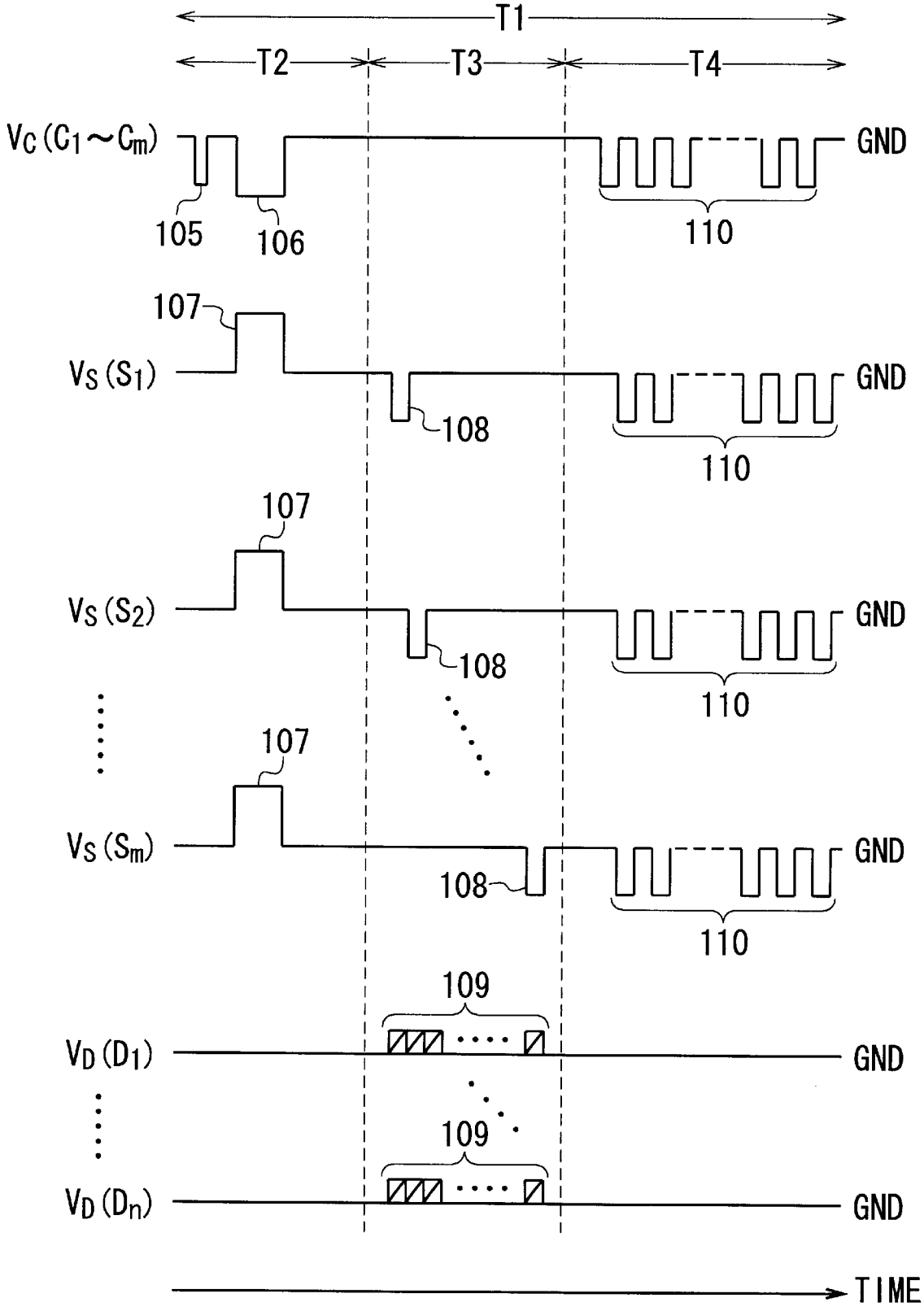
FIG. 1 PRIOR ART
FIG. 1 is a schematic waveform diagram showing the waveform of the driving voltage pulses applied to the respective electrodes in a conventional method of driving an ac-type PDP.

Preferred embodiments of the present invention will be described in detail below while referring to the drawings attached.

First Embodiment

A method of driving an ac-discharge type PDP according to a first embodiment of the present invention is shown in FIG. 7 and FIGS. 8A to 8D. In this embodiment and other embodiments explained later, the ac-discharge type PDP has the same configuration as shown in FIGS. 45 to 48 and therefore, the explanation on the configuration is omitted here.

Figure 7:
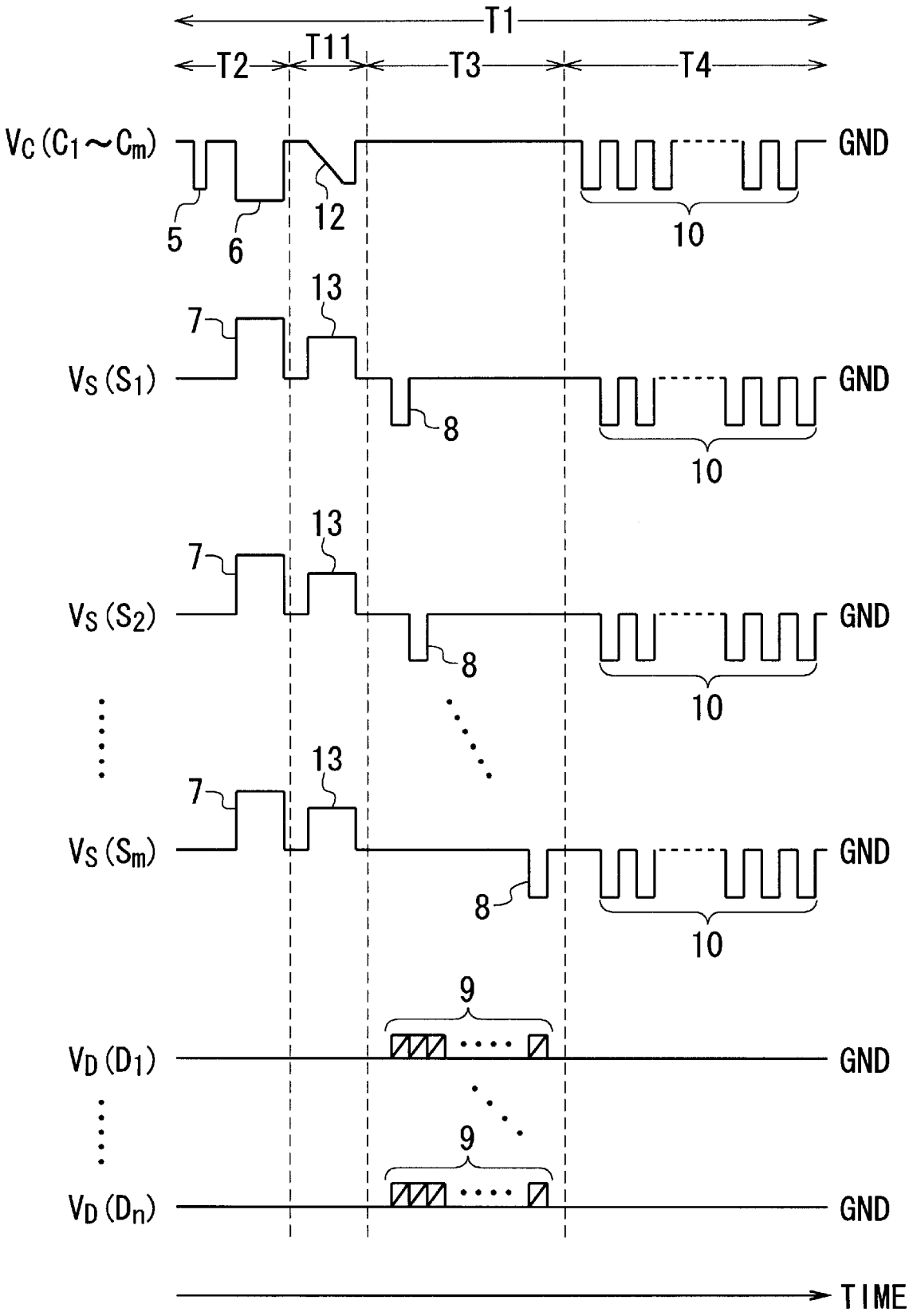
FIG. 7 is a schematic waveform diagram showing the waveform of the driving voltage pulses applied to the respective electrodes in a method of driving an ac-type PDP according to a first embodiment of the invention.

As shown in FIG. 7, this driving method includes a sub-field T1 comprising a preliminary discharge period T2, a scan period T3, a sustain period T4, and a wall-charge adjustment period T11. This is the same as the conventional method shown in FIG. 1 except that the wall-charge adjustment period T11 is additionally provided between the preliminary discharge period T2 and the scan period T3.

The voltage applied to the scan voltages 53 ($S_1$ to $S_m$) may be referred as $V_S$, the voltage applied to the sustain voltages 54 ($C_1$ to $C_m$) may be referred as $V_C$, the voltage applied to the data voltages 57 ($D_1$ to $D_n$) may be referred as $V_D$.

Figure 8A:
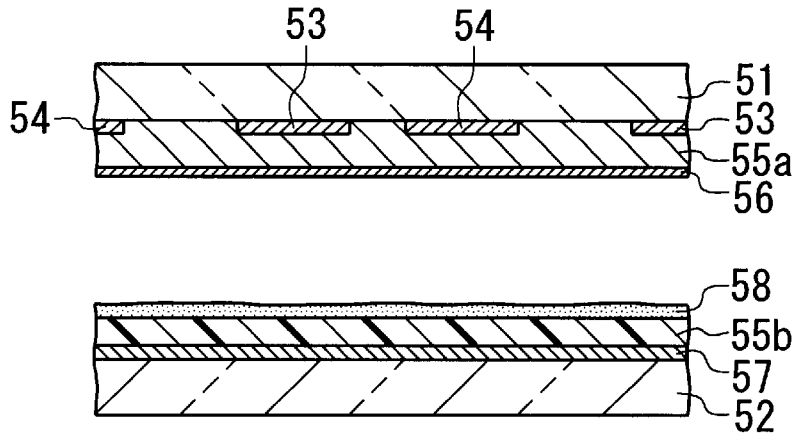
FIGS. 8A to 8E are partial cross-sectional views showing schematically the distribution of the wall charge in the method according to the first embodiment of FIG. 7, respectively.

In the preliminary discharge period T2, first, as shown in FIG. 7, a sustain elimination pulse 5 with a narrow, rectangular waveform is commonly applied to all the sustain electrodes 54 ($C_1$ to $C_m$). Due to common application of the pulse 5, the sustain discharge, which has been kept by the application of the sustain pulses 10 in the prior sustain period T4, is stopped in the light-emitting cells 61 and at the same time, the wall-charge stored in the dielectric layers 55*a* and 55*b* is eliminated. Thus, as shown in FIG. 8A, the wall-charge stored in the layers 55*a* and 55*b* is eliminated. This is the same as in the conventional method shown in FIG. 1.

In the previously-described conventional method of FIG. 1, a rectangular pulse with an amplitude ranging from −100 V to −150 V is used as the elimination pulse 105, eliminating the wall charge generated in the prior sub-field T1. The same rectangular pulse with an amplitude ranging from −100 V to −150 V is used as the elimination pulse 5 in the method of the first embodiment. A pulse with any other waveform may be used as the pulse 5 in the first embodiment if it has the same effect or function. A set of pulses may be applied instead of the pulse 5 if they have the same effect or function.

Figure 8B:
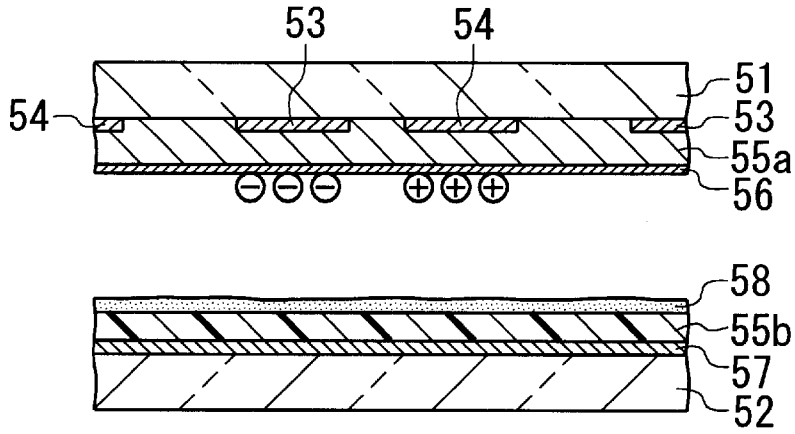
Figure 8C:
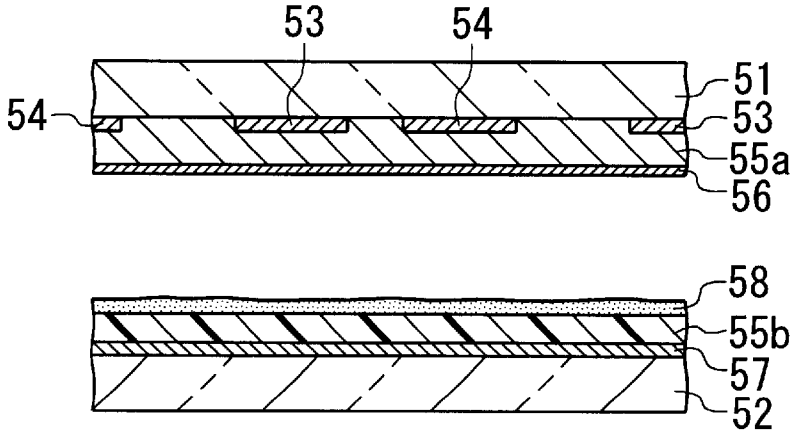

After the sustain discharge is stopped or eliminated y the pulse 5, a preliminary discharge pulse 6 is commonly applied to all the sustain electrodes 54 ($C_1$ to $C_m$) while a preliminary discharge pulse 7 is commonly applied to all the scan electrodes 54 ($S_1$ to $S_m$). Thus, preliminary discharge occurs compulsively in all the cells 61 at the rise (i.e., at the leading edges) of the pulses 6 and 7. Due to the preliminary discharge thus occurred, as shown in FIG. 8B, negative wall charge is stored in the dielectric layer 55*a* over the scan electrodes 53 and at the same time, positive wall charge is stored in the same dielectric layer 55*a* over the sustain electrodes 54. The positive and negative wall charge thus stored generates a voltage of −150 V to −200 V on the side of the sustain electrodes 54 and a voltage of 150 V to 200 V on the side of the scan electrodes 53. At the fall (i.e., at the trailing edges) of the pulses 6 and 7, preliminary elimination discharge occurs by the wall charge thus stored by the preliminary discharge in all the cells 61, thereby eliminating the wall charge, as shown in FIG. 8C.

In the wall-charge adjustment period T11, which is located between the preliminary discharge period T2 and the scan period T3, a wall-charge adjustment pulse 12 with a negative value is commonly applied to the sustain electrodes 54 and a wall-charge adjustment pulse 13 with a positive value is commonly applied to the scan electrodes 53. In this embodiment, the wall-charge adjustment pulse 12 has a blunt or dull waveform raising gradually the sustain voltage $V_C$ from zero to a specific negative peak value. The wall-charge adjustment pulse 13 has a rectangular waveform with a positive, constant value.

Because the wall-charge adjustment pulse 12 applies the sustain voltage $V_C$ that rises gradually from zero to a specific negative peak value to the sustain electrodes 54, feeble discharge is caused initially and then, the discharge thus caused becomes gradually stronger. Thus, the amount of the stored wall charge is increased gradually during the application period of the pulse 12. As a result, desired wall charge is stored in the dielectric layer 55*a* over the scan and sustain electrodes 53 and 54 more correctly and more easily. In other words, the amount of the wall charge is well controllable according to the necessity. This makes it possible to cause desired writing discharge in the cells 61 even if the writing voltage is low.

Figure 8D:
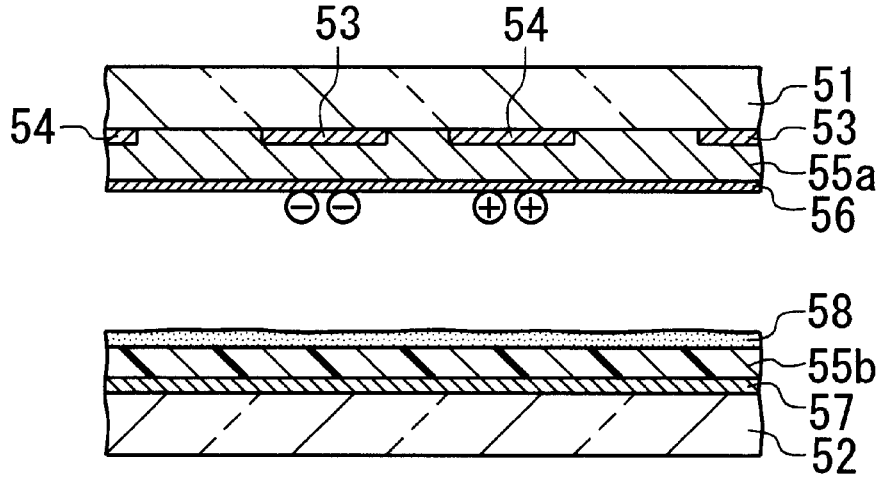

In the first embodiment of FIG. 7, the amplitude of the scan voltage $V_S$ (i.e., the peak voltage of the wall charge adjustment pulse 13) is set at a value from 80 V to 150 V and the maximum amplitude of the sustain voltage $V_C$ (i.e., the peak voltage of the wall charge adjustment pulse 12) is set at a value of −80 V to −150 V. Thus, desired discharge occurs between the scan and sustain electrodes 53 and 54, thereby storing wall charge in the dielectric layer 55*a*, as shown in FIG. 8D. In FIG. 8D, negative wall charge is stored rear the scan electrodes 53 and positive wall charge is stored near the sustain electrodes 54.

In the subsequent scan period T3, scan pulses 8, which have the same rectangular waveform and the same negative amplitude, are successively applied to all the scan electrodes 53 ($S_1$ to $S_m$). Synchronized with the scan pulses 9 thus applied, data pulses 9, which have rectangular waveform and the same negative amplitude, are suitably applied to the data electrodes 57 (D1 to Dn) according to the image signal, respectively. The amplitude ($V_{S1}$ to $V_{Sm}$) of the scan pulses 8 is set at a value ranging from −130 to −190 V. The amplitude ($V_{D1}$ to $V_{Dn}$) of the data pulses 9 is set at a value ranging from 30 to 80 V.

In the light-emitting cells 61, since the negative wall charge has been stored in the dielectric layer 55*a* over the scan electrodes 53 in the prior wall-charge adjustment period T11, it forms the "associate electric-field" in the respective discharge spaces 59. In addition to the electric-field thus formed by the wall charge, the scan voltage ($V_{S1}$ to $V_{Sn}$) applied to the scan electrodes 53 and the data voltage ($V_{D1}$ to $V_{Dn}$) applied to the data electrodes 57 generates the "main electric-field" in the respective spaces 59. The main and associate electric-fields are superposed or summed in the spaces 59, thereby causing desired writing discharge in these cells 61 even if the amplitude of the scan and/or data voltage is smaller than the conventional method explained with reference to FIG. 1.

Concretely, with the conventional method shown in FIG. 1, desired writing discharge is caused by application of the scan voltage of −170 V to −190 V and/or the data voltage of 50 V to 80 V. On the other hand, with the method according to the first embodiment shown in FIG. 7, desired writing discharge is caused by application of the scan voltage of −130 V to −170 V and/or the data voltage of 30 V to 50 V, both of which are lower than those in the conventional method.

If the scan voltage is set as −170 V to −190 V and/or the data voltage of 50 V to 80 V in the method according to the first embodiment, like the conventional method, a stronger electric-field is generated by the superposed or summed voltages. Thus, desired writing discharge will occur more easily compared with the case where the scan voltage is set as −130 V to −170 V and/or the data voltage is set as 30 V to 50 V.

Figure 8E:
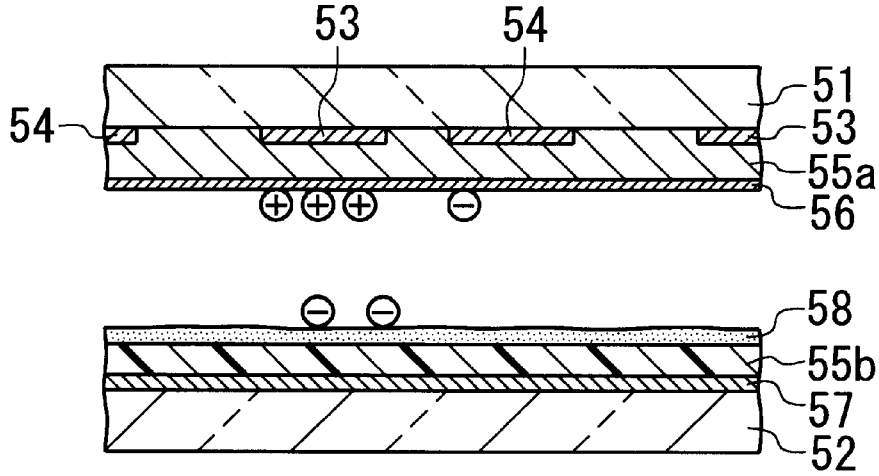

At the time the scan period T3 is finished, the desired writing discharge has occurred in the light-emitting cells 61 (i.e., selected cells). Thus, positive wall charge is stored in the dielectric layer 55*a* over the scan electrodes 53 while negative wall charge is stored in the dielectric layer 55*b* over the data electrodes 57 in these cells 61. As a result, the wall charge distribution in the selected cells 61 has the state shown in FIG. 8E. On the other hand, no writing discharge has occurred in the unselected cells 61 and therefore, the wall charge distribution in the unselected cells 61 is kept in the state shown in FIG. 8D.

In the subsequent sustain period T4, a set of rectangular sustain pulses 10 are commonly and successively applied to the sustain electrodes 54 and the scan electrodes 53. The application timing of the pulses 10 to the sustain electrodes 54 and to the scan electrodes 53 are different from each other. Specifically, the pulses 10 are alternately applied to these electrode 53 and 54. In other words, when a specific one of the pulses 10 is commonly applied to the scan electrodes 53, it is not applied to the sustain electrodes 54. In contrast, when a specific one of the pulses 10 is commonly applied to the sustain electrodes 54, it is not applied to the scan electrodes 53.

The voltage value or amplitude $V_C$ of the sustain pulses 10 is, for example, set at a value ranging from −150 V to −180 V. This voltage value of the pulses 10 (i.e., the sustain voltage $V_C$) is determined so as to cause desired discharge continuously in the emitting or selected cells 61 and to cause no discharge in the non-emitting or unselected cells 61.

Figure 49:
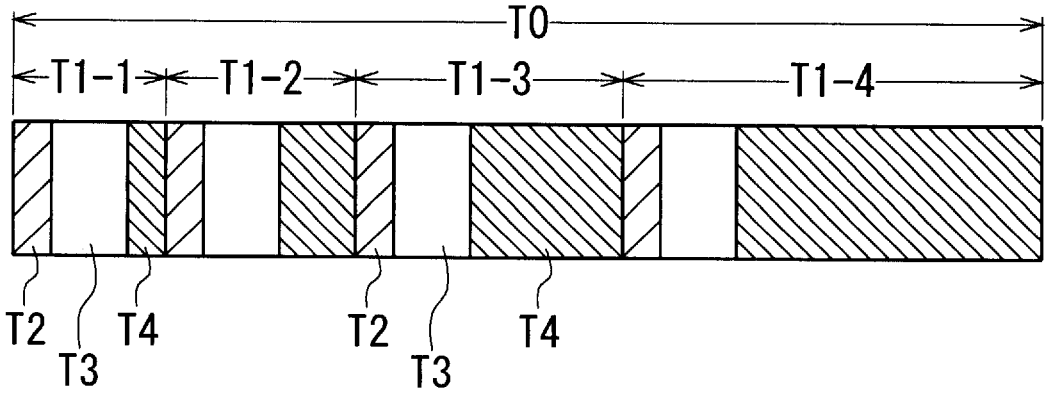
FIG. 49 is a schematic diagram showing the content of the field, in which the field is divided into four sub-fields, each of the sub-fields comprising the preliminary discharge period, the scan period, and the sustain period.

Additionally, the method to display images with gradation is the same as explained in the conventional driving method with reference to FIG. 49. Therefore, the explanation on this is omitted here.

With the method according to the first embodiment of the invention shown in FIG. 7, prior to the scan period T3 where desired writing discharge is generated in the desired cells 61, the wall-charge adjustment period T11 is provided to store the negative wall-charge near the respective scan electrodes 53 and the positive wall-charge near the respective sustain electrodes 54. Thus, before the scan period T3 begins, the negative wall-charge is stored near the respective scan electrodes 53 and the positive wall-charge is stored near the respective sustain electrodes 54, generating the associate electric-field in the cells 61.

On the other hand, in the scan period T3, the scan voltage pulse 8 is successively applied to the scan electrodes 53 and the data voltage pulse 9 is applied to the data electrodes 57 according to the desired image data, generating the main electric-field in the cells 61. The main electric-field cooperates with the associate electric-field, thereby generating the writing voltage in the cells 61.

As a result, the desired writing discharge is generated or caused by the sum of the main electric-field and the associate electric-field, which ensures desired writing discharge generation even if the writing voltage has a comparatively small amplitude. In other words, the permissible range of the voltage applied across the scan and data electrodes 53 and 57 at the writing discharge is expanded. Consequently, desired images are displayed correctly (without any error discharge) at high quality even if the writing voltage has a comparatively small amplitude.

Moreover, in the wall-charge adjustment period T11, the wall-charge adjustment voltage pulses 12 and 13 are applied and therefore, the amount of the positive and negative wall charge stored in the dielectric layer 55*a* near the respective scan and sustain electrodes 53 and 54 can be well adjusted or controlled by changing/adjusting the waveform, amplitude, width, and/or polarity of at least one of the wall-charge adjustment voltage pulses 12 and 13. This means that the desired writing discharge is caused more easily compared with the conventional method shown in FIG. 1.

Figure 9:
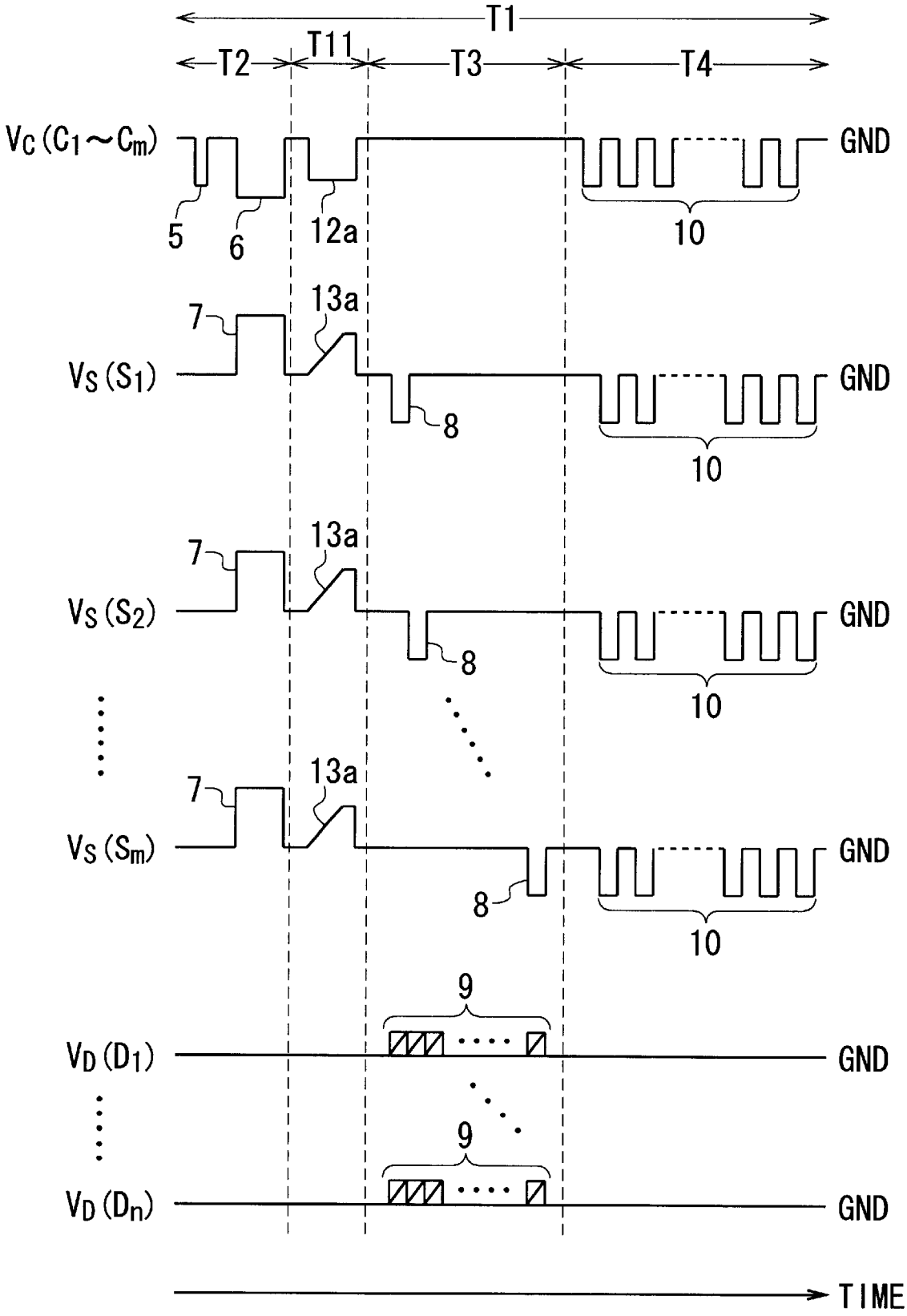
FIG. 9 is a schematic waveform diagram showing a variation of the waveform of the driving voltage pulses applied to the respective electrodes in the method according to the first embodiment of FIG. 7.
Figure 10:
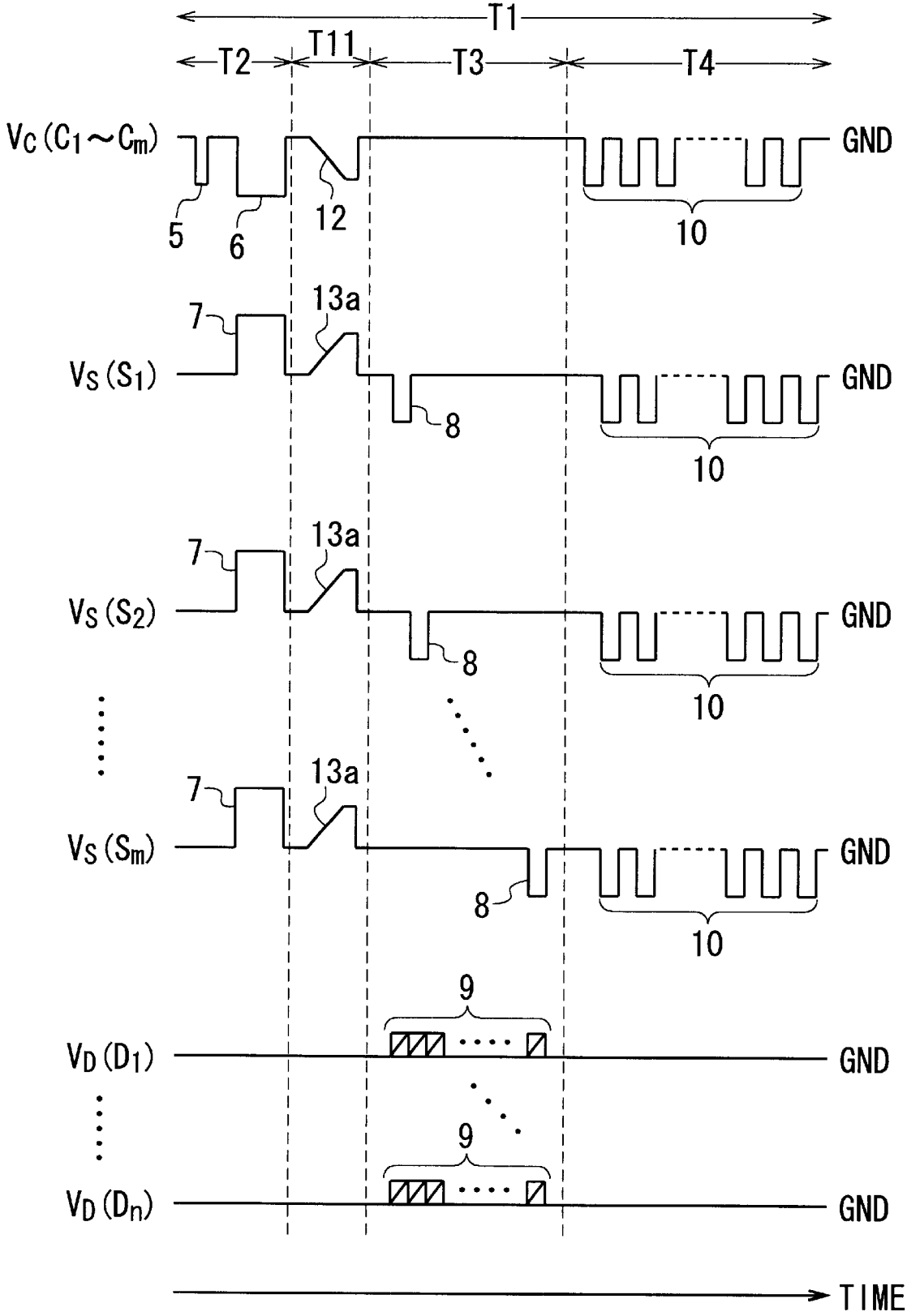
FIG. 10 is a schematic waveform diagram showing another variation of the waveform of the driving voltage pulses applied to the respective electrodes in the method according to the first embodiment of FIG. 7.

In the method according to the first embodiment, only the wall-charge adjustment pulse 12 has an increasing amplitude in the wall-charge adjustment period T11. However, a wall-charge adjustment pulse 13*a* with an increasing amplitude may be applied in the period T11 instead of the rectangular pulse 13, as shown in FIG. 9. Moreover, each of the wall-charge adjustment pulses 12 and 13*a* may have an increasing amplitude in the period T11, as shown in FIG. 10.

Second Embodiment

Figure 11:
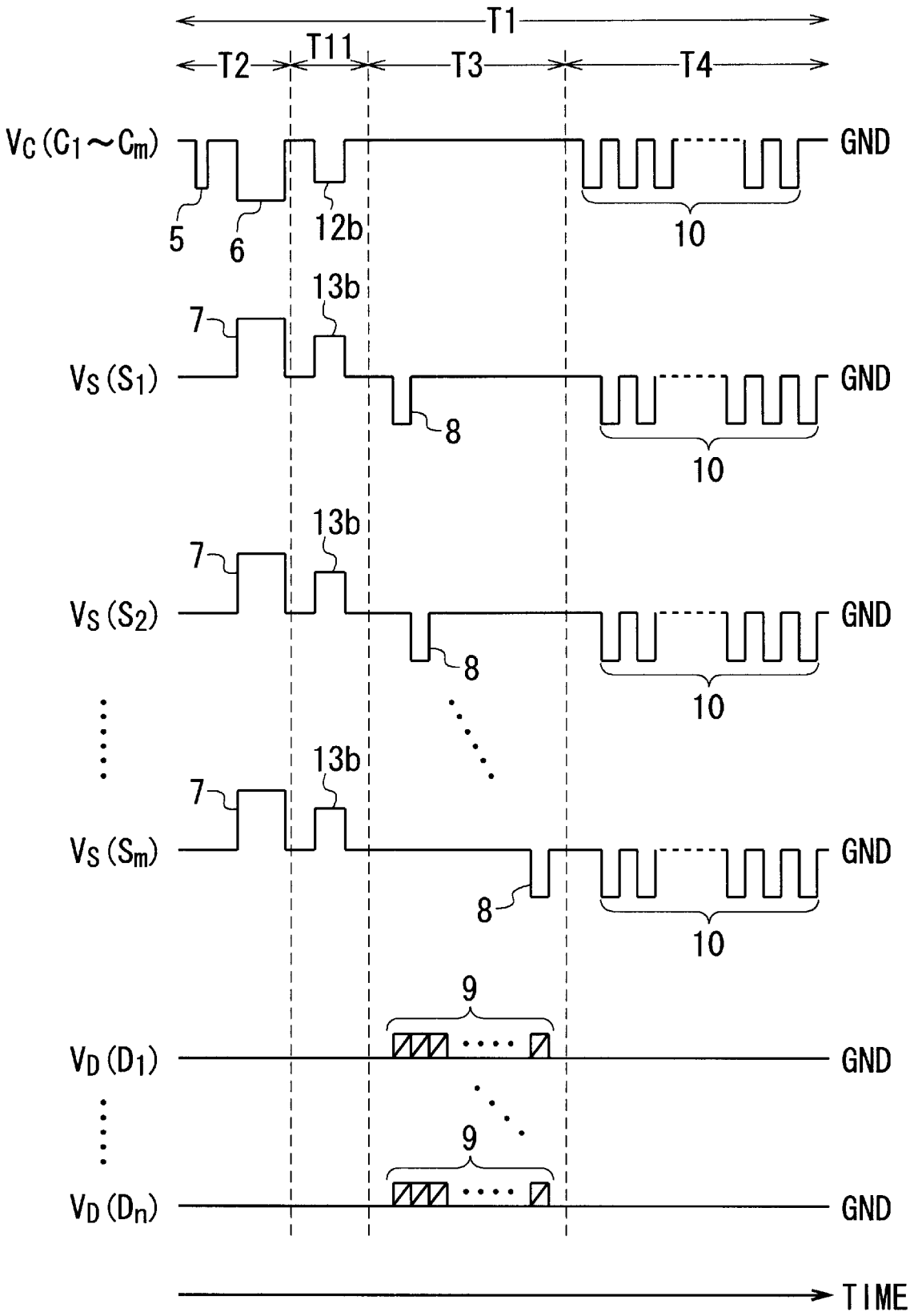
FIG. 11 is a schematic waveform diagram showing the waveform of the driving voltage pulses applied to the respective electrodes in a method of driving an ac-type PDP according to a second embodiment of the invention.

FIG. 11 shows a method of driving an ac-discharge type PDP according to a second embodiment of the invention, which is the same as the method according to the first embodiment of FIG. 7 except that rectangular pulses 12*b* and 13*b* are used instead of the wall-charge adjustment pulses 12 and 13, respectively. Therefore, the explanation about the same pulses and operation is omitted here for the sake of simplification by attaching the same reference symbols as those in FIG. 7 to the same elements in FIG. 11.

In the method of the second embodiment, the wall-charge adjustment pulse 12 applies the sustain voltage $V_C$ with a fixed amplitude to the sustain electrodes 54. Thus, the amount of the wall charge is not so controllable as the method in the first embodiment. However, if precise control of the wall charge amount is unnecessary and only the superposition or summation of the main and associate electric-fields due to the wall charge thus stored is necessary, the rectangular wall-charge adjustment pulses 12*b* and 13*b* are acceptable. The second embodiment is effective to this case.

Third Embodiment

Figure 12:
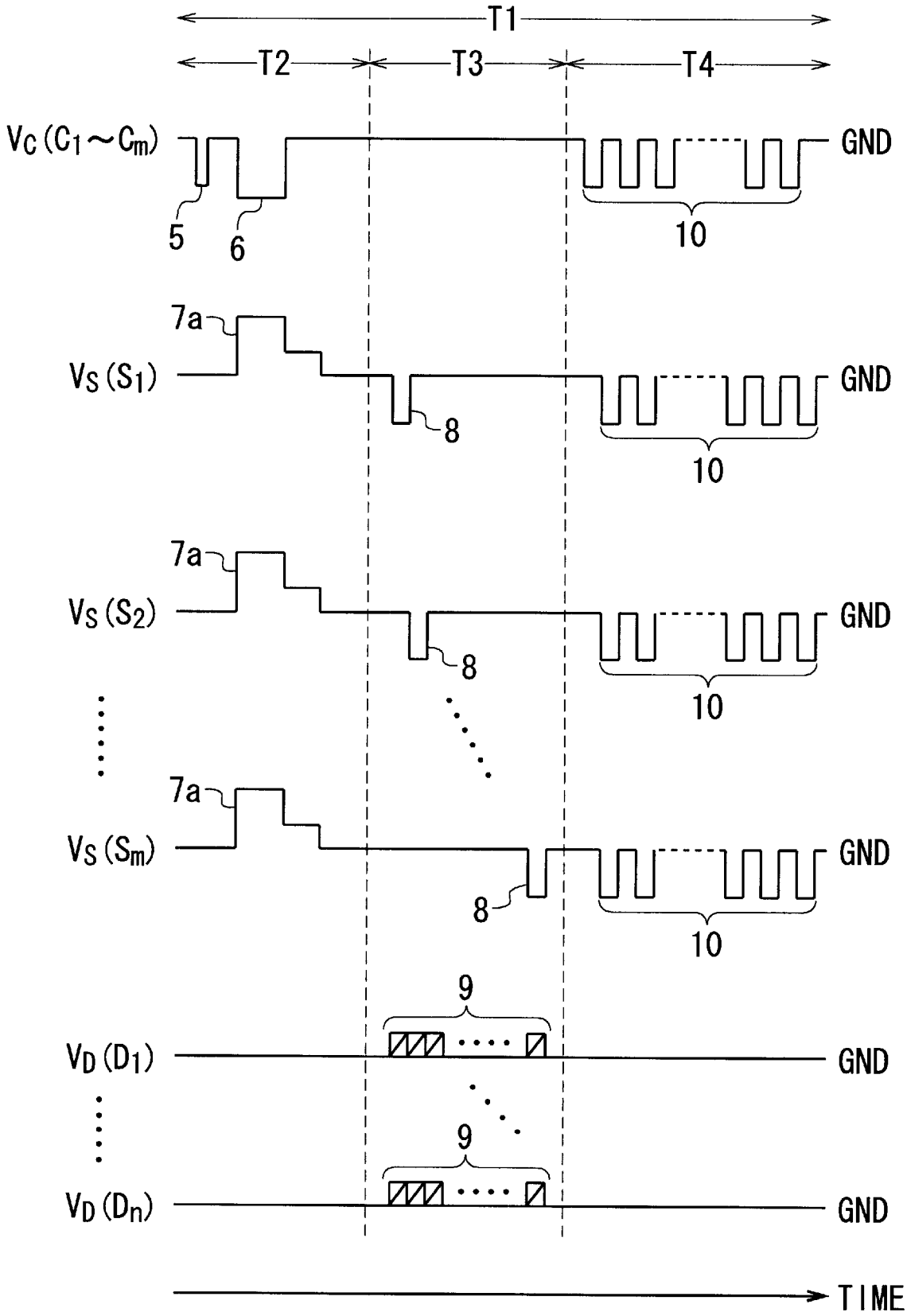
FIG. 12 is a schematic waveform diagram showing the waveform of the driving voltage pulses applied to the respective electrodes in a method of driving an ac-type PDP according to a third embodiment of the invention.

FIG. 12 shows a method of driving an ac-discharge type PDP according to a third embodiment of the invention, which is the same as the conventional method shown in FIG. 1 except that a preliminary discharge pulse 7*a* is used in the preliminary discharge period T2 instead of the preliminary discharge pulse 7.

The pulse 7*a* is formed by a rectangular leading part and a rectangular trailing part connected to each other. The leading part of the pulse 7*a* has a greater positive amplitude than the trailing part. The leading part of the pulse 7 is the same as the pulse 7. The trailing part of the pulse 7 has an amplitude of 10 V to 80 V.

In the preliminary discharge period T2, the sustain discharge elimination pulse 5 is commonly applied to all the sustain electrodes 54 ($C_1$ to $C_m$) and then, the preliminary discharge pulse 6 is commonly applied to the same electrodes 54. At the same time as the application of the pulse 6, the preliminary discharge pulse 7*a* is commonly applied to all the scan electrodes 53 ($S_1$ to $S_m$). The application of the leading part of the pulse 7*a* ends at the trailing edge of the pulse 6. This is the same as the conventional method shown in FIG. 1. Thereafter, unlike the conventional method of FIG. 1, only the trailing part of the pulse 7*a* is applied to all the electrodes 53.

Figure 2A:
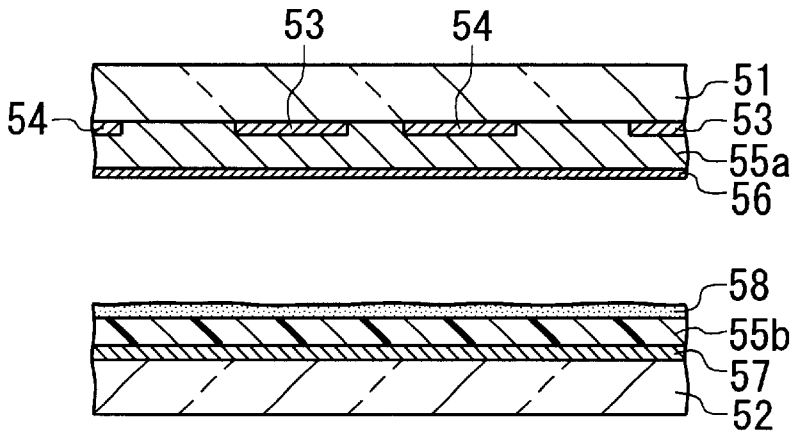
FIG. 2A PRIOR ART
FIGS. 2A to 2F are partial cross-sectional views showing schematically the distribution of the wall charge in the conventional method of FIG. 1, respectively
Figure 2B:
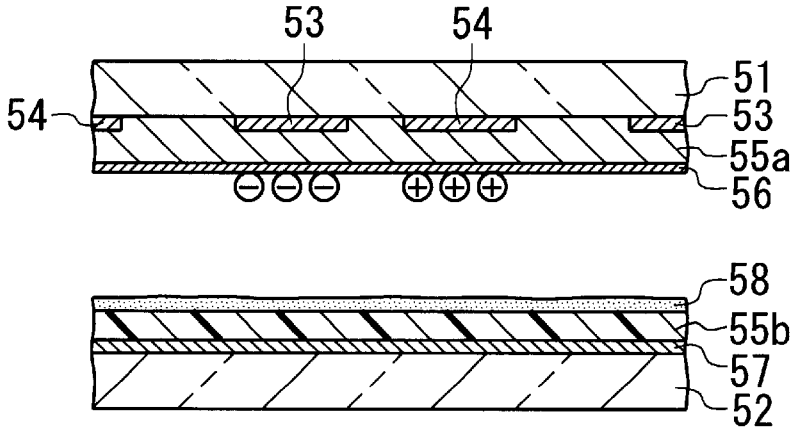
FIG. 2B PRIOR ART
Figure 2C:
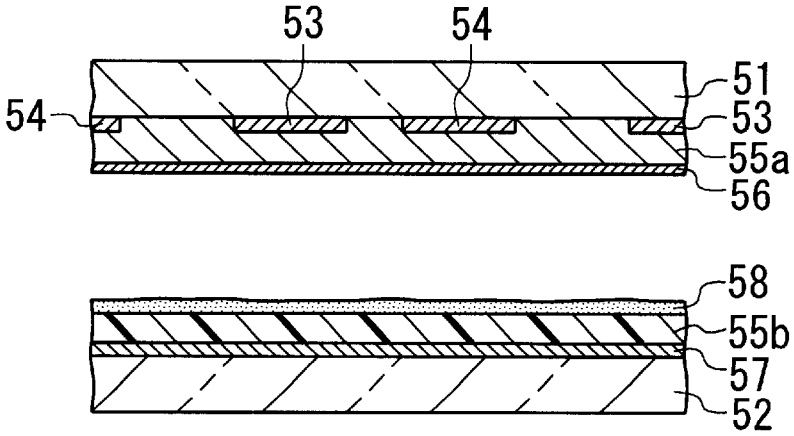
FIG. 2C PRIOR ART
Figure 2D:
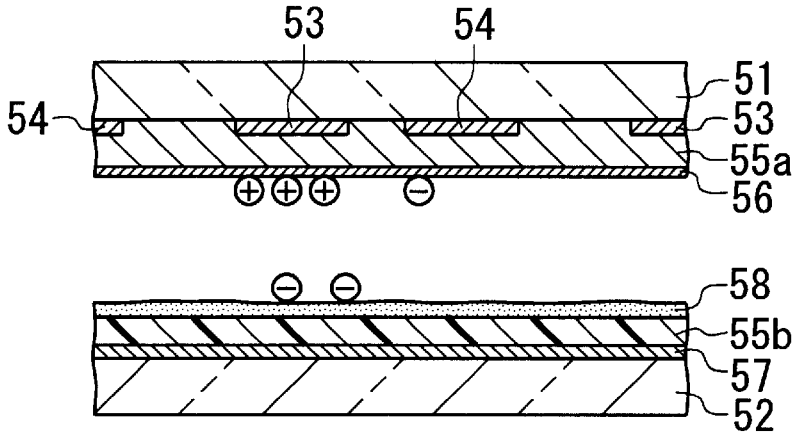
FIG. 2D PRIOR ART
Figure 2E:
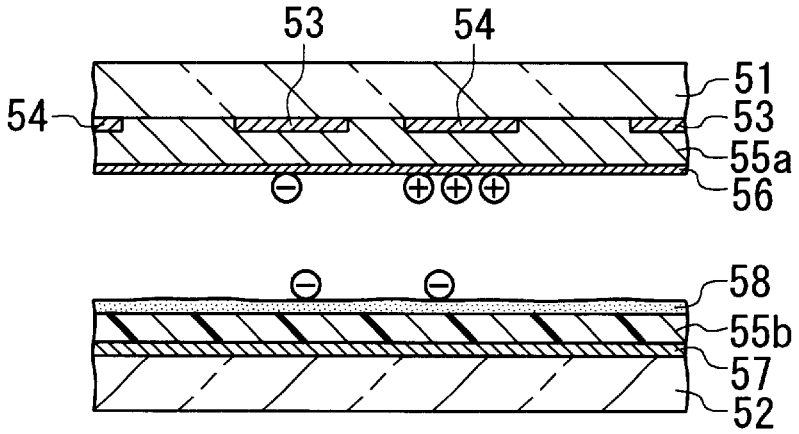
FIG. 2E PRIOR ART
Figure 2F:
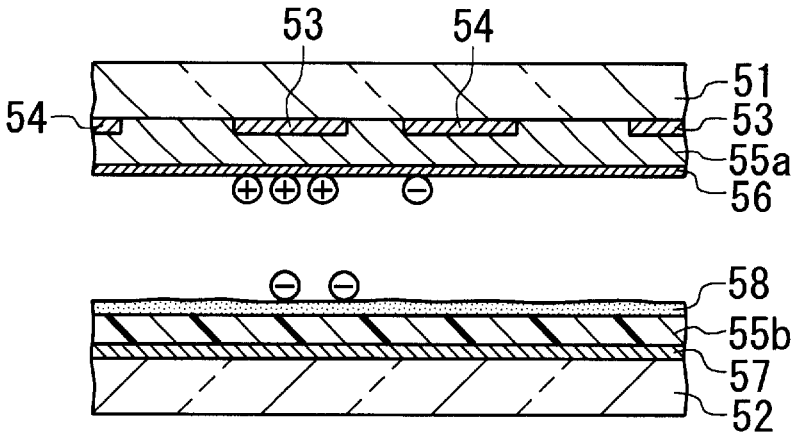
FIG. 2F PRIOR ART
Figure 3:
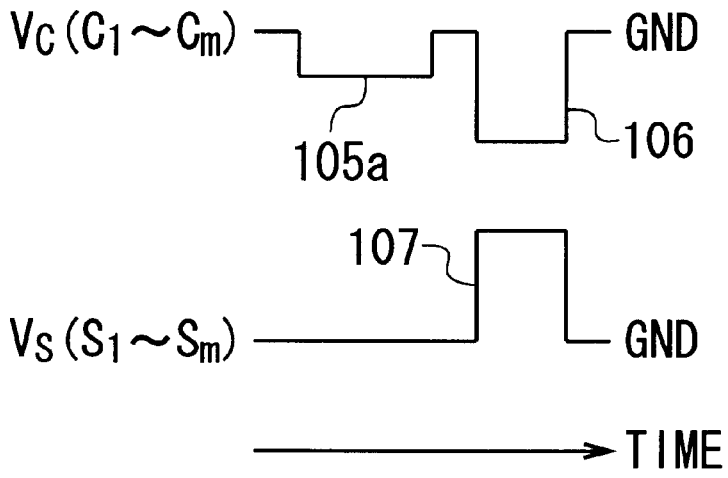
FIG. 3 PRIOR ART
FIG. 3 is a schematic waveform diagram showing a variation of the waveform of the driving voltage pulses applied to the sustain electrodes in the preliminary discharge period in the conventional method of FIG. 1.
Figure 4:
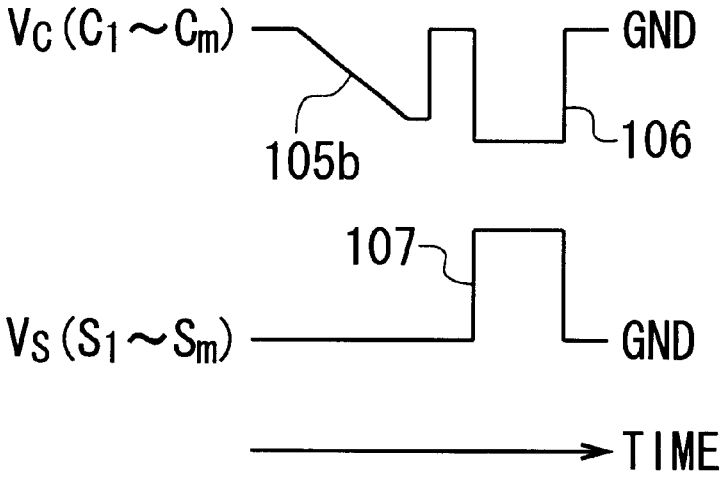
FIG. 4 PRIOR ART
FIG. 4 is a schematic waveform diagram showing another variation of the waveform of the driving voltage pulses applied to the sustain electrodes in the preliminary discharge period in the conventional method of FIG. 1.
Figure 5:
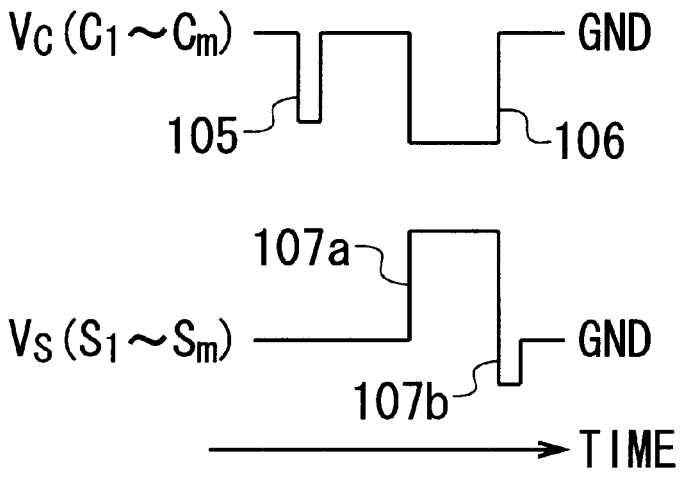
FIG. 5 PRIOR ART
FIG. 5 is a schematic waveform diagram showing a variation of the waveform of the driving voltage pulses applied to the scan electrodes in the preliminary discharge period in the conventional method of FIG. 1.
Figure 6:
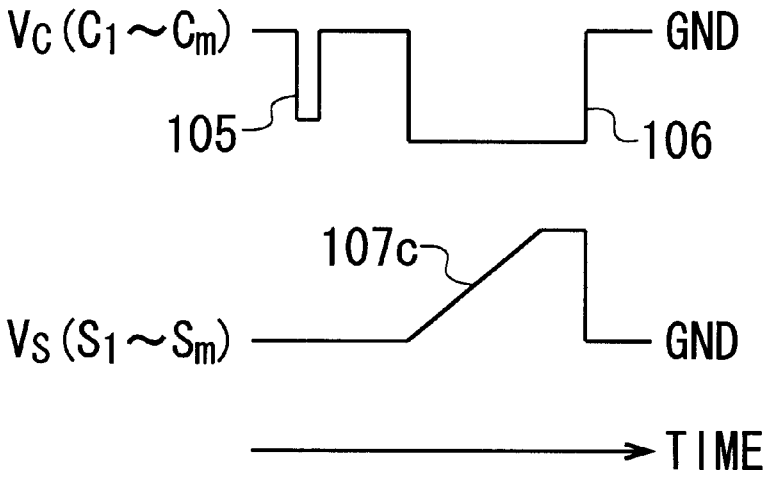
FIG. 6 PRIOR ART
FIG. 6 is a schematic waveform diagram showing another variation of the waveform of the driving voltage pulses applied to the scan electrodes in the preliminary discharge period in the conventional method of FIG. 1.
Figure 13A:
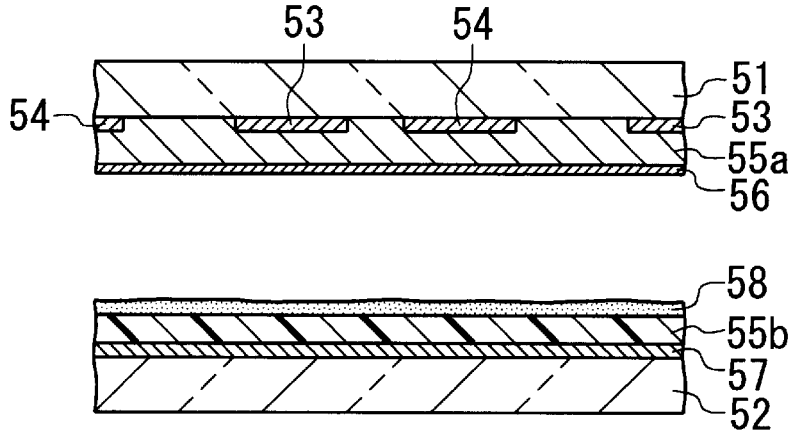
FIGS. 13A to 13D are partial cross-sectional views showing schematically the distribution of the wall charge in the method according to the third embodiment of FIG. 12, respectively.
Figure 13B:
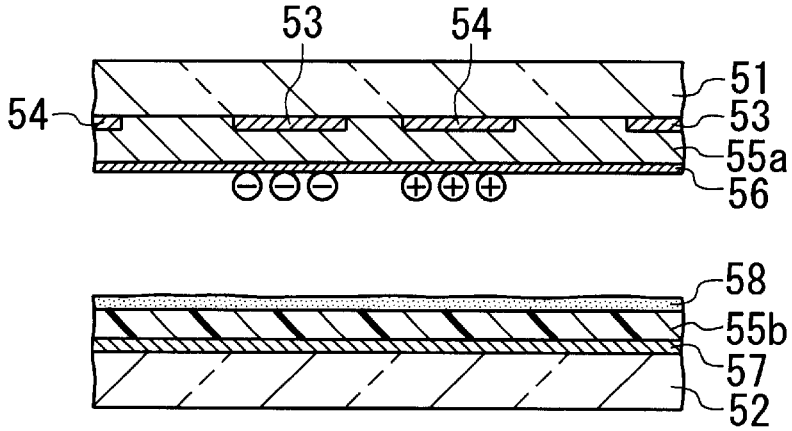

After the application of the elimination pulse 5 is finished, the wall discharge is eliminated, as shown in FIG. 13A. Subsequently, at the leading edges of the preliminary discharge pulses 6 and 7*a*, due to the preliminary discharge, negative wall charge is stored in the dielectric layer 55*a* over the scan electrodes 53 while positive wall charge is stored in the dielectric layer 55*a* over the sustain electrodes 54, as shown in FIG. 13B. This is the same as the wall charge distribution of the conventional method shown in FIGS. 2A and 2B.

With the conventional method of FIG. 1, as explained previously, the preliminary discharge is eliminated at the trailing edge of the preliminary discharge pulse 107, thereby eliminating the wall charge that has been stored over the scan and sustain electrodes 53 and 54 in the prior preliminary discharge. Thereafter, the scan period T3 begins.

Figure 13C:
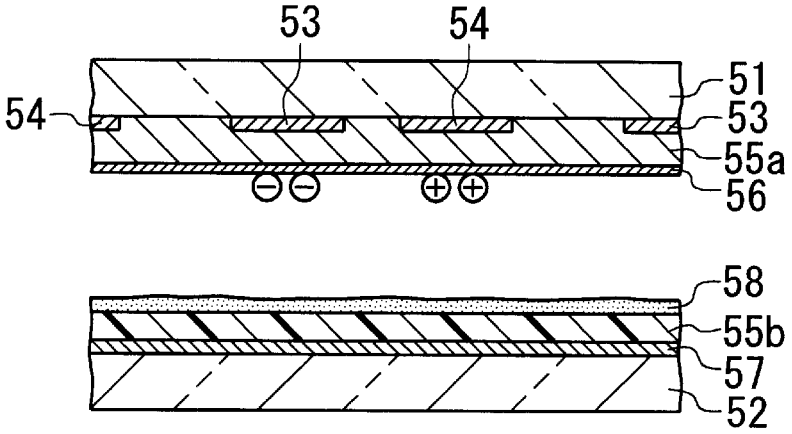

On the other hand, with the driving method according to the third embodiment of FIG. 12, similar to the conventional method, the preliminary discharge is eliminated at the trailing edge of the leading part of the preliminary discharge pulse 7*a*, thereby eliminating the wall charge that has been stored over the scan and sustain electrodes 53 and 54 in the prior preliminary discharge. Thereafter, unlike the conventional method, the trailing part of the pulse 7*a* is commonly applied to the scan electrodes 53 just a after the leading part thereof, thereby leaving negative wall charge in the dielectric layer 55*a* over the scan electrodes 53 and positive wall charge in the dielectric layer 55*a* over the sustain electrodes 54, as shown in FIG. 13C.

Figure 13D:
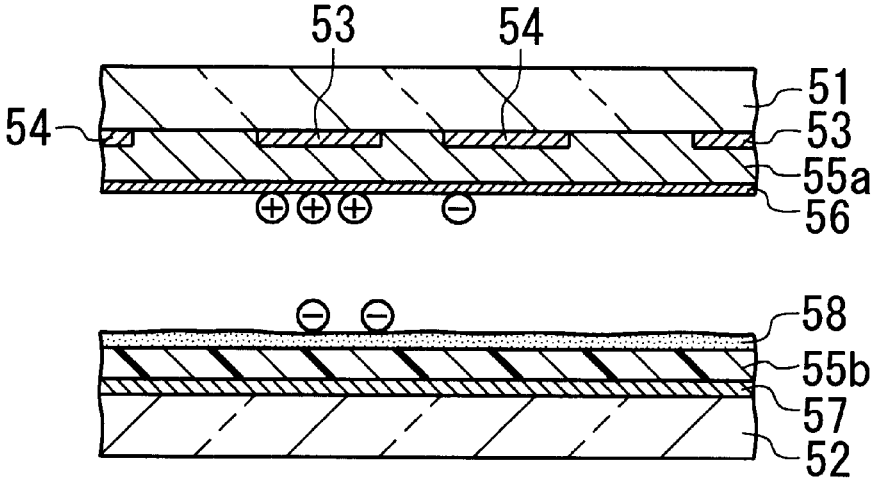

Accordingly, in the subsequent scan period T3, desired writing discharge will occur easily by the electric-field superposition or summation of the main and associated electric-fields due to the wall charge thus left in the dielectric layer 55*a* at the time the preliminary discharge has been eliminated, as shown in FIG. 13D.

Figure 14:
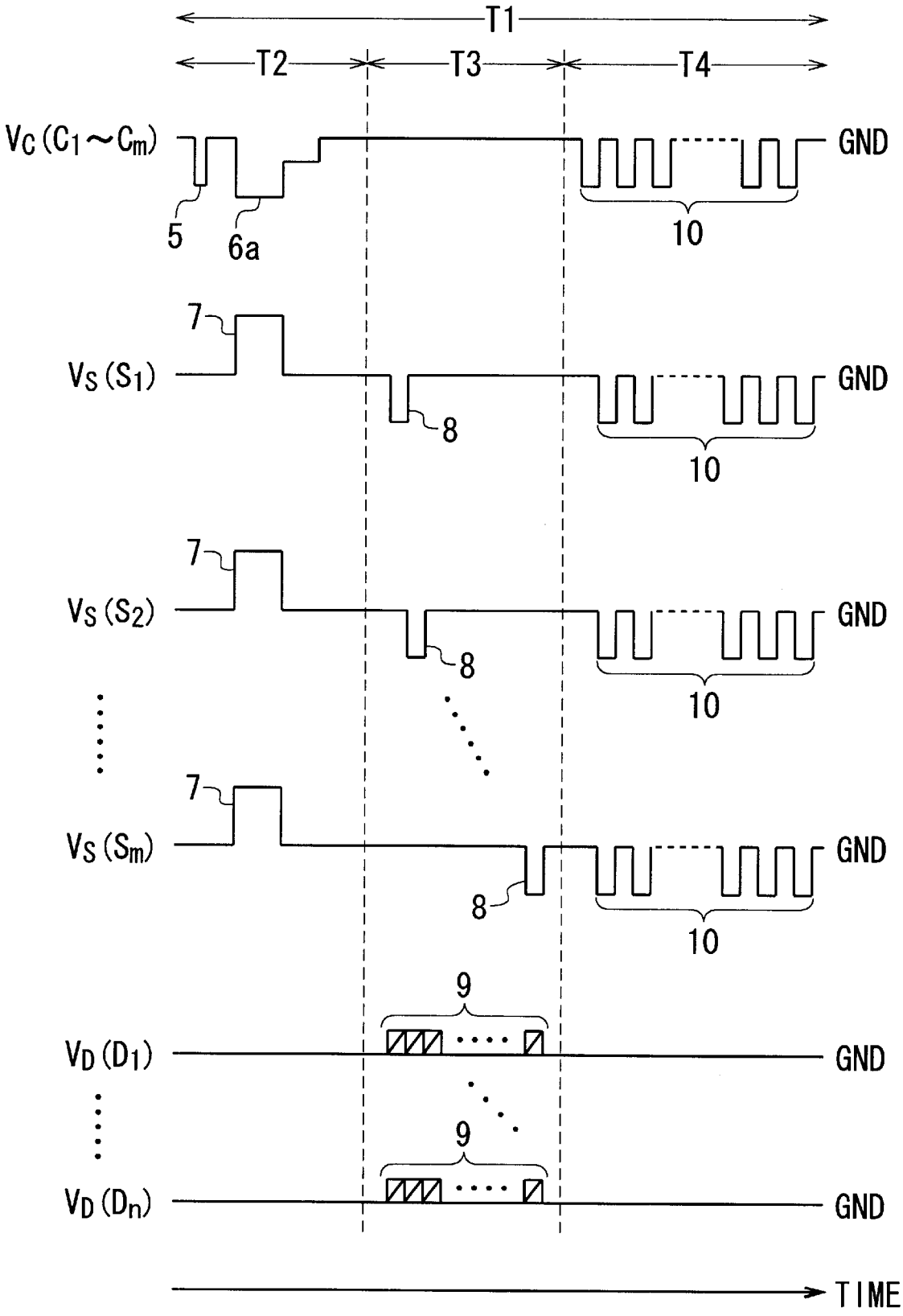
FIG. 14 is a schematic waveform diagram showing a variation of the waveform of the driving voltage pulses applied to the sustain electrodes in the preliminary discharge period in the method according to the third embodiment of FIG. 12.

With the method according to the third embodiment of FIG. 12, the leading and trailing parts of the preliminary discharge pulse 7*a* are rectangular and positive. However, as shown in FIG. 14, a preliminary discharge pulse 6*a* may be commonly applied to the sustain electrodes 54 instead of the preliminary discharge pulse 6 while the preliminary discharge pulse 7*a* is eliminated. The pulse 6*a* is formed by a rectangular leading part and a rectangular trailing part connected to each other. The leading part has a greater negative amplitude than the trailing part. In the case of FIG. 14, the same effect as shown with reference to FIG. 12 is given.

Figure 15:
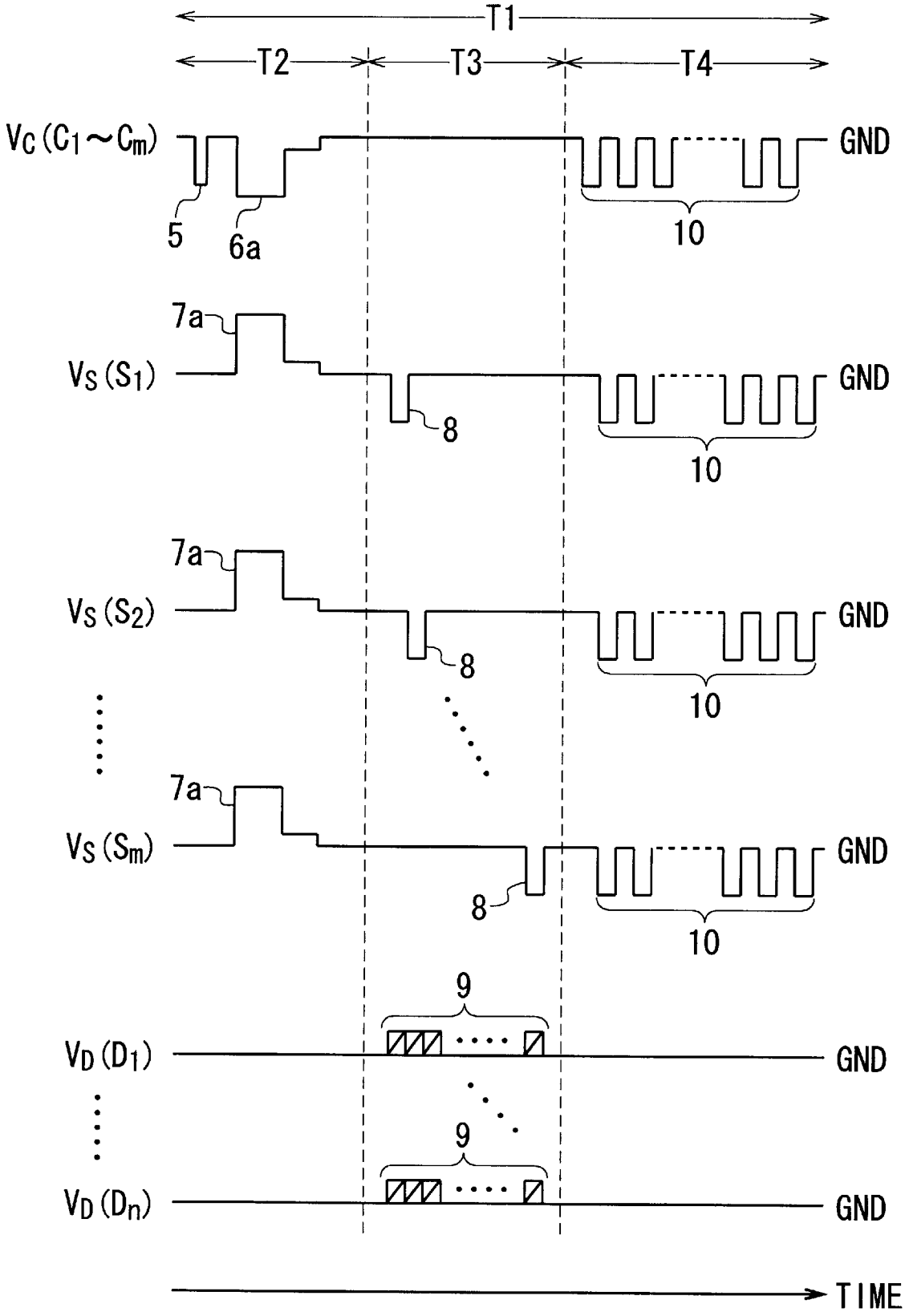
FIG. 15 is a schematic waveform diagram showing another variation of the waveform of the driving voltage pulses applied to the sustain electrodes in the preliminary discharge period in the method according to the third embodiment of FIG. 12.

Moreover, as shown in FIG. 15, the preliminary discharge pulse 7*a* used in the method of FIG. 12 and the preliminary discharge pulse 6*a* used in the method of FIG. 14 may be used together. In the case of FIG. 15 also, the same effect as shown with reference to FIG. 12 is given.

Fourth Embodiment

Figure 16:
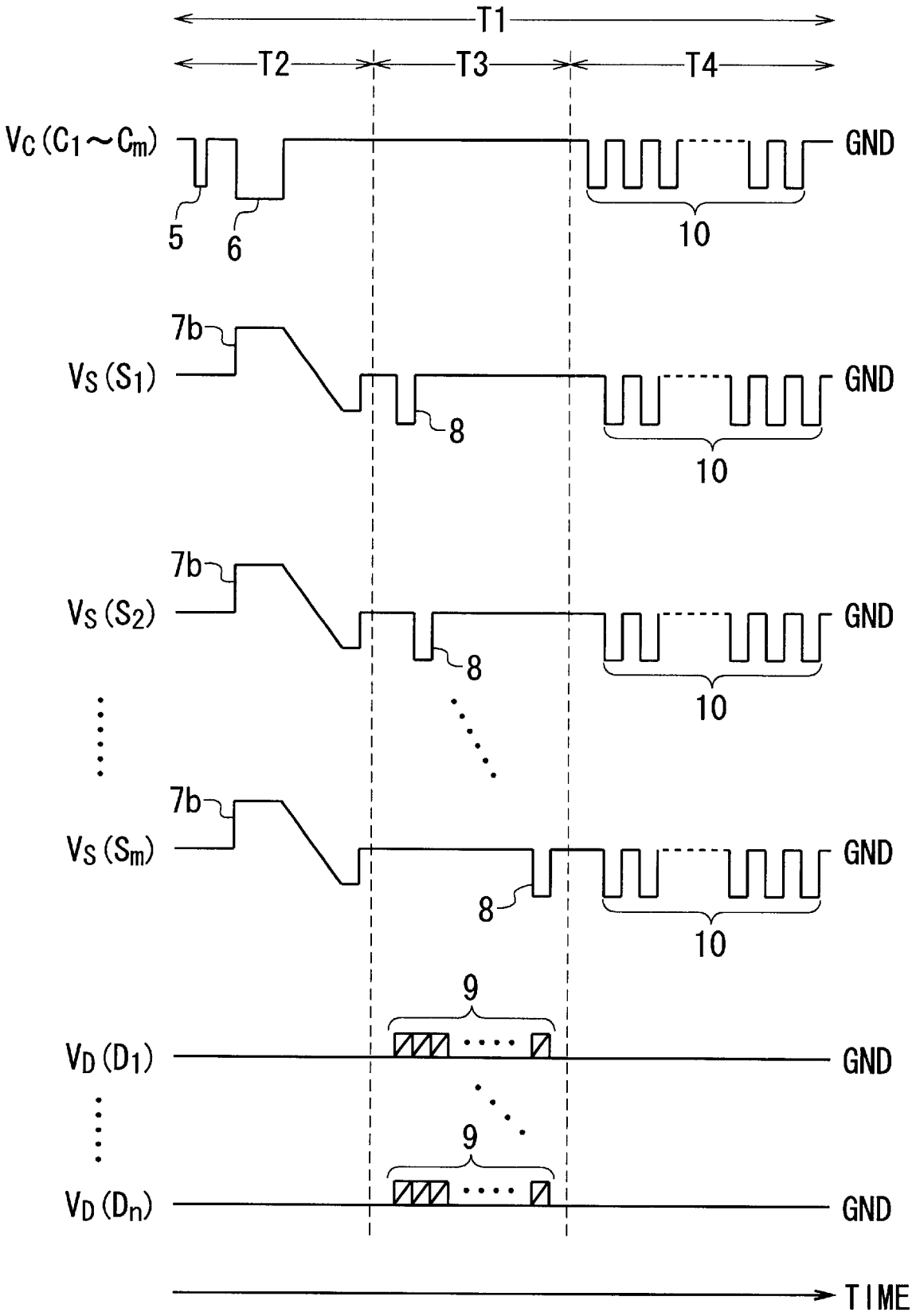
FIG. 16 is a schematic waveform diagram showing the waveform of the driving voltage pulses applied to the respective electrodes in a method of driving an ac-type PDP according to a fourth embodiment of the invention.

FIG. 16 shows a method of driving an ac-discharge type PDP according to a fourth embodiment of the invention, which is the same as the conventional method shown in FIG. 1 except that a preliminary discharge pulse 7*b* is used in the preliminary discharge period T2 instead of the preliminary discharge pulse 107.

The preliminary discharge pulse 7*b* is formed by the rectangular leading part, the triangular middle part, and the trapezoidal trailing part connected to one another. The leading part has a greater positive amplitude than the trailing part.

The leading part of the preliminary discharge pulse 7*b* has a positive, constant amplitude. This leading part is the same as the preliminary discharge pulse 7 used in the first embodiment of FIG. 7. The middle part of the pulse 7*b* has a positive, decreasing amplitude, where the maximum amplitude is equal to the amplitude of the leading part while the minimum amplitude is zero. The trailing part of the pulse 7*b* has a negative, increasing amplitude, where the minimum amplitude is zero while the maximum amplitude is less than the scan pulses 8.

It may be said that the preliminary discharge pulse 7*b* correspond to the preliminary discharge pulse 7*a* used in the third embodiment of FIG. 12. Thus, the method according to the fourth embodiment of FIG. 16 may be said as a variation of the third embodiment of FIG. 12.

The rectangular leading part of the preliminary discharge pulse 7*b* has the same function as the preliminary discharge pulse 107 or 7. On the other hand, the middle and trailing parts of the pulse 7*b* has the linearly changing amplitude and the voltage of the pulse 7*b* is changed from a positive value to a negative one. Therefore, weak or feeble discharge is caused in the cells 61 and as a result, the state and amount of the wall charge stored in the dielectric layers 55*a* changes gradually. Accordingly, the amount and state of the wall charge stored over the scan and sustain electrodes 53 and 54 can be adjusted or controlled more correctly.

As a result, in the subsequent scan period T3, desired writing discharge will occur easily.

Figure 17:
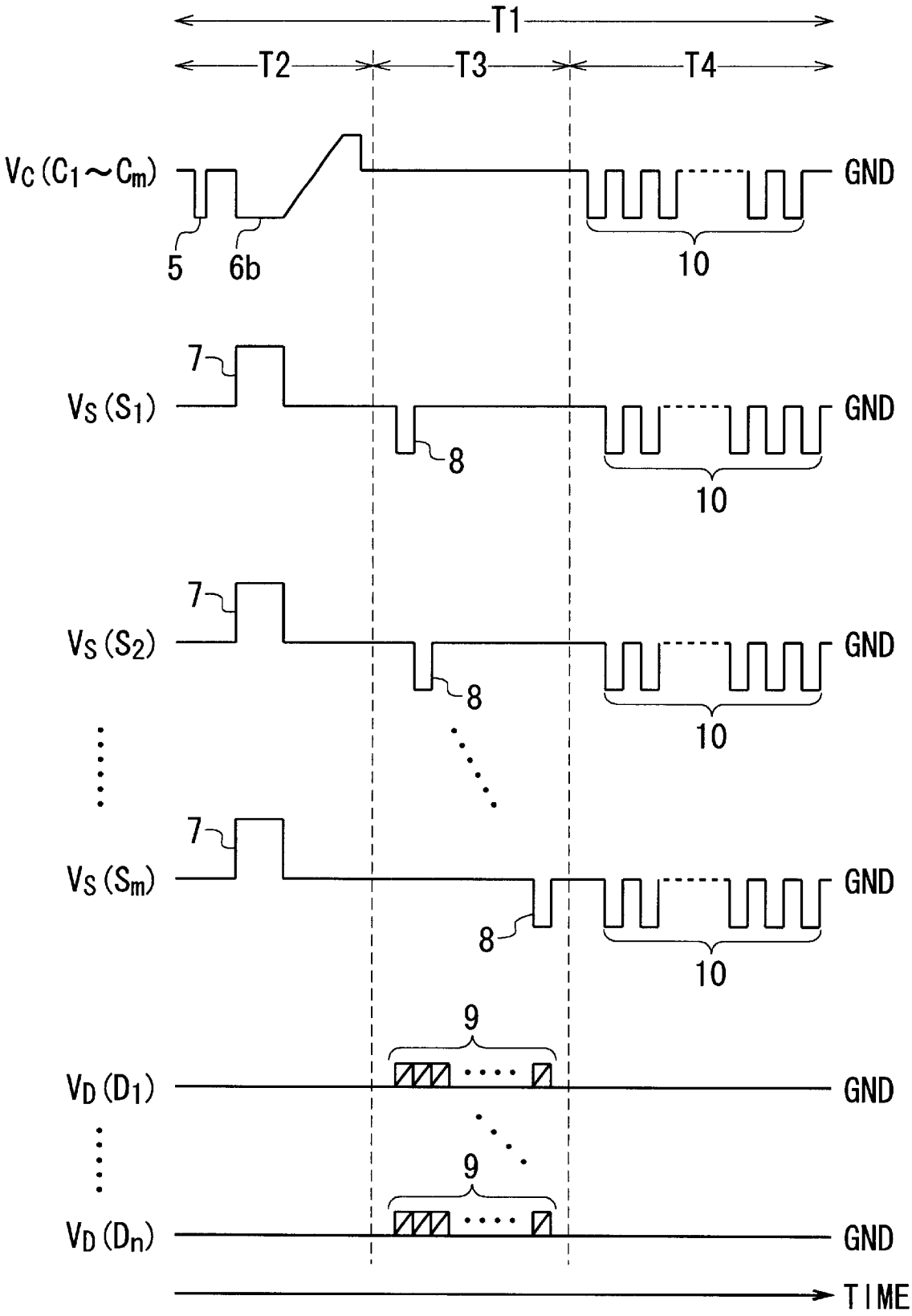
FIG. 17 is a schematic waveform diagram showing a variation of the waveform of the driving voltage pulses applied to the sustain electrodes in the preliminary discharge period in the method according to the fourth embodiment of FIG. 16.

With the method according to the fourth embodiment of FIG. 16, the middle and trailing parts of the preliminary discharge pulse 7*b* applied to the scan electrodes 53 ($S_1$ to $S_m$) have the linearly changing amplitude. However, as shown in FIG. 17, a preliminary discharge pulse 6*a* may be commonly applied to the sustain electrodes 54 ($C_1$ to $C_m$) instead of the preliminary discharge pulse 6 while the preliminary discharge pulse 7 is used. In the method of FIG. 17, the same effect as shown with reference to FIG. 16 is given.

The preliminary discharge pulse 6*a* is formed by the rectangular leading part, the triangular middle part, and the trapezoidal trailing part connected to one another. The leading part has a greater negative amplitude than the trailing part.

The leading part of the preliminary discharge pulse 6*b* has a negative, constant amplitude. The leading part is the same as the preliminary discharge pulse 6 used in the first embodiment of FIG. 7. The middle part of the pulse 6*b* has a negative, decreasing amplitude, where the maximum amplitude is equal to the amplitude of the leading part while the minimum amplitude is zero. The trailing part of the pulse 6*b* has a positive, increasing amplitude, where the minimum amplitude is zero.

Figure 18:
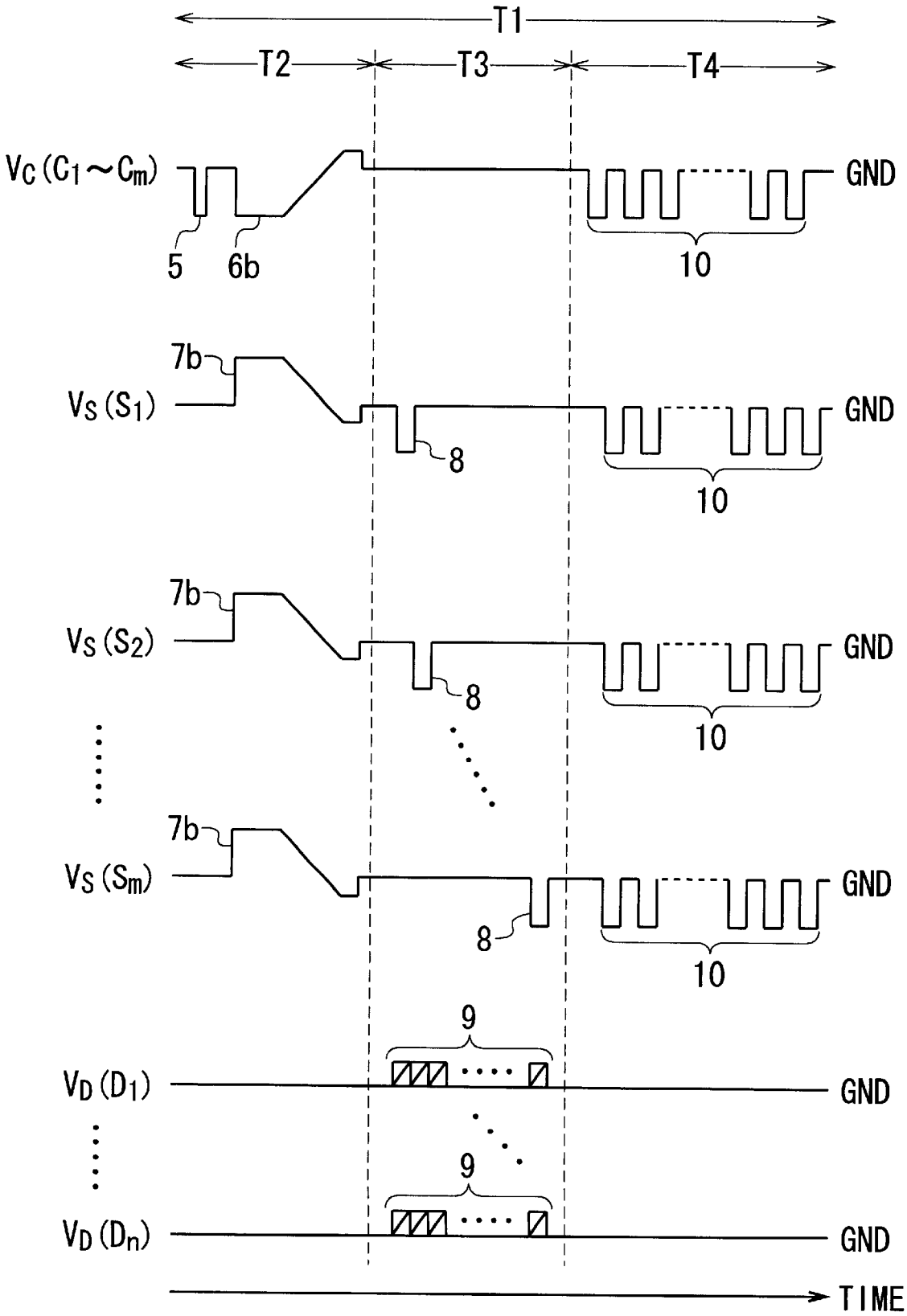
FIG. 18 is a schematic waveform diagram showing another variation of the waveform of the driving voltage pulses applied to the sustain electrodes in the preliminary discharge period in the method according to the fourth embodiment of FIG. 16.

Moreover, as shown in FIG. 18, both the preliminary discharge pulse 7*b* used in the method of FIG. 16 and the preliminary discharge pulse 6*b* used in the method of FIG. 17 may be used. In the method of FIG. 18, needless to say, the same effect as shown with reference to FIG. 16 is given.

In addition, the final voltage value of the pulses 6*b* and 7*b* are set positive and negative in the methods of FIGS. 16, 17, and 18, respectively. However, the invention is not limited to these cases. If wall charge is stored over the respective scan electrodes 53 as desired, the final voltage value of the pulses 6*b* and 7*b* may be positive or negative or zero. It may be optionally determined.

Fifth Embodiment

Figure 19:
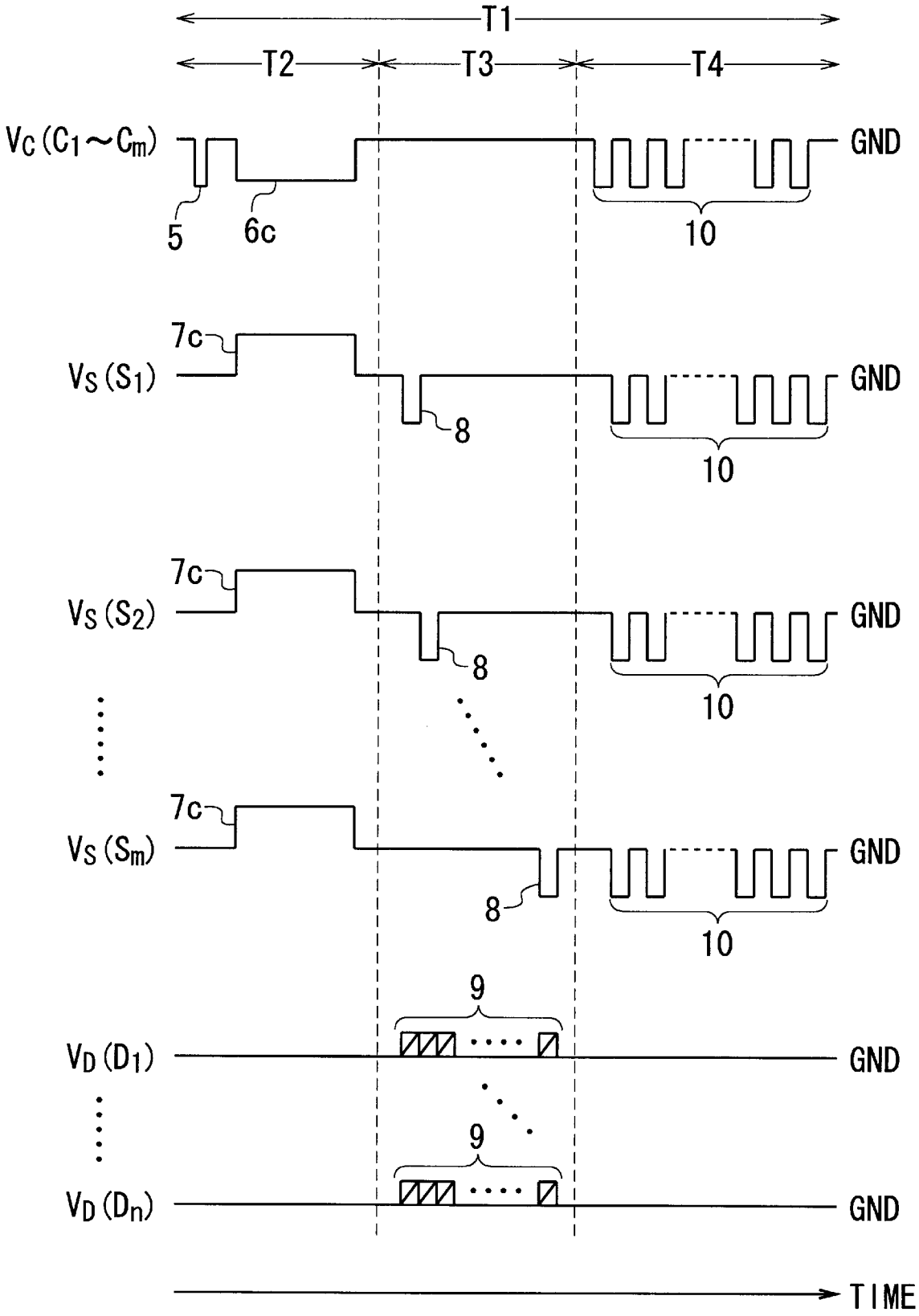
FIG. 19 is a schematic waveform diagram showing the waveform of the driving voltage pulses applied to the respective electrodes in a method of driving an ac-type PDP according to a fifth embodiment of the invention.

FIG. 19 shows a method of driving an ac-discharge type PDP according to a fifth embodiment of the invention, which is the same as the conventional method shown in FIG. 1 except that preliminary discharge pulses 6*c* and 7*c* are used in the preliminary discharge period T2 instead of the preliminary discharge pulses 106 and 107, respectively.

The pulse 6*c* is formed by the rectangular leading part and the rectangular trailing part connected to one another. The leading part of the pulse 6*c* has a negative amplitude equal to that of the trailing part thereof. The pulse 7*c* is formed by the rectangular leading part and the rectangular trailing part connected to one another. The leading part of the pulse 7*c* has a positive amplitude equal to that of the trailing part thereof.

Unlike the conventional method of FIG. 1, the amplitudes (i.e., the sustain and scan voltages $V_C$ and $V_S$) of the pulses 6*c* and 7*c* are selected in such a way that preliminary discharge occurs at the leading edges of the pulses 6*c* and 7*c* while preliminary discharge does not occur at the trailing edges thereof.

Figure 20A:
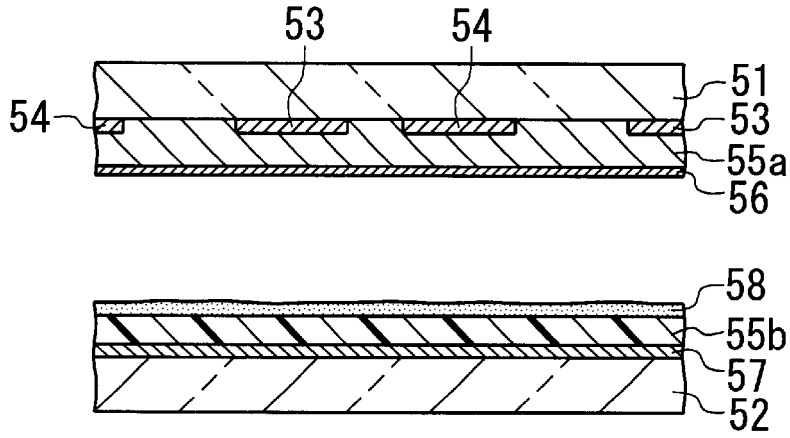
FIGS. 20A to 20C are partial cross-sectional views showing schematically the distribution of the wall charge in the method according to the fifth embodiment of FIG. 19, respectively.
Figure 20B:
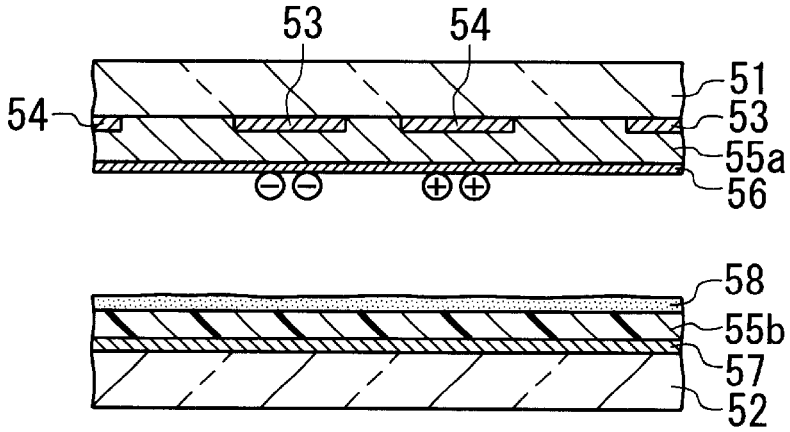

With the method according to the fifth embodiment of FIG. 19, wall charge has the state shown in FIG. 20A prior to the application of the pulses 6*c* and 7*c*. Then, at the leading edges of the pulses 6*c* and 7*c*, preliminary discharge occurs and as a result, wall charge is stored in the dielectric layer 55*a*, as shown in FIG. 20B. The amount of the wall charge thus stored is limited at a level where the stored walls charge causes no self-discharge and thus, no discharge occurs at the trailing edges of the pulses 6*c* and 7*c*.

Because of the walls charge thus stored in the preliminary discharge period T2, desired writing discharge will occur easily in the subsequent scan period T3.

Figure 20C:
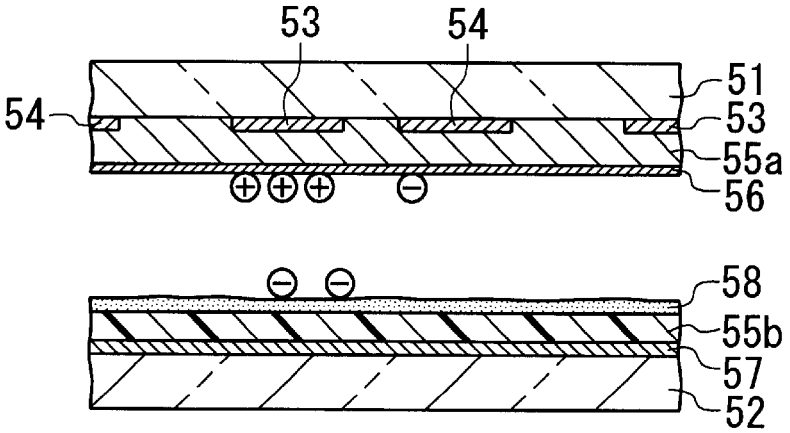

After the scan period T3 is completed, positive wall charge is stored in the dielectric layer 55*a* over the scan electrodes 53 while negative wall charge is stored in the dielectric layer 55*b* over the data electrodes 57 in the selected (i.e., emitting) cells 61. The state of wall charge at this time is shown in FIG. 20C. Unlike this, in the unselected (i.e., non-emitting) cells 61, writing discharge does not occur and thus, the wall charge is kept in the state shown in FIG. 20B.

Sixth Embodiment

Figure 21:
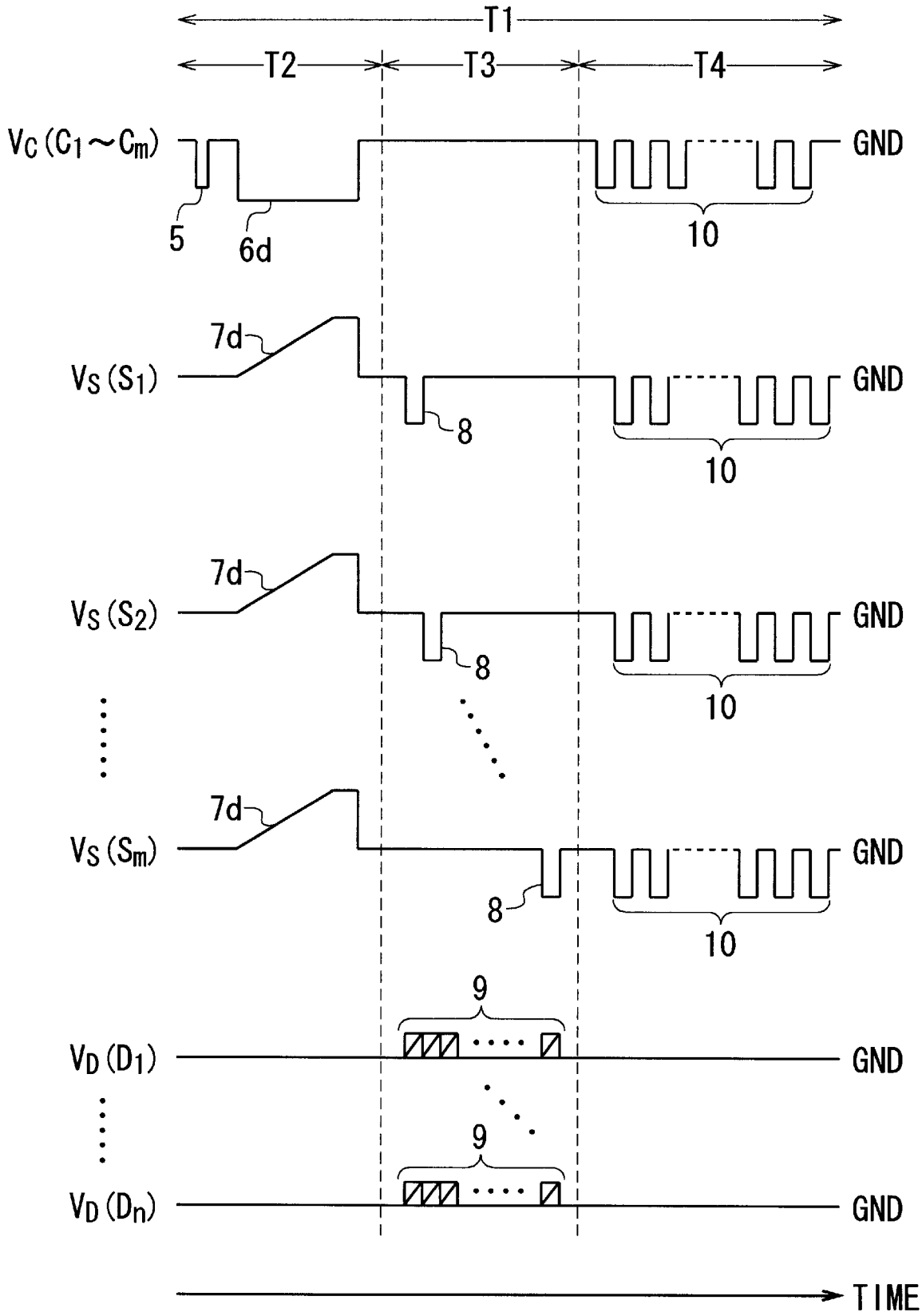
FIG. 21 is a schematic waveform diagram showing the waveform of the driving voltage pulses applied to the respective electrodes in a method of driving an ac-type PDP according to a sixth embodiment of the invention.

FIG. 21 shows a method of driving an ac-discharge type PDP according to a sixth embodiment of the invention, which is the same as the conventional method shown in FIG. 1 except that preliminary discharge pulse 6*d* and 7*d* are used in the preliminary discharge period T2 instead of the preliminary discharge pulses 106 and 107, respectively. In this embodiment, wall charge is generated or stored utilizing preliminary discharge itself in the preliminary discharge period T2.

The pulse 6*d* is rectangular and wider than the pulse 106. The pulse 6*d* has a negative, constant amplitude greater than that of the elimination pulse 5.

The pulse 7*d* is trapezoidal and equal in width to the pulse 6*d*. The pulse 7*d* is formed by a triangular leading part and the rectangular trailing part connected to each other. The leading part of the pulse 7*d* has a positive, linearly increasing amplitude from zero to a specific positive value. The trailing part of the pulse 7*d* has a positive, constant amplitude, which is equal to the maximum value of the leading part thereof.

With the method according to the sixth embodiment of FIG. 21, the preliminary discharge pulses 6*d* and 7*d* are applied in the preliminary discharge period T2, causing discharge in such a way that the scan electrodes 53 serve as the anode. The amplitude of the pulse 6*d* is −150 V to −200 V and the maximum amplitude of the pulse 7*d* is 150 V to 250 V. Thus, negative wall charge is stored in the dielectric layer 55*a* over the scan electrodes 53 and positive wall charge is stored in the dielectric layer 55*a* over the sustain electrodes 54.

As seen from this explanation, wall charge is generated and stored utilizing the preliminary discharge itself caused by the applied pulses 6*d* and 7*d* in the preliminary discharge period T2. Therefore, using the wall charge thus stored in advance, desired writing discharge will occur easily in the following scan period T3 because of the same reason as explained in the previous embodiments.

With the method according to the sixth embodiment of FIG. 21, the positive preliminary discharge pulse 7*d* is commonly applied to the scan electrodes 53 ($S_1$ to $S_m$) and the negative preliminary discharge pulse 6*d* is commonly applied to the sustain electrodes 54 ($C_1$ to $C_n$), thereby causing preliminary discharge. However, any other pulse may be used as the preliminary discharge pulses 6*d* or 7*d* if it causes the scan electrodes 53 to serve as the anode. For example, it is sufficient to simply apply a positive pulse to the scan electrodes 53 while no pulse is applied to the sustain electrodes 54.

Figure 22:
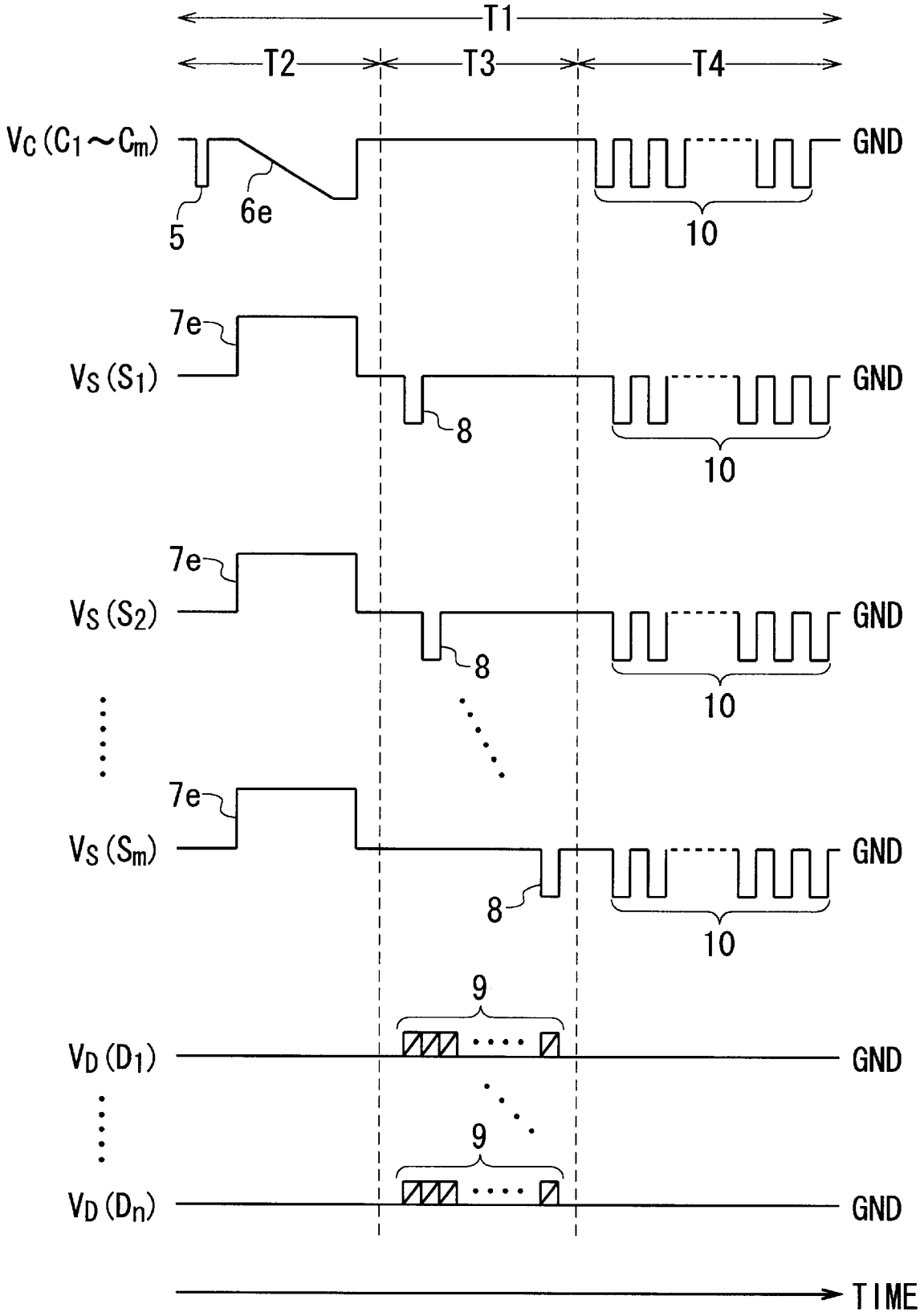
FIG. 22 is a schematic waveform diagram showing a variation of the waveform of the driving voltage pulses applied to the sustain electrodes in the preliminary discharge period in the method according to the sixth embodiment of FIG. 21.

Furthermore, with the method according to the sixth embodiment of FIG. 21, the amplitude of the preliminary discharge pulse 7*d*, which is commonly applied to the scan electrodes 53, increases linearly from zero to a specific positive value. However, as shown in FIG. 22, a preliminary discharge pulse 6*e* maybe commonly applied to the sustain electrodes 54 instead of the preliminary discharge pulse 6*d*. The pulse 6*e* has a negative, increasing amplitude from zero to a specific negative value. In this case, a preliminary discharge pulse 7*e* is used instead of the preliminary discharge pulse 7*d*. The pulse 7*e* has a positive, constant amplitude.

Figure 23:
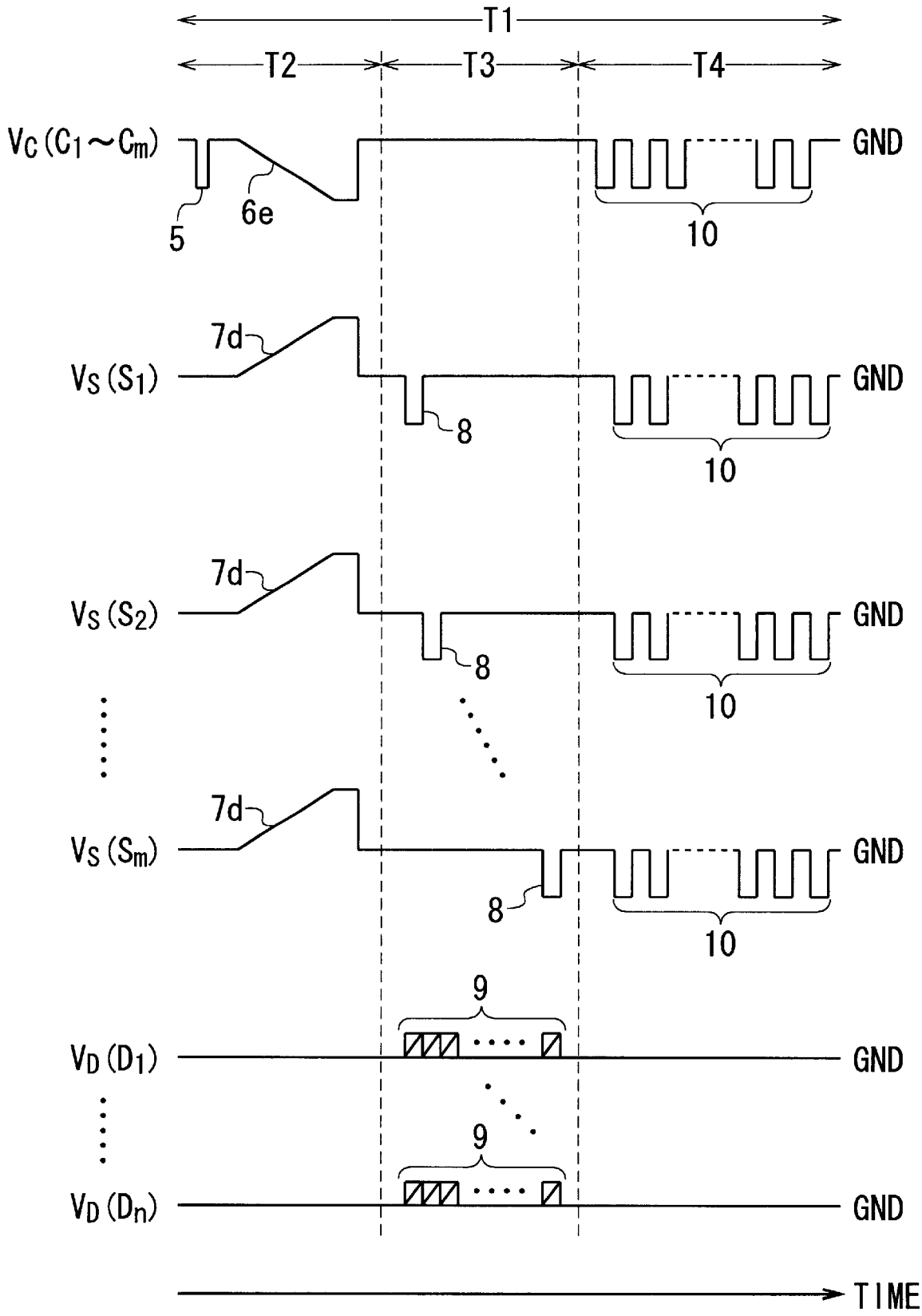
FIG. 23 is a schematic waveform diagram showing another variation of the waveform of the driving voltage pulses applied to the sustain electrodes in the preliminary discharge period in the method according to the sixth embodiment of FIG. 21.

Needless to say, as shown in FIG. 23, both the preliminary discharge pulse 6*e* used in the method of FIG. 22 and the preliminary discharge pulse 7*d* used in the method of FIG. 21 maybe used together.

Seventh Embodiment

Figure 24:
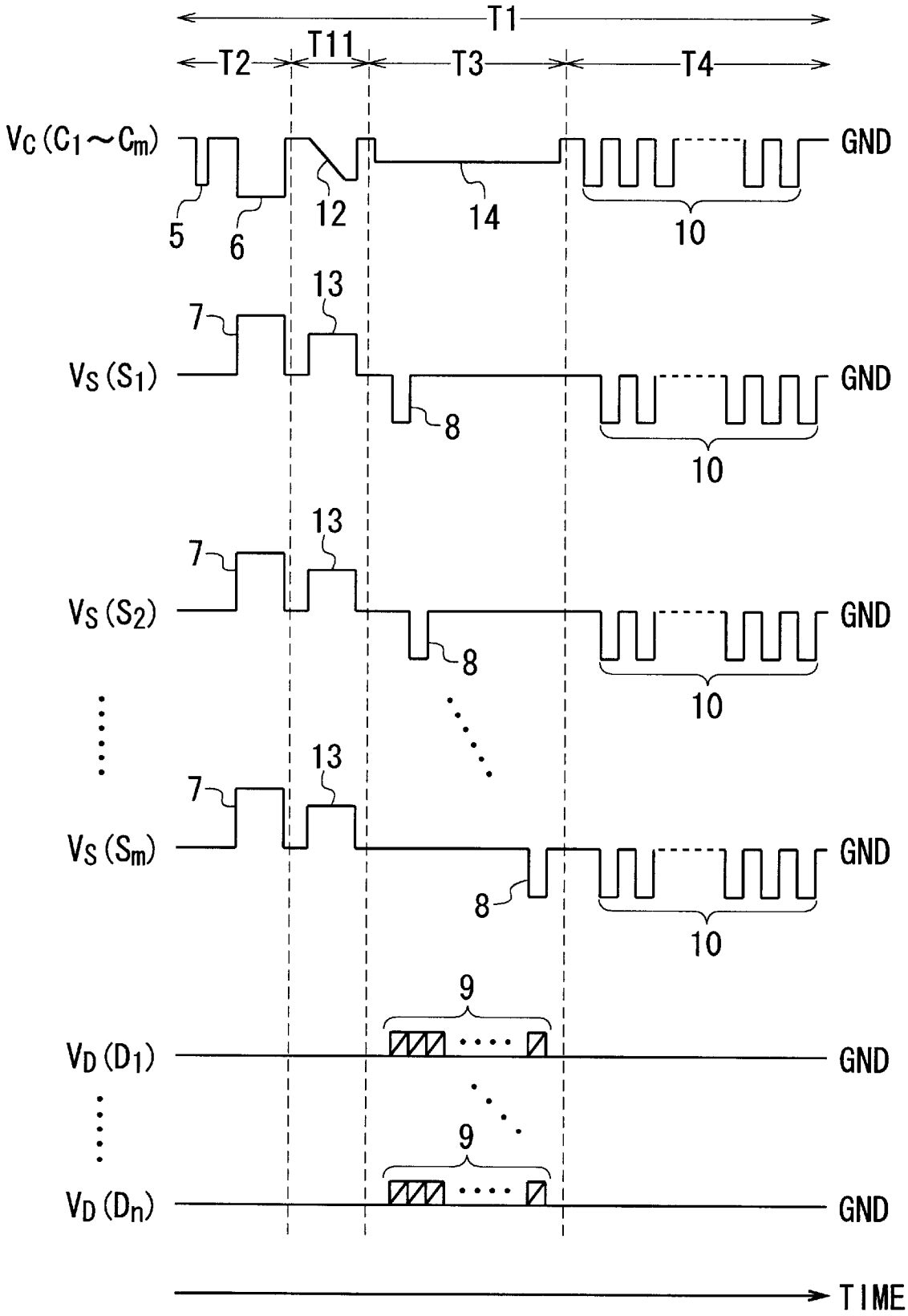
FIG. 24 is a schematic waveform diagram showing the waveform of the driving voltage pulses applied to the respective electrodes in a method of driving an ac-type PDP according to a seventh embodiment of the invention.

FIG. 24 shows a method of driving an ac-discharge type PDP according to a seventh embodiment of the invention, which is the same as the method according to the first embodiment of FIG. 7 except that a secondary or sub scan pulse 14 is additionally applied in common to all the sustain electrodes 54 ($C_1$ to $C_m$) in the scan period T3. Therefore, the explanation about the same pulses and operation is omitted here for the sake of simplification by attaching the same reference symbols as those in FIG. 7 to the same elements in FIG. 24.

In the scan period T3, desired writing discharge needs to be caused between the scan electrodes 53 and the data electrodes 57 in only the selected or emitting cells 61. This is performed by the action of the superposed electric-fields with the use of the wall charge that has been stored in the dielectric layer 55*a* in the wall charge adjustment period T11. However, the wall charge are stored in all the cells 61 through the period T11 and thus, there is a possibility that error discharge occurs between the scan electrodes 53 and the data electrodes 57 in the unselected or non-emitting cells 61 to which the data pulses 9 are not applied. Once error discharge occurs in the period T11, it is kept even in the sustain period T4. This means that the unselected cells 61 emit light in error, in other words, unintended light-emission occurs in the unselected cells 61.

With the method of the seventh embodiment of FIG. 24, such unintended (or error) light-emission can be prevented by applying the secondary or sub scan pulse 14 in common to the sustain electrodes 54 ($C_1$ to $C_m$) in the scan period T3 while the scan pulse 8 is applied to the scan electrodes 53 ($S_1$ to $S_m$). This is realized on the basis of the following principle.

In the wall-charge adjustment period T11, the wall-charge adjustment pulse 12 is applied in common to the sustain electrodes 54 while the wall-charge adjustment pulse 13 is applied in common to the scan electrodes 53, thereby causing discharge between the electrodes 53 and 54. Due to the discharge thus caused, negative wall charge is stored in the dielectric layer 55*a* over the scan electrodes 53 and positive wall charge is stored in the dielectric layer 55*a* over the sustain electrodes 54. When the negative secondary scan pulse 14 is commonly applied to the sustain electrodes 54 in the scan period T3, the pulse 14 serves to cancel or eliminate the positive wall charge stored over the sustain electrodes 54. As a result, the voltage or potential difference caused by the stored wall charge between the scan and sustain electrodes 53 and 54 is reduced, preventing the error or unintended discharge from occurring between the electrodes 53 and 54.

Because of the reason thus explained here, error or unintended discharge is prevented in the unselected cells 61. This means that the PDP can be driven more stably than the method according to the first embodiment of FIG. 7.

Here, the secondary scan pulse 14 has a constant amplitude of, for example, −10 V to −90 V.

Although the negative secondary scan pulse 14 serves to cancel the positive wall charge stored over the sustain electrodes 54, it applies no action to the negative wall charge stored over the scan electrodes 53. Therefore, the pulse 14 applies no effect to the voltage or electric-field superposition in the writing discharge operation between the scan and sustain electrodes 53 and 54.

Eighth Embodiment

Figure 25:
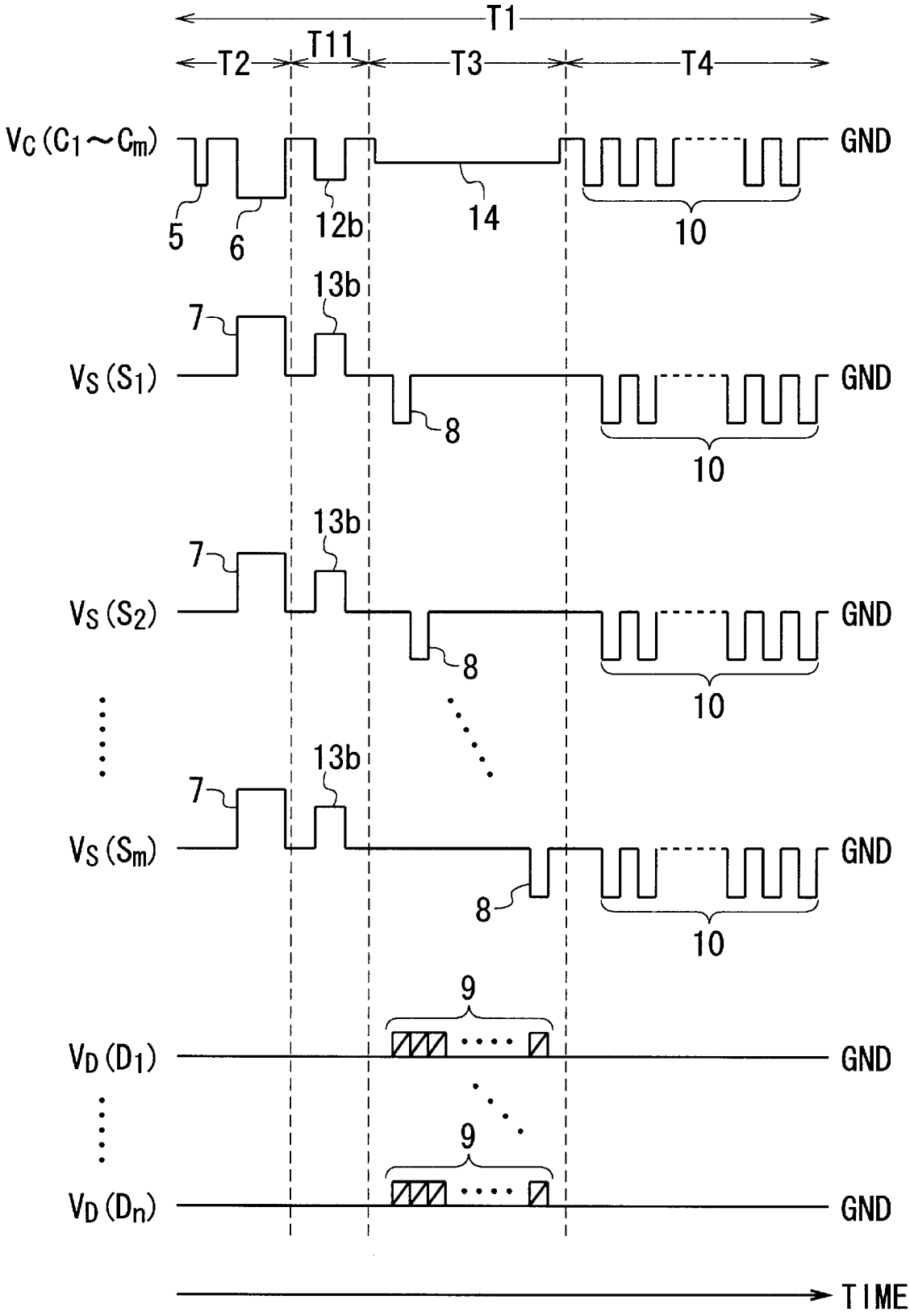
FIG. 25 is a schematic waveform diagram showing the waveform of the driving voltage pulses applied to the respective electrodes in a method of driving an ac-type PDP according to an eighth embodiment of the invention.

FIG. 25 shows a method of driving an ac-discharge type PDP according to an eighth embodiment of the invention, which is the same as the method according to the second embodiment of FIG. 11 except that a secondary or sub scan pulse 14 is additionally applied in common to the sustain electrodes 54 in the scan period T3. Therefore, the explanation about the same pulses and operation is omitted here for the sake of simplification by attaching the same reference symbols as those in FIG. 11 to the same elements in FIG. 25.

Because of the reason explained in the seventh embodiment of FIG. 24, there is an additional advantage that error discharge is prevented in the unselected cells 61, which means that the PDP can be driven more stably than the method of the second embodiment.

Ninth Embodiment

Figure 26:
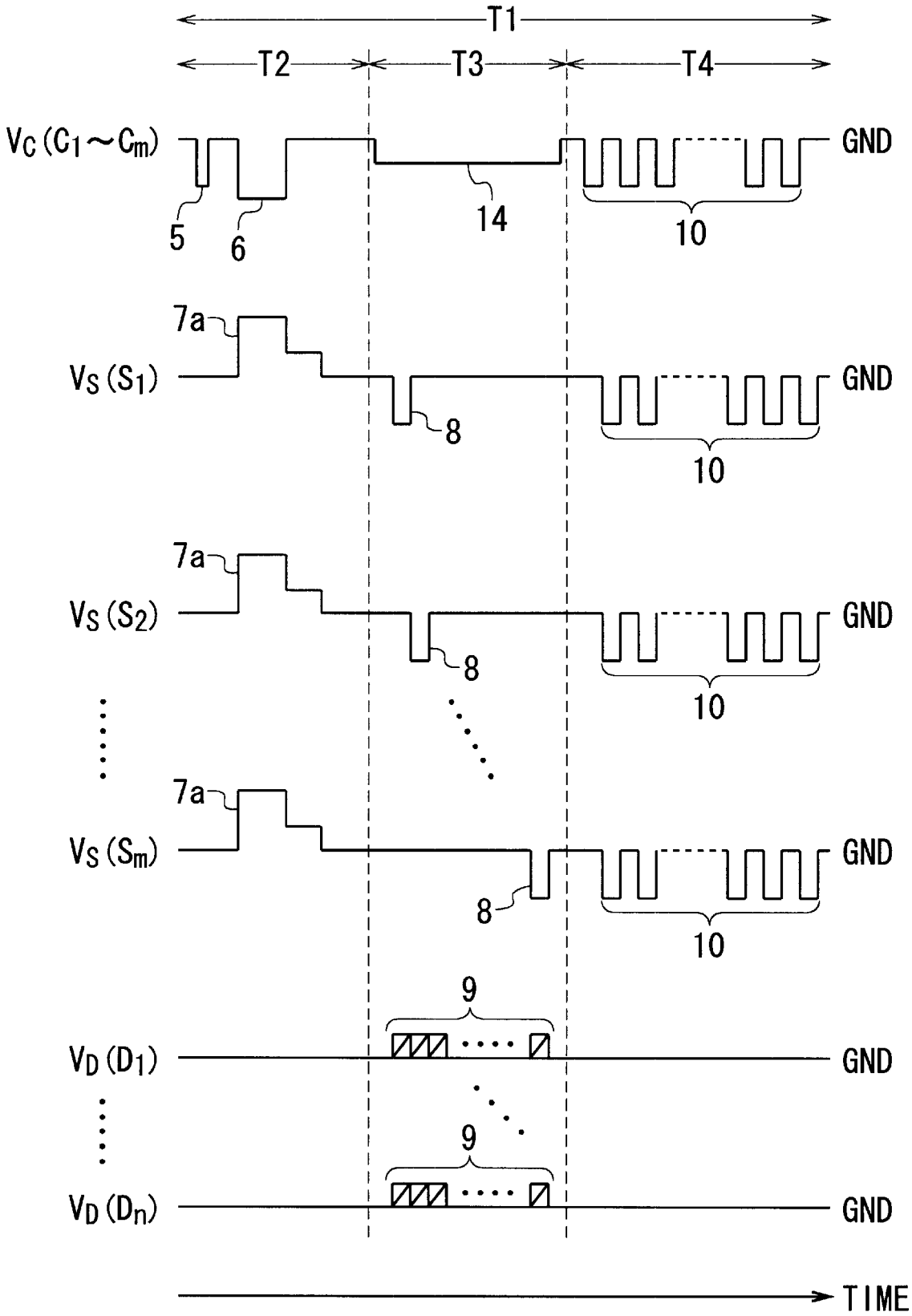
FIG. 26 is a schematic waveform diagram showing the waveform of the driving voltage pulses applied to the respective electrodes in a method of driving an ac-type PDP according to a ninth embodiment of the invention.

FIG. 26 shows a method of driving an ac-discharge type PDP according to a ninth embodiment of the invention, which is the same as the method according to the third embodiment of FIG. 12 except that a secondary or sub scan pulse 14 is additionally applied in common to the sustain electrodes 54 in the scan period T3. Therefore, the explanation about the same pulses and operation is omitted here for the sake of simplification by attaching the same reference symbols as those in FIG. 12 to the same elements in FIG. 26.

Because of the reason explained in the seventh embodiment of FIG. 24, there is an additional advantage that error discharge is prevented in the unselected cells 61, which means that the PDP can be driven more stably than the method of the third embodiment.

Tenth Embodiment

Figure 27:
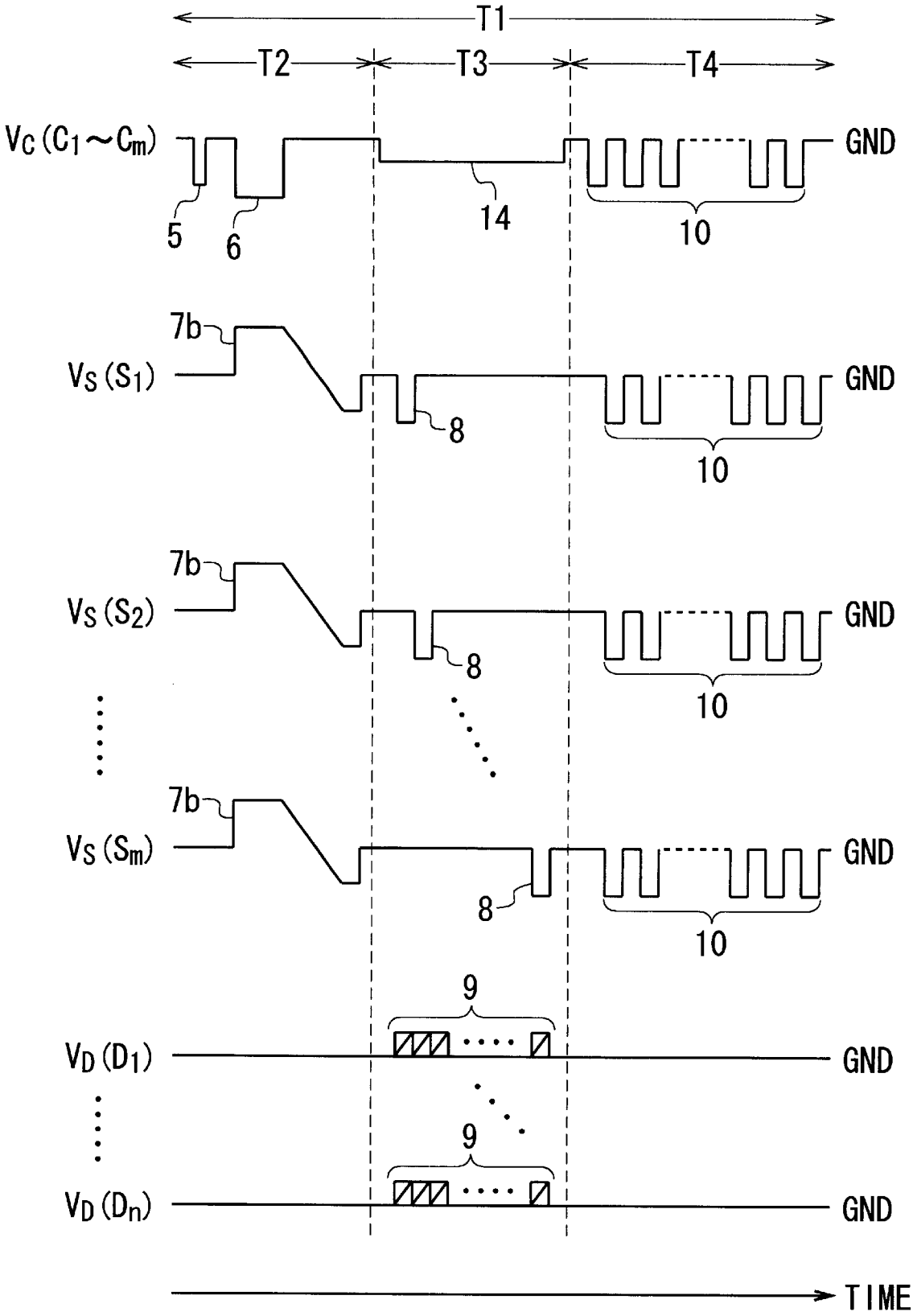
FIG. 27 is a schematic waveform diagram showing the waveform of the driving voltage pulses applied to the respective electrodes in a method of driving an ac-type PDP according to a tenth embodiment of the invention.

FIG. 27 shows a method of driving an ac-discharge type PDP according to a tenth embodiment of the invention, which is the same as the method according to the fourth embodiment of FIG. 16 except that a secondary or sub scan pulse 14 is additionally applied in common to the sustain electrodes 54 in the scan period T3. Therefore, the explanation about the same pulses and operation is omitted here for the sake of simplification by attaching the same reference symbols as those in FIG. 16 to the same elements in FIG. 27.

Because of the reason explained in the seventh embodiment of FIG. 24, there is an additional advantage that error discharge is prevented in the unselected cells 61, which means that the PDP can be driven more stably than the method of the fourth embodiment.

Eleventh Embodiment

Figure 28:
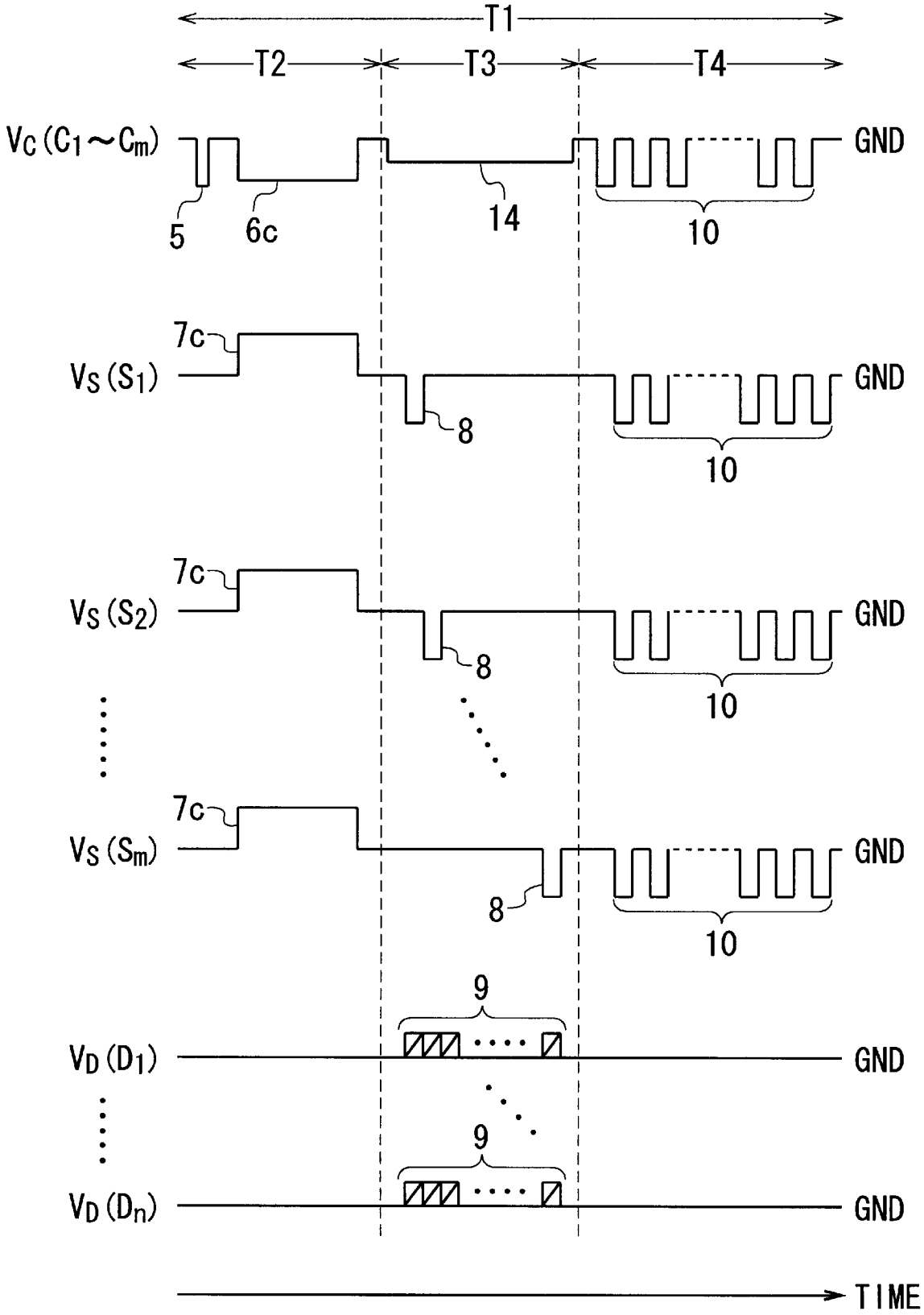
FIG. 28 is a schematic waveform diagram showing the waveform of the driving voltage pulses applied to the respective electrodes in a method of driving an ac-type PDP according to an eleventh embodiment of the invention.

FIG. 28 shows a method of driving an ac-discharge type PDP according to an eleventh embodiment of the invention, which is the same as the method according to the fifth embodiment of FIG. 19 except that a secondary or sub scan pulse 14 is additionally applied in common to the sustain electrodes 54 in the scan period T3. Therefore, the explanation about the same pulses and operation is omitted here for the sake of simplification by attaching the same reference symbols as those in FIG. 19 to the same elements in FIG. 28.

Because of the reason explained in the seventh embodiment of FIG. 24, there is an additional advantage that error discharge is prevented in the unselected cells 61, which means that the PDP can be driven more stably than the method of the fifth embodiment.

Twelfth Embodiment

Figure 29:
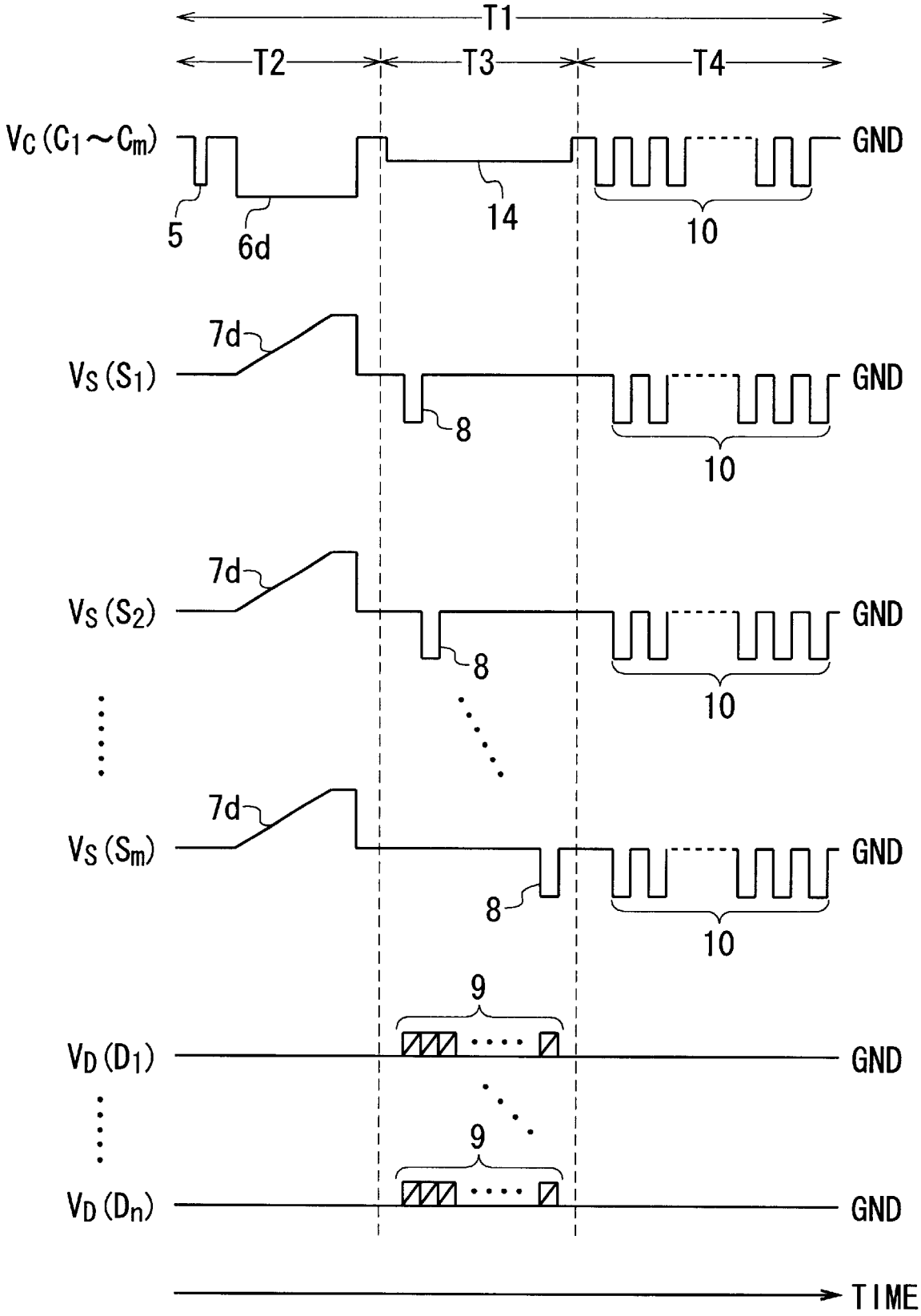
FIG. 29 is a schematic waveform diagram showing the waveform of the driving voltage pulses applied to the respective electrodes in a method of driving an ac-type PDP according to a twelfth embodiment of the invention.

FIG. 29 shows a method of driving an ac-discharge type PDP according to a twelfth embodiment of the invention, which is the same as the method according to the sixth embodiment of FIG. 21 except that a secondary or sub scan pulse 14 is additionally applied in common to the sustain electrodes 54 in the scan period T3. Therefore, the explanation about the same pulses and operation is omitted here for the sake of simplification by attaching the same reference symbols as those in FIG. 21 to the same elements in FIG. 29.

Because of the reason explained in the seventh embodiment of FIG. 24, there is an additional advantage that error discharge is prevented in the unselected cells 61, which means that the PDP can be driven more stably than the method of the sixth embodiment.

Thirteenth Embodiment

Figure 30:
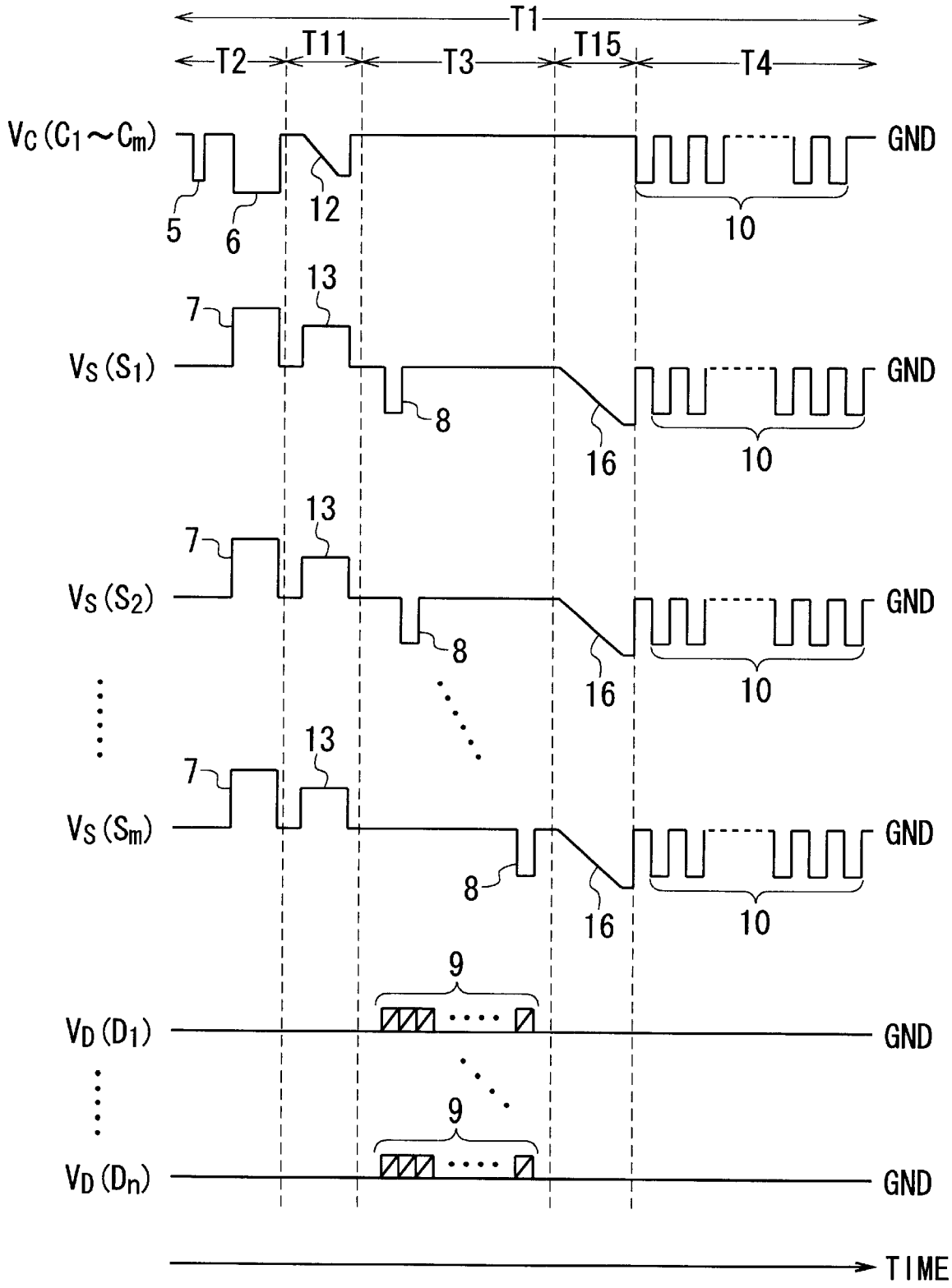
FIG. 30 is a schematic waveform diagram showing the waveform of the driving voltage pulses applied to the respective electrodes in a method of driving an ac-type PDP according to a thirteenth embodiment of the invention.

FIG. 30 shows a method of driving an ac-discharge type PDP according to a thirteenth embodiment of the invention, which is the same as the method according to the first embodiment of FIG. 7 except that a wall-charge elimination period T15 is additionally provided between the scan period T3 and the sustain period T4. Therefore, the explanation about the same pulses and operation is omitted here for the sake of simplification by attaching the same reference symbols as those in FIG. 7 to the same elements in FIG. 30.

In the scan period T3, desired writing discharge needs to be caused between the scan electrodes 53 and the data electrodes 57 in only the selected or emitting cells 61. This is performed by the action of the superposed electric-fields or voltages with the use of the wall charge that has been stored in the dielectric layer 55*a* in the wall-charge adjustment period T11. However, the wall charge are stored in all the cells 61 in the period T11 and thus, there is a possibility that error discharge occurs between the scan electrodes 53 and the data electrodes 57 in the unselected or non-emitting cells 61 to which the data pulses 9 are not applied. Once error discharge occurs in the period T11, it is kept even in the sustain period T4. This means that the unselected cells 61 emit light in error, in other words, unintended light-emission occurs in the unselected cells 61.

With the method of the thirteenth embodiment of FIG. 30, such unintended light-emission can be prevented by applying an elimination pulse 16 in common to the scan electrodes 53 in the wall charge elimination period T15. The pulse 16, which is negative, has a triangular waveform, as shown in FIG. 30. The amplitude of the pulse 16 increases linearly from zero to a specific negative value. The maximum amplitude of the pulse 16 is set at a value in the range of, for example, −150 V to −230 V.

Due to application of the elimination pulse 16 before the scan period T4, weak or feeble discharge is caused between the scan and sustain electrodes 53 and 54, thereby eliminating the wall charge that has been stored in the dielectric layer 55*a* in the unselected or non-emitting cells 61. As a result, error light-emission of the unselected cells 61 can be prevented.

Next, the change of the wall charge distribution before and after the wall charge elimination period T15 is explained below with reference to FIGS. 31A to 31C and FIGS. 32A to 32C.

Figure 32A:
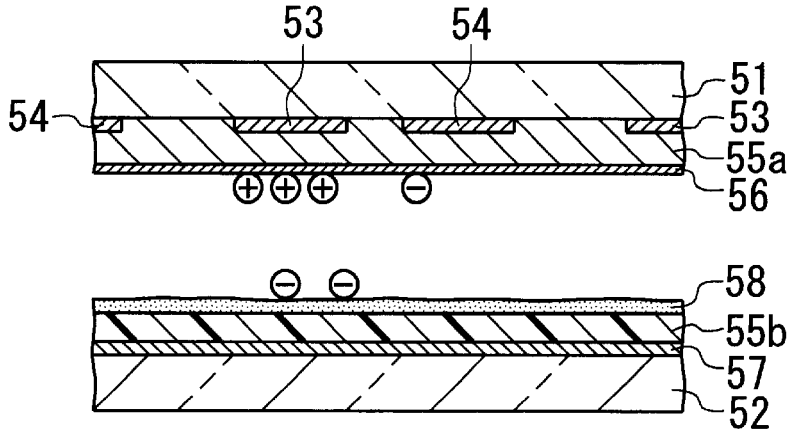
FIGS. 32A to 32C are partial cross-sectional views showing schematically the distribution of the wall charge in the selected cells in the method according to the thirteenth embodiment of FIG. 30, respectively.

At the time the scan period T3 is finished, in the selected cells 61, positive wall charge is stored in the dielectric layer 55*a* over the scan electrodes 53 while negative wall charge is stored in the dielectric layer 55*b* over the data electrodes 57, as shown in FIG. 32A. In this state, negative wall charge is left in the dielectric layer 55*a* over the sustain electrodes 54.

Figure 31A:
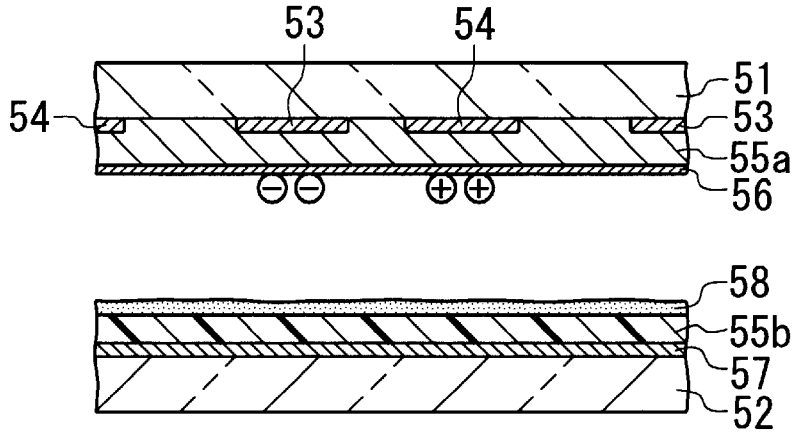
FIGS. 31A to 31C are partial cross-sectional views showing schematically the distribution of the wall charge in the unselected cells in the method according to the thirteenth embodiment of FIG. 30, respectively.

On the other hand, in the unselected cells 61, positive wall charge is stored in the dielectric layer 55*a* over the scan electrodes 53 while negative wall charge is stored in the same dielectric layer 55*a* over the sustain electrodes 54, as shown in FIG. 31A. No wall charge is stored in the dielectric layer 55*b* over the data electrodes 57.

Thereafter, when the negative wall charge elimination period T15 has begun, the wall-charge elimination pulse 16 is applied in common to the scan electrodes 53 in all the cells 61.

At this time, in the selected cells 61, since the positive wall charge has been stored over the scan electrodes 53, the amount of the wall charge is decreased by the negative elimination pulse 16 applied to the scan electrodes 53. Thus, the potential difference (i.e., voltage) between the scan and sustain electrodes 53 and 54 is reduced. As a result, the wall charge distribution shown in FIG. 32A is kept almost unchanged even when the elimination period T15 has finished.

Figure 31B:
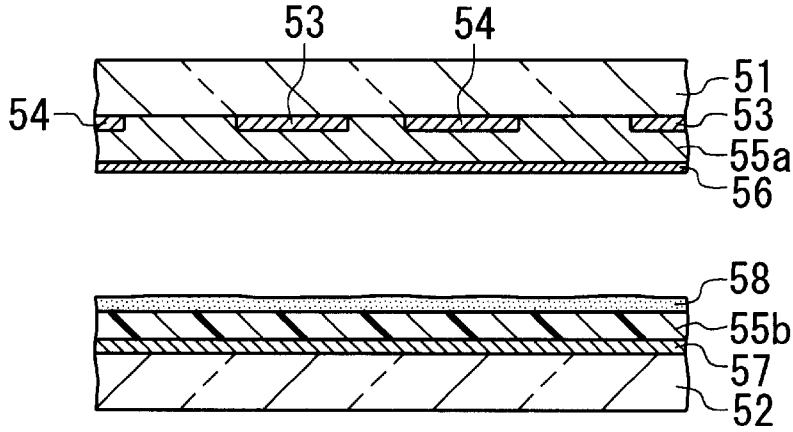

On the other hand, in the unselected cells 61, since the negative wall charge has been stored over the scan electrodes 53, the amount of the wall charge is increased by the negative elimination pulse 16 applied to the scan electrodes 53. Thus, the potential difference (i.e., voltage) between the scan and sustain electrodes 53 and 54 is raised, causing feeble or weak discharge between the scan and sustain electrodes 53 and 54. As a result, the wall charge is eliminated, as shown in FIG. 31B.

Figure 32B:
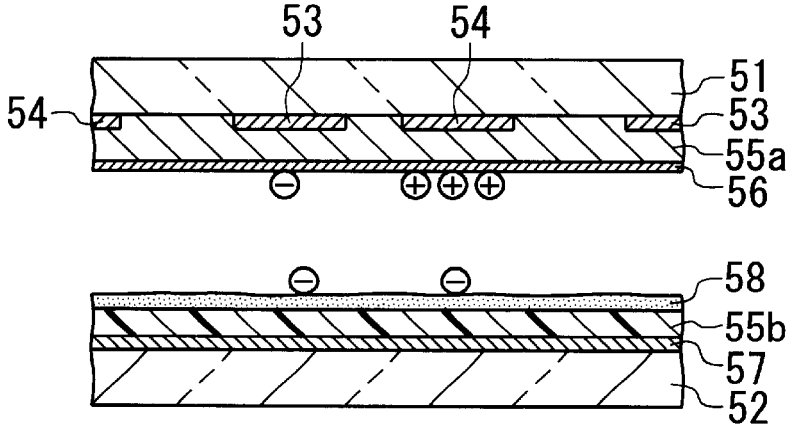
Figure 32C:
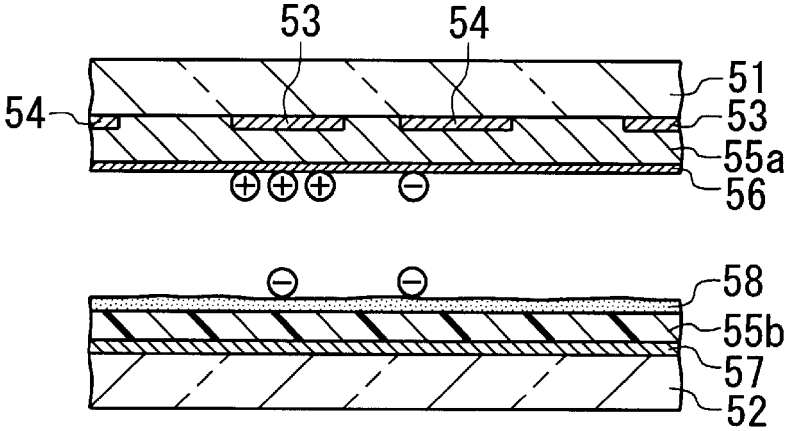

Following this, when the sustain period T4 has begun, in the selected cells 61, the wall charge distribution is turned from the state of FIG. 32A to the state of FIG. 32B due to the first sustain discharge. Specifically, as shown in FIG. 32B, negative wall charge is stored in the dielectric layer 55*a* over the scan electrodes 53 while positive wall charge is stored in the same dielectric layer 55*a* over the sustain electrodes 54. Thereafter, due to the second sustain discharge, positive wall charge is stored in the dielectric layer 55*a* over the scan electrodes 53 while negative wall charge is stored in the same dielectric layer 55*a* over the sustain electrodes 54, as shown in FIG. 32C. This sustain discharge operation is repeated at plural times according to the application count of the sustain pulses 10.

Figure 31C:
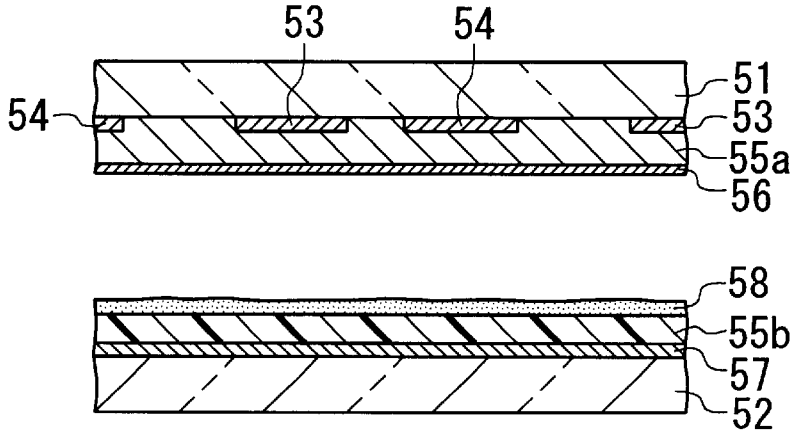

On the other hand, in the unselected cells 61, no sustain discharge occurs in the sustain period T4. Thus, no wall charge is stored in the dielectric layers 55*a* and 55*b* even in this period T4, as shown in FIG. 31C.

Fourteenth Embodiment

Figure 33:
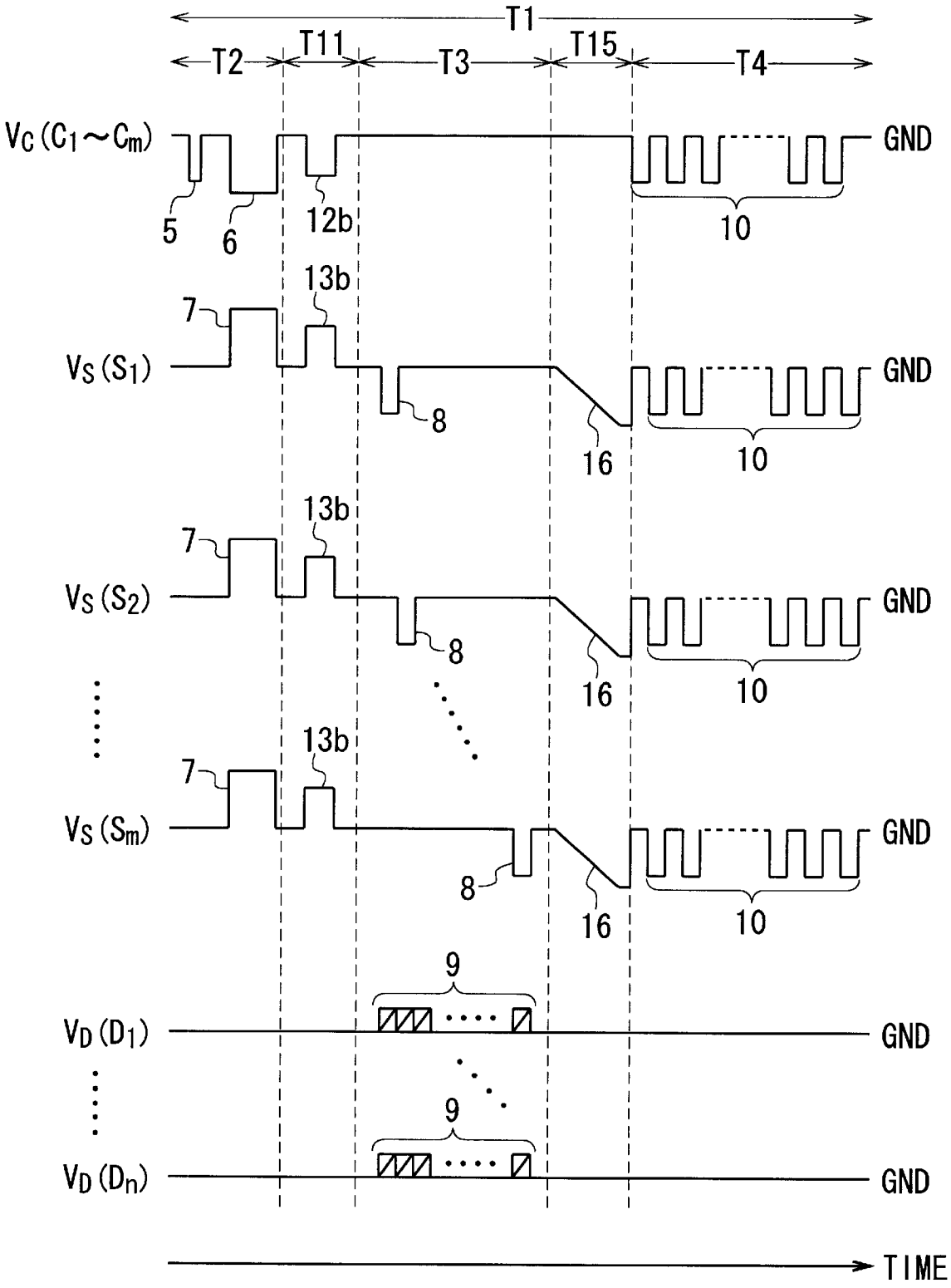
FIG. 33 is a schematic waveform diagram showing the waveform of the driving voltage pulses applied to the respective electrodes in a method of driving an ac-type PDP according to a fourteenth embodiment of the invention.

FIG. 33 shows a method of driving an ac-discharge type PDP according to a fourteenth embodiment of the invention, which is the same as the method according to the second embodiment of FIG. 11 except that the elimination pulse 16 is applied in common to the scan electrodes 53 in the wall-charge elimination period T15 provided between the scan period T3 and the sustain period T4.

Because of the reason explained in the thirteenth embodiment of FIG. 30, there is an additional advantage that unintended or error light-emission is prevented in the unselected cells 61.

Fifteenth Embodiment

Figure 34:
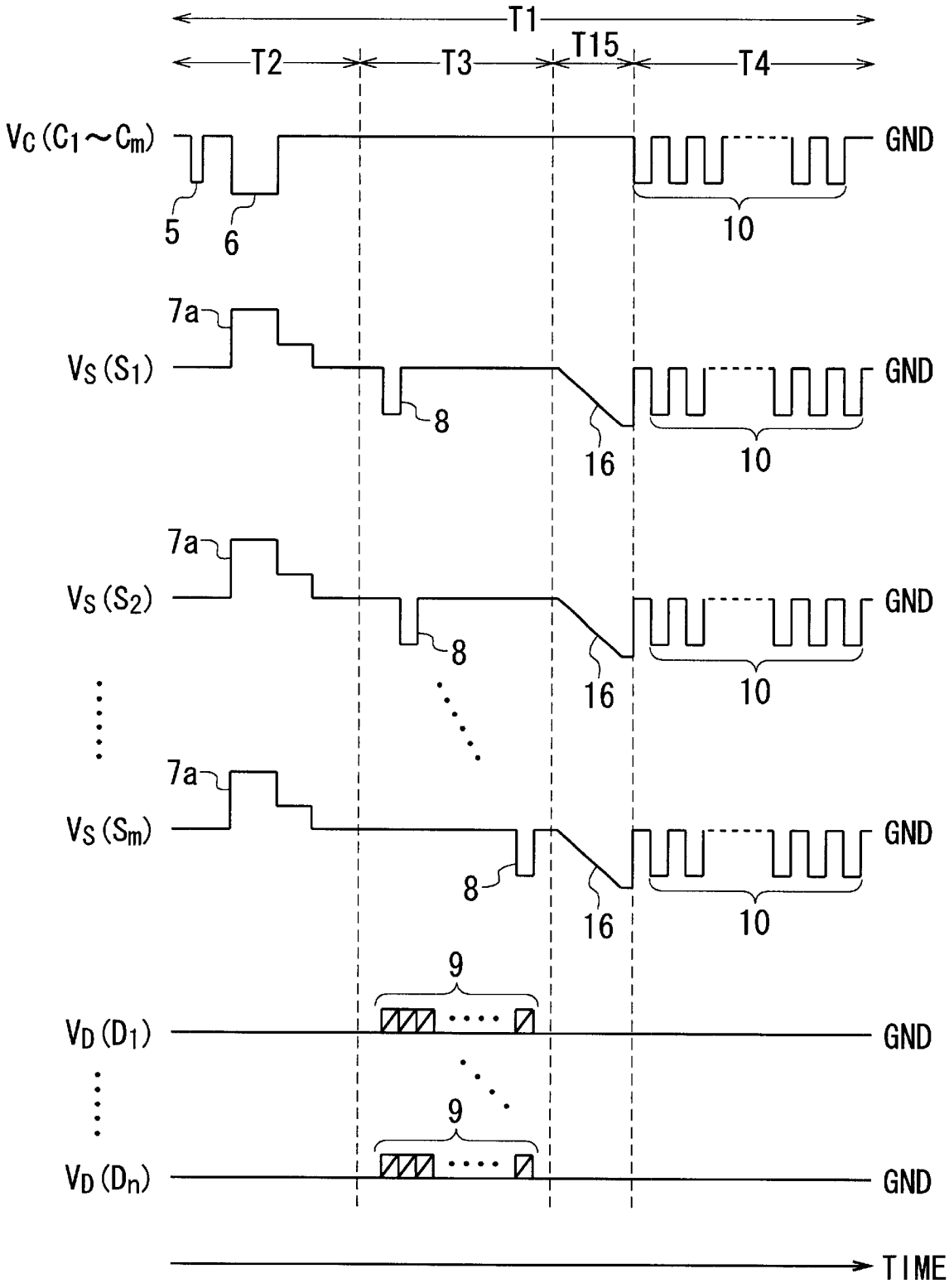
FIG. 34 is a schematic waveform diagram showing the wave form of the driving voltage pulses applied to the respective electrodes in a method of driving an ac-type PDP according to a fifteenth embodiment of the invention.

FIG. 34 shows a method of driving an ac-discharge type PDP according to a fifteenth embodiment of the invention, which is the same as the method according to the third embodiment of FIG. 12 except that the elimination pulse 16 is applying in common to the scan electrodes 53 in the wall charge elimination period T15 provided between the scan period T3 and the sustain period T4.

Because of the reason explained in the thirteenth embodiment of FIG. 30, there is an additional advantage that unintended or error light-emission is prevented in the unselected cells 61.

Sixteenth Embodiment

Figure 35:
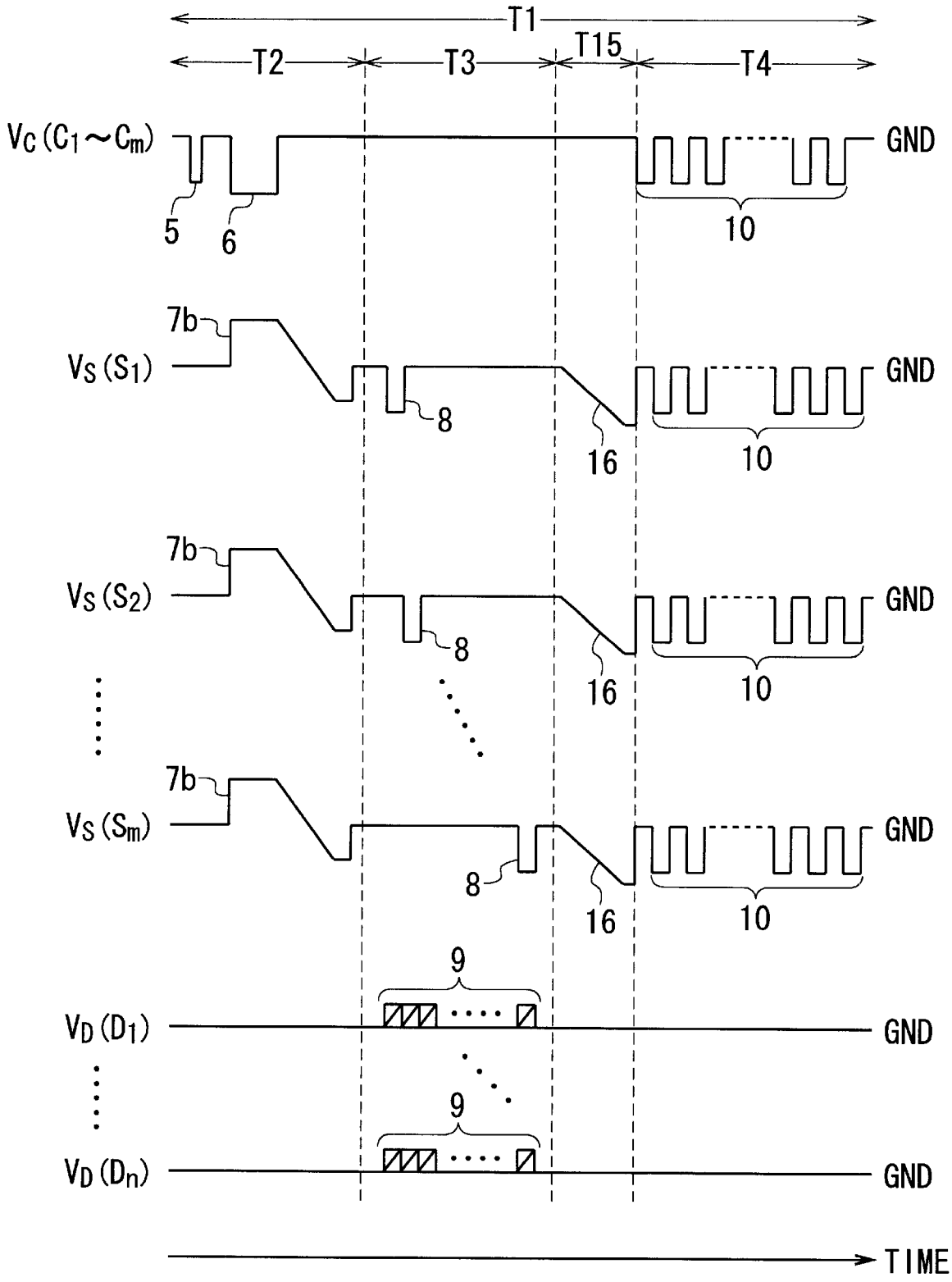
FIG. 35 is a schematic waveform diagram showing the waveform of the driving voltage pulses applied to the respective electrodes in a method of driving an ac-type PDP according to a sixteenth embodiment of the invention.

FIG. 35 shows a method of driving an ac-discharge type PDP according to a sixteenth embodiment of the invention, which is the same as the method according to the fourth embodiment of FIG. 16 except that the elimination pulse 16 is applying in common to the scan electrodes 53 in the wall charge elimination period T15 provided between the scan period T3 and the sustain period T4.

Because of the reason explained in the thirteenth embodiment of FIG. 30, there is an additional advantage that unintended or error light-emission is prevented in the unselected cells 61.

Seventeenth Embodiment

Figure 36:
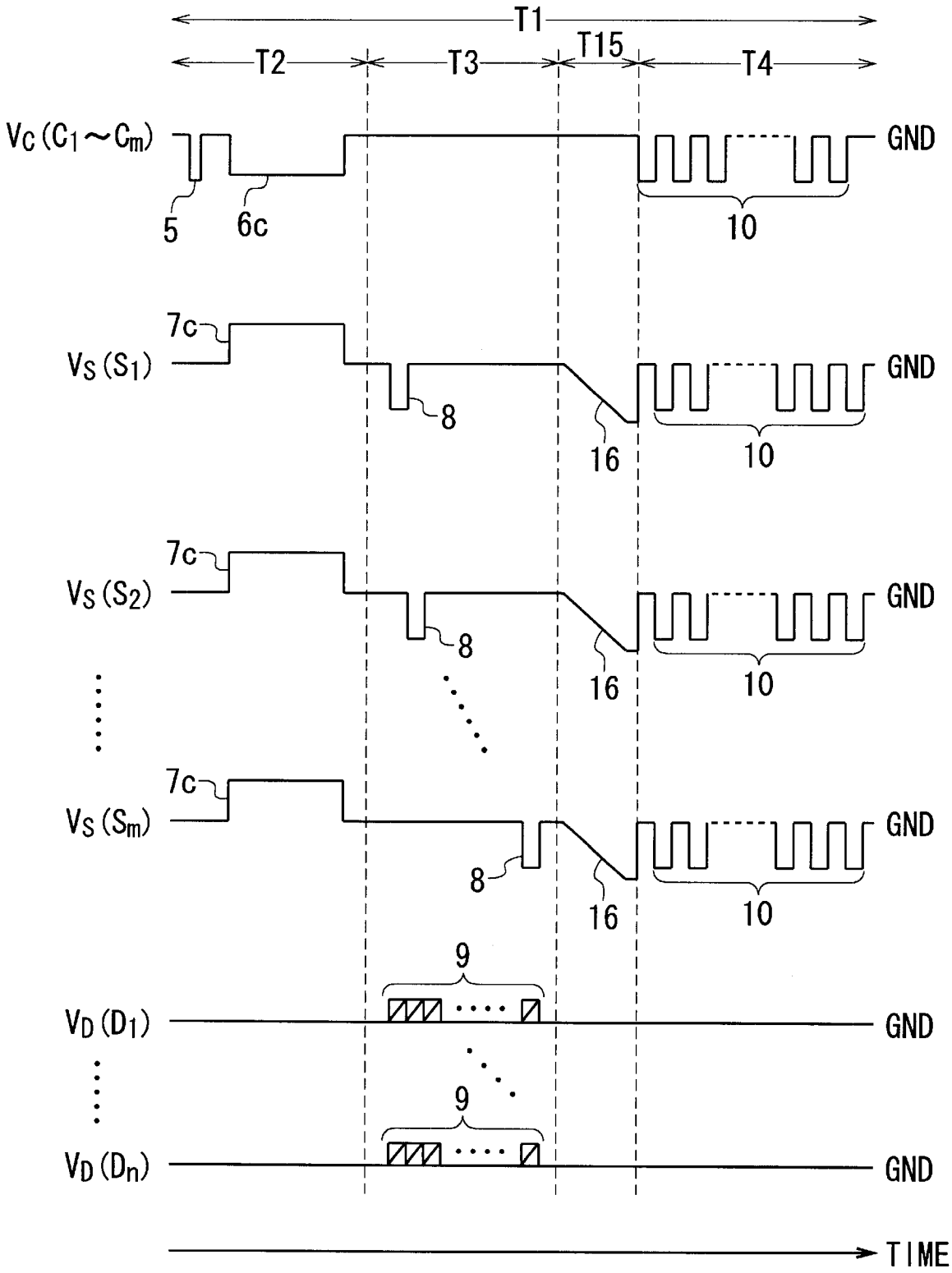
FIG. 36 is a schematic waveform diagram showing the waveform of the driving voltage pulses applied to the respective electrodes in a method of driving an ac-type PDP according to a seventeenth embodiment of the invention.

FIG. 36 shows a method of driving an ac-discharge type PDP according to a seventeenth embodiment of the invention, which is the same as the method according to the fifth embodiment of FIG. 19 except that the elimination pulse 16 is applying in common to the scan electrodes 53 in the wall charge elimination period T15 provided between the scan period T3 and the sustain period T4.

Because of the reason explained in the thirteenth embodiment of FIG. 30, there is an additional advantage that unintended or error light-emission is prevented in the unselected cells 61.

Eighteenth Embodiment

Figure 37:
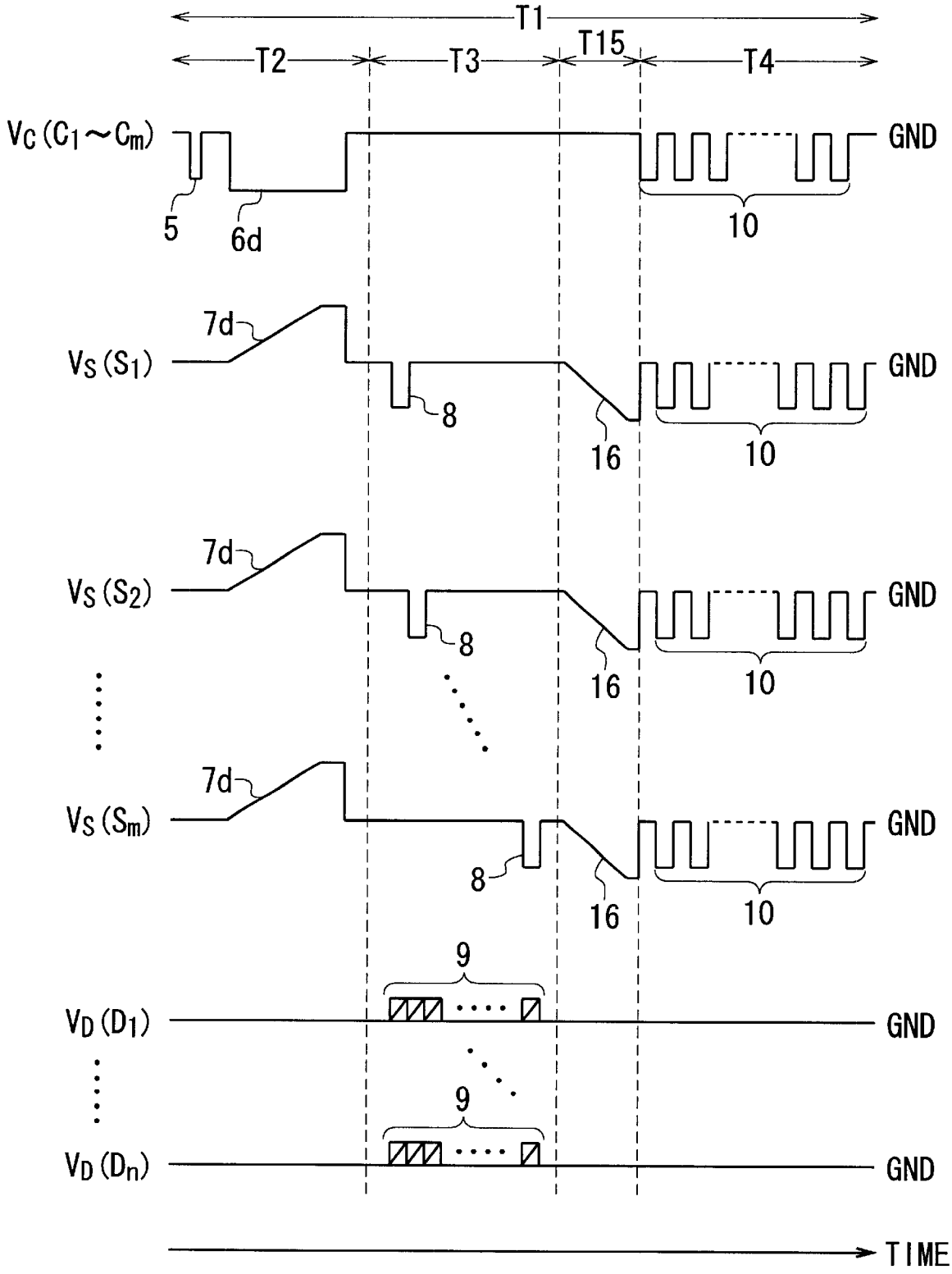
FIG. 37 is a schematic waveform diagram showing the waveform of the driving voltage pulses applied to the respective electrodes in a method of driving an ac-type PDP according to an eighteenth embodiment of the invention.

FIG. 37 shows a method of driving an ac-discharge type PDP according to an eighteenth embodiment of the invention, which is the same as the method according to the sixth embodiment of FIG. 21 except that the elimination pulse 16 is applying in common to the scan electrodes 53 in the wall charge elimination period T15 provided between the scan period T3 and the sustain period T4.

Because of the reason explained in the thirteenth embodiment of FIG. 30, there is an additional advantage that unintended or error light-emission is prevented in the unselected cells 61.

Nineteenth Embodiment

Figure 38:
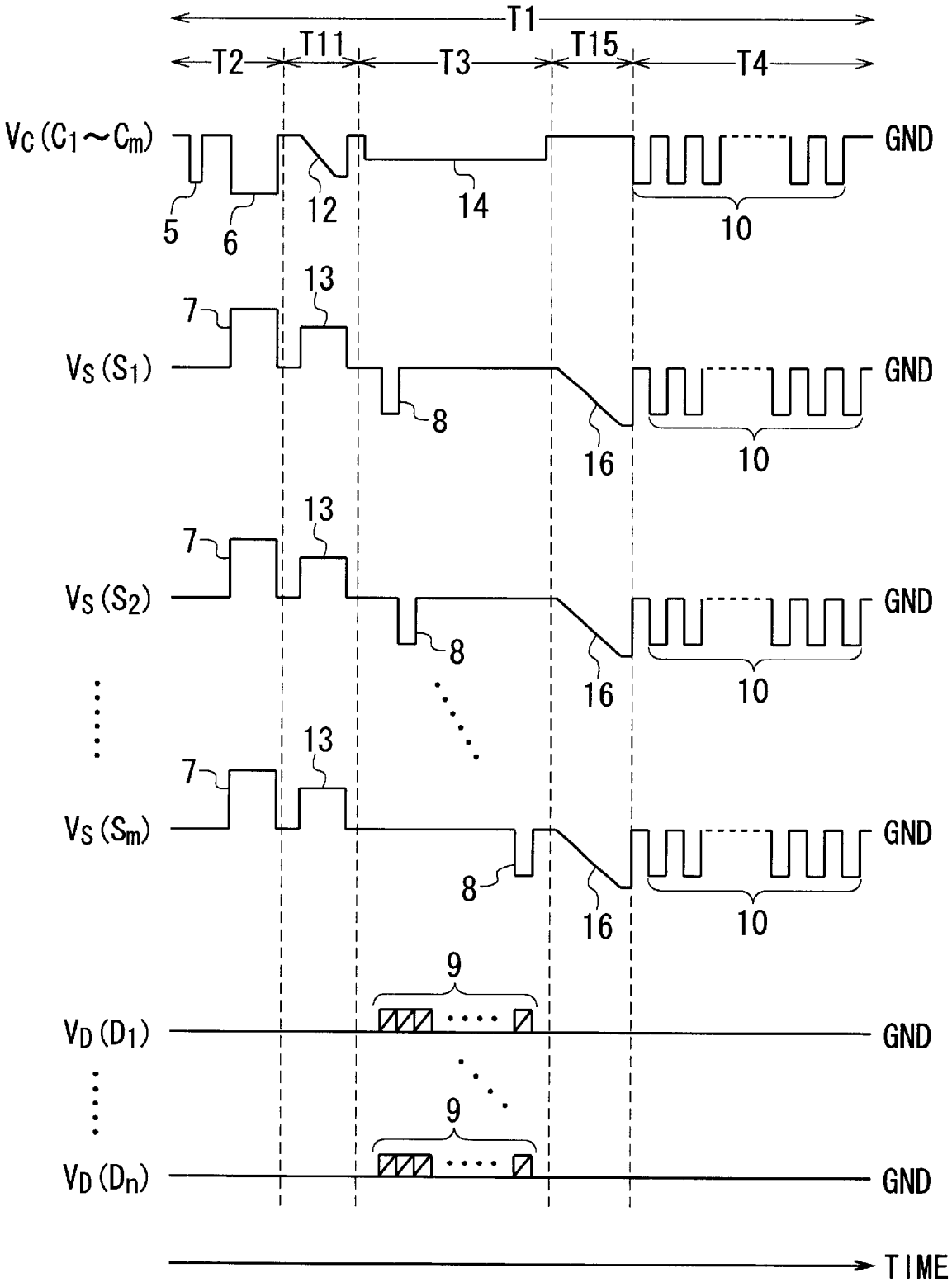
FIG. 38 is a schematic waveform diagram showing the waveform of the driving voltage pulses applied to the respective electrodes in a method of driving an ac-type PDP according to a nineteenth embodiment of the invention.

FIG. 38 shows a method of driving an ac-discharge type PDP according to a nineteenth embodiment of the invention, which is the same as the method according to the thirteenth embodiment of FIG. 30 except that the elimination pulse 16 is applying in common to the scan electrodes 53 in the wall charge elimination period T15 provided between the scan period T3 and the sustain period T4.

Because of the reason explained in the thirteenth embodiment of FIG. 30, there is an additional advantage that unintended or error light-emission is prevented in the unselected cells 61.

Twentieth Embodiment

Figure 39:
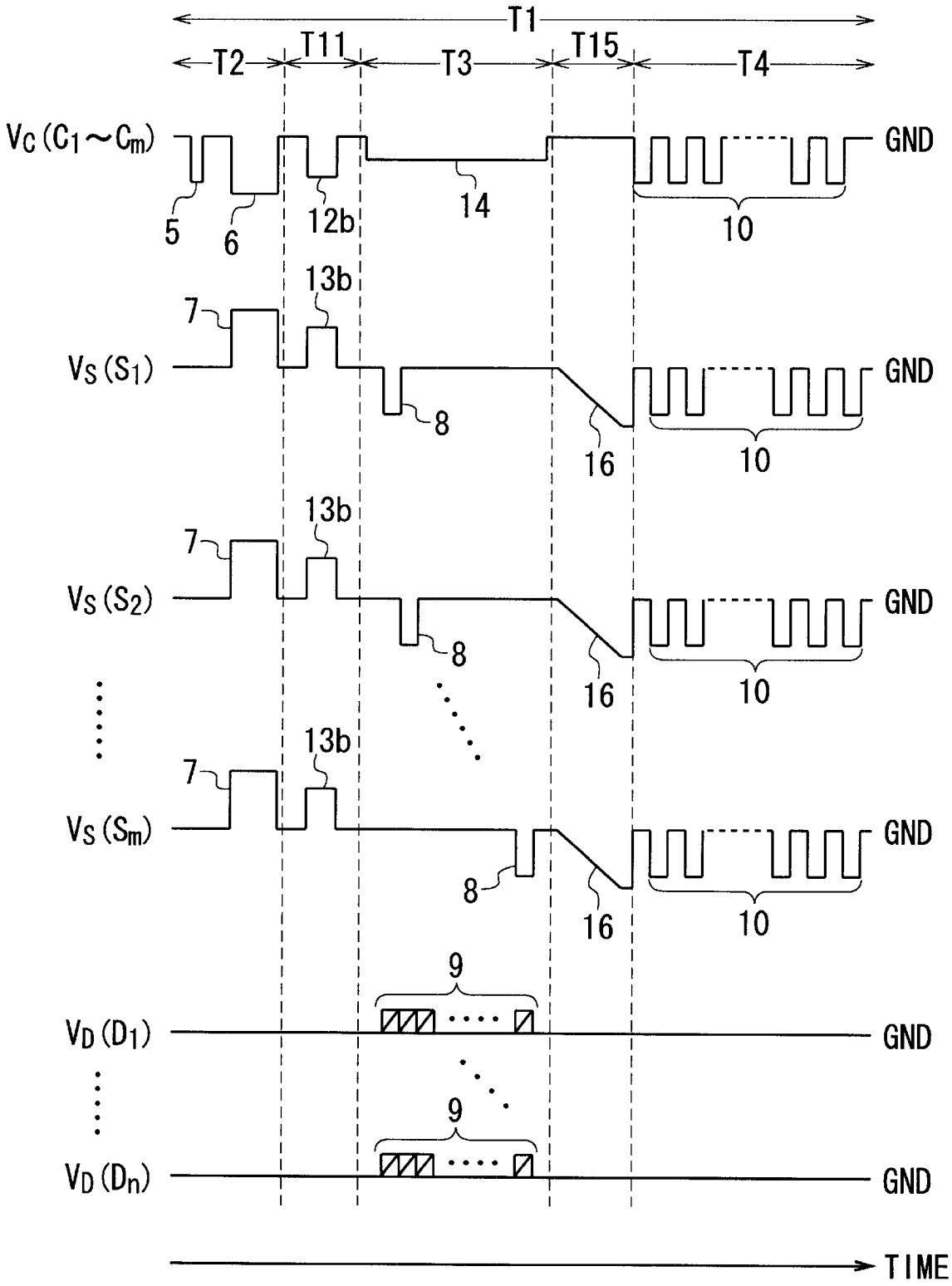
FIG. 39 is a schematic waveform diagram showing the waveform of the driving voltage pulses applied to the respective electrodes in a method of driving an ac-type PDP according to a twentieth embodiment of the invention.

FIG. 39 shows a method of driving an ac-discharge type PDP according to a twentieth embodiment of the invention, which is the same as the method according to the fourteenth embodiment of FIG. 33 except that the elimination pulse 16 is applying in common to the scan electrodes 53 in the wall charge elimination period T15 provided between the scan period T3 and the sustain period T4.

Because of the reason explained in the thirteenth embodiment of FIG. 30, there is an additional advantage that unintended or error light-emission is prevented in the unselected cells 61.

Twenty-First Embodiment

Figure 40:
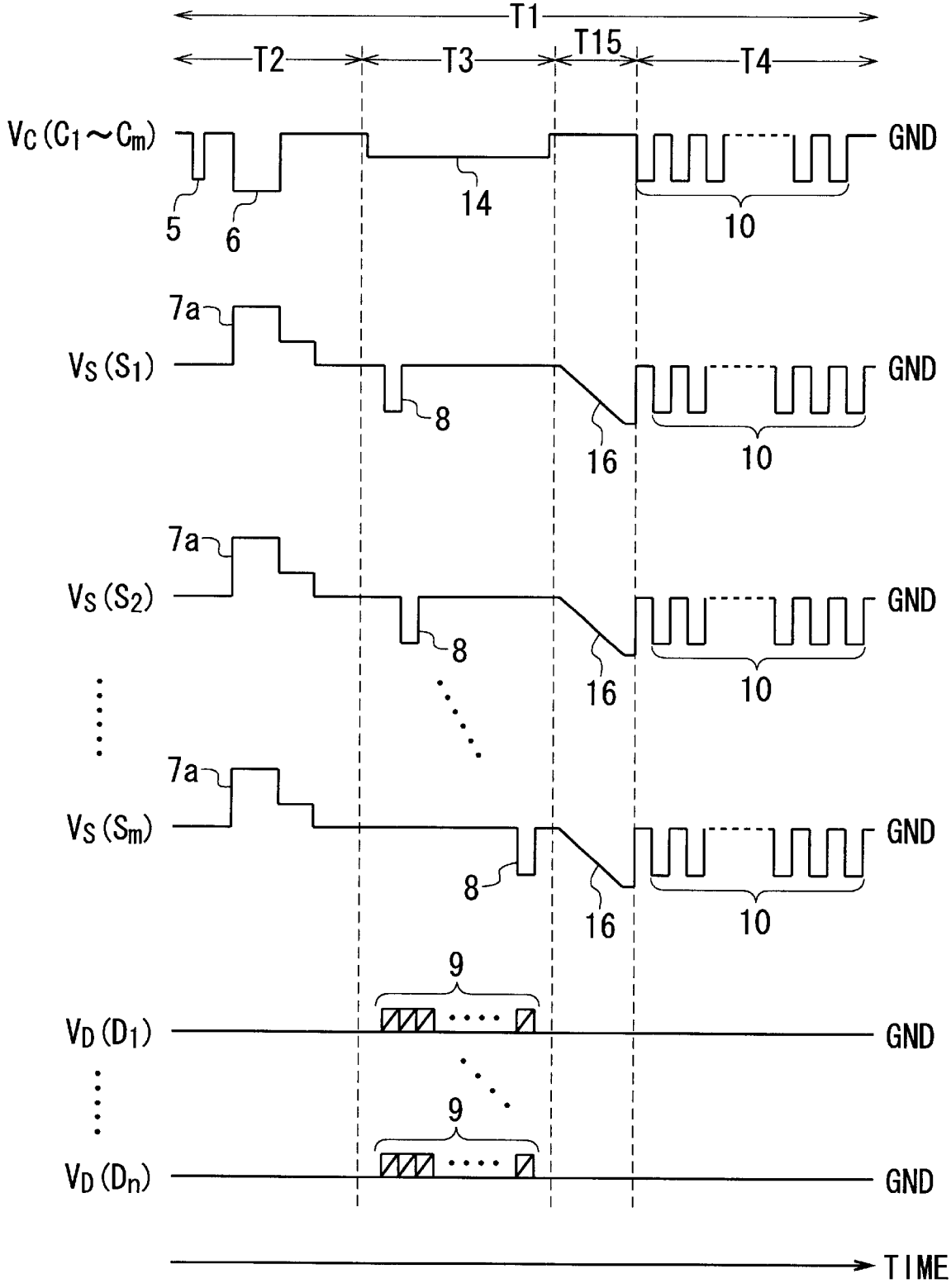
FIG. 40 is a schematic waveform diagram showing the waveform of the driving voltage pulses applied to the respective electrodes in a method of driving an ac-type PDP according to a twenty-first embodiment of the invention.

FIG. 40 shows a method of driving an ac-discharge type PDP according to a twenty-first embodiment of the invention, which is the same as the method according to the fifteenth embodiment of FIG. 34 except that the elimination pulse 16 is applying in common to the scan electrodes 53 in the wall charge elimination period T15 provided between the scan period T3 and the sustain period T4.

Because of the reason explained in the thirteenth embodiment of FIG. 30, there is an additional advantage that unintended or error light-emission is prevented in the unselected cells 61.

Twenty-Second Embodiment

Figure 41:
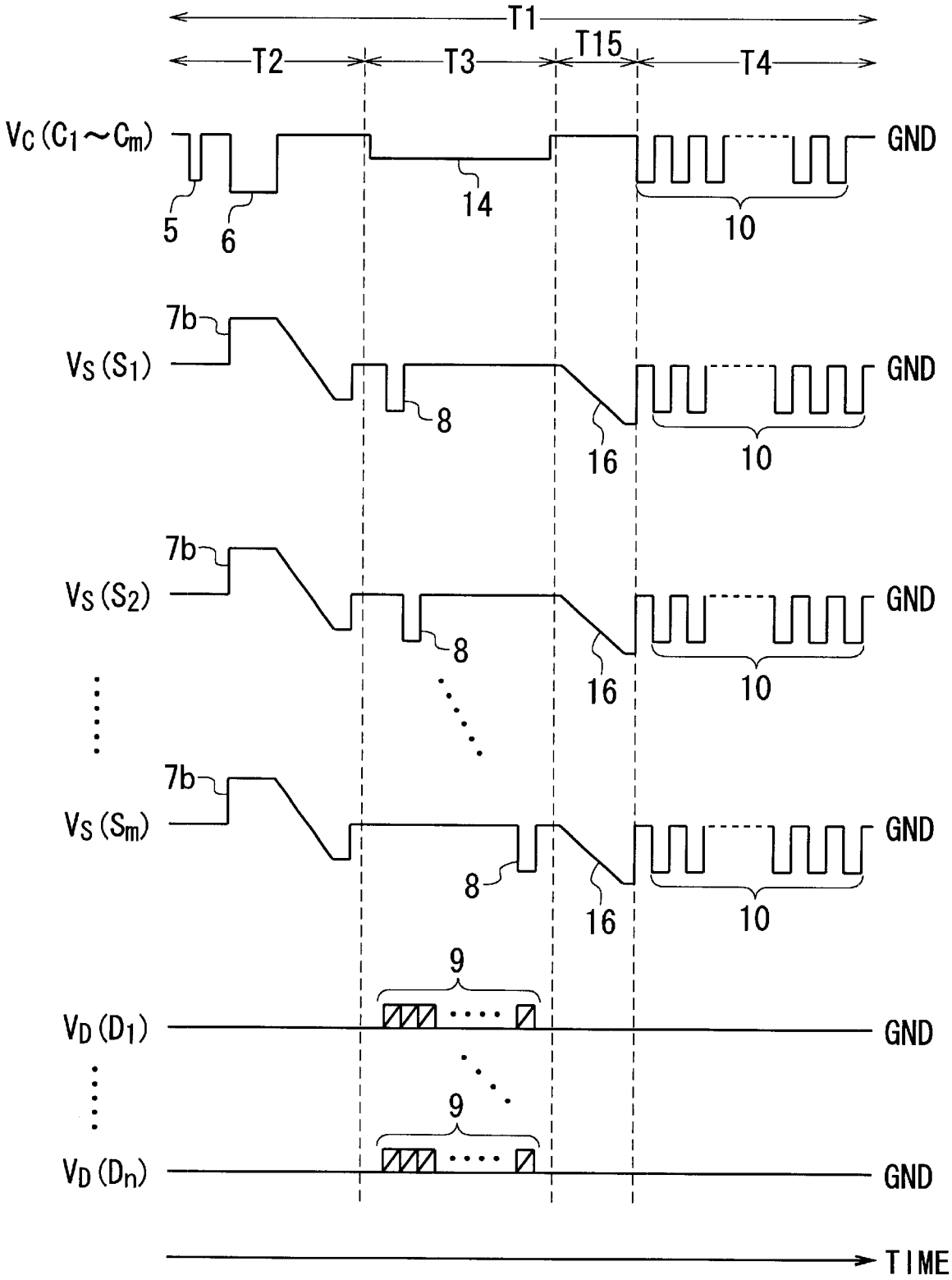
FIG. 41 is a schematic waveform diagram showing the waveform of the driving voltage pulses applied to the respective electrodes in a method of driving an ac-type PDP according to a twenty-second embodiment of the invention.

FIG. 41 shows a method of driving an ac-discharge type PDP according to a twenty-second embodiment of the invention, which is the same as the method according to the sixteenth embodiment of FIG. 35 except that the elimination pulse 16 is applying in common to the scan electrodes 53 in the wall charge elimination period T15 provided between the scan period T3 and the sustain period T4.

Because of the reason explained in the thirteenth embodiment of FIG. 30, there is an additional advantage that unintended or error light-emission is prevented in the unselected cells 61.

Twenty-Third Embodiment

Figure 42:
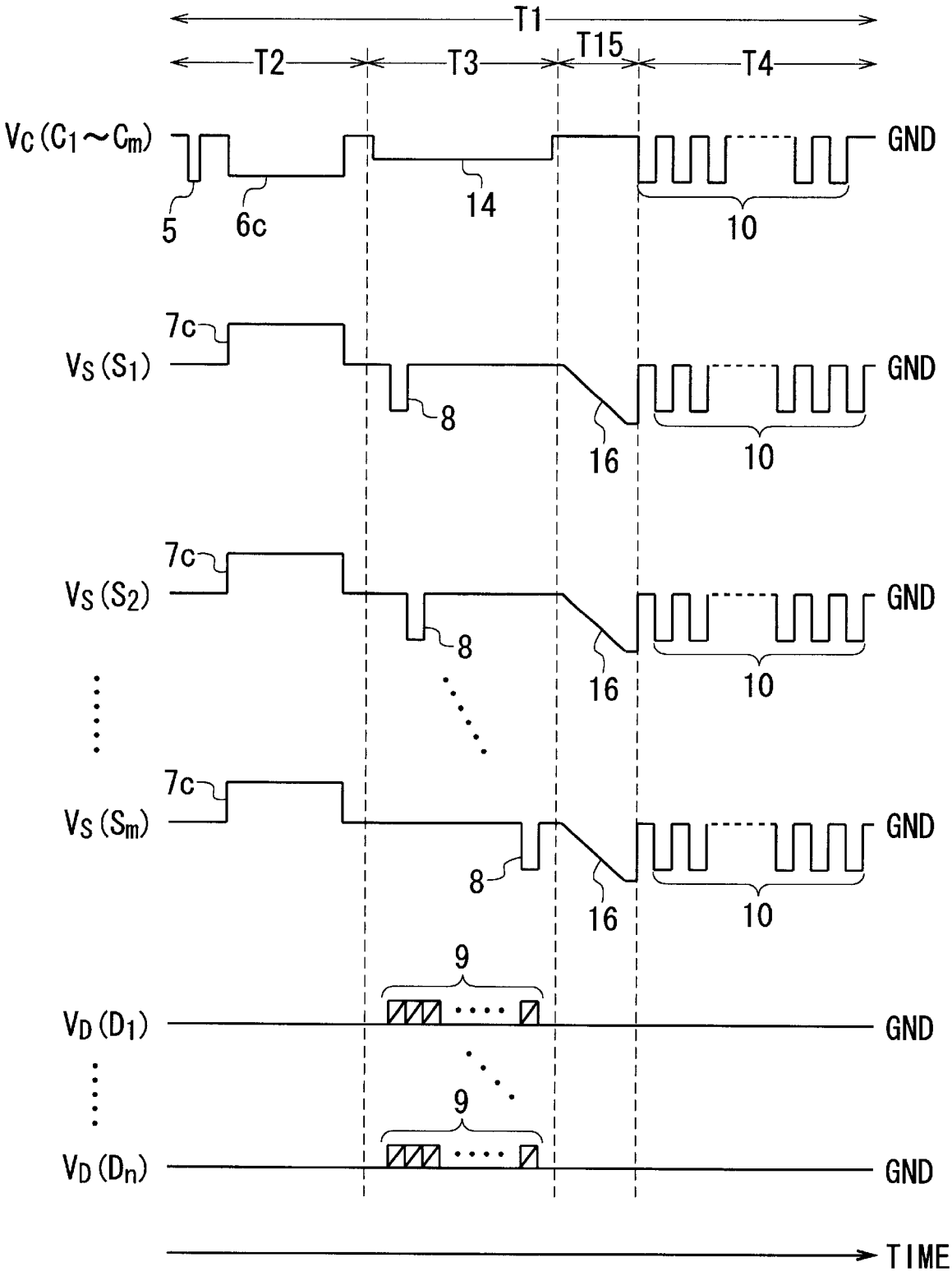
FIG. 42 is a schematic waveform diagram showing the waveform of the driving voltage pulses applied to the respective electrodes in a method of driving an ac-type PDP according to a twenty-third embodiment of the invention.

FIG. 42 shows a method of driving an ac-discharge type PDP according to a twenty-third embodiment of the invention, which is the same as the method according to the seventeenth embodiment of FIG. 36 except that the elimination pulse 16 is applying in common to the scan electrodes 53 in the wall charge elimination period T15 provided between the scan period T3 and the sustain period T4.

Because of the reason explained in the thirteenth embodiment of FIG. 30, there is an additional advantage that unintended or error light-emission is prevented in the unselected cells 61.

Twenty-Fourth Embodiment

Figure 43:
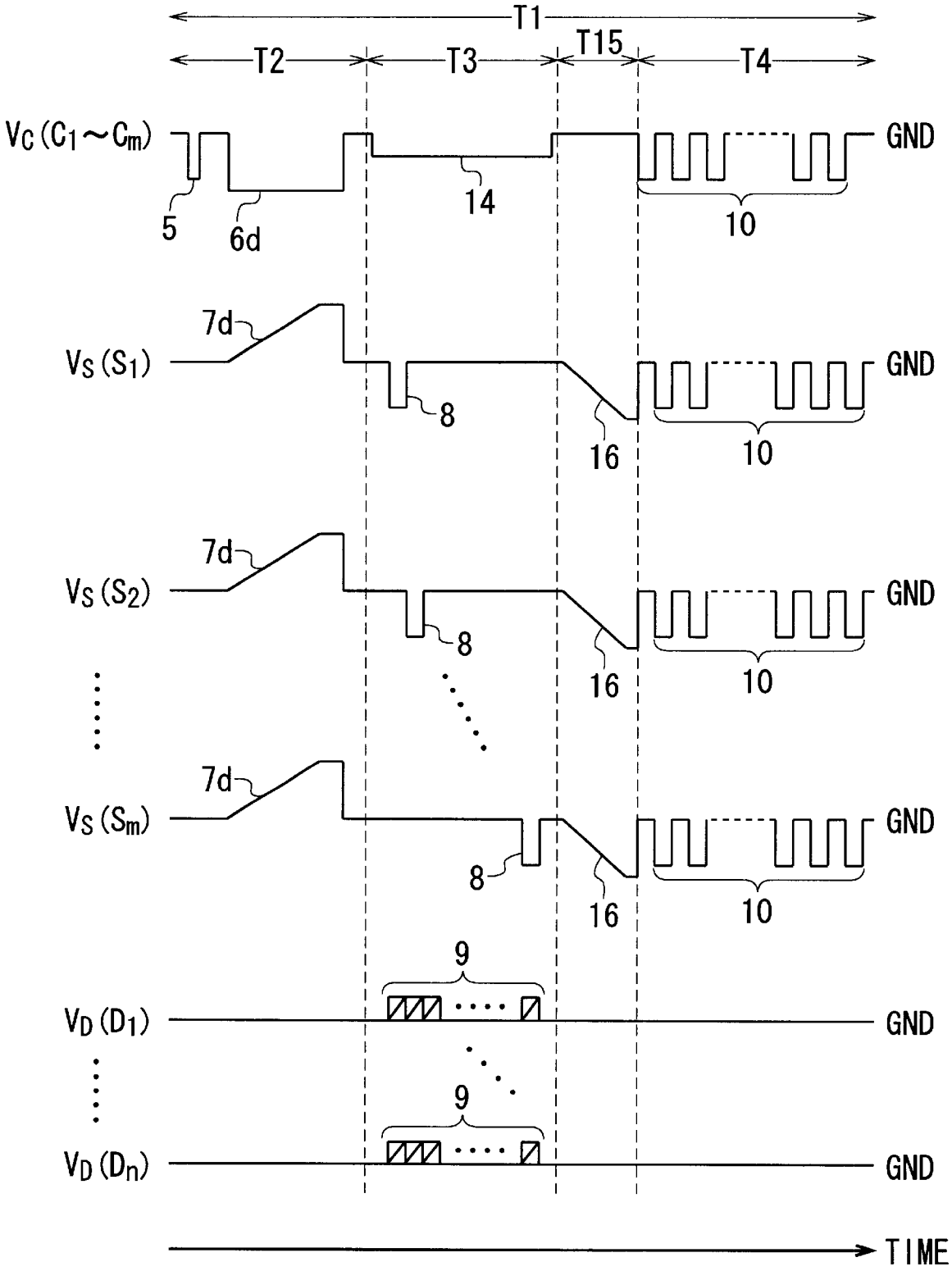
FIG. 43 is a schematic waveform diagram showing the waveform of the driving voltage pulses applied to the respective electrodes in a method of driving an ac-type PDP according to a twenty-fourth embodiment of the invention.

FIG. 43 shows a method of driving an ac-discharge type PDP according to a twenty-fourth embodiment of the invention, which is the same as the method according to the eighteenth embodiment of FIG. 37 except that the elimination pulse 16 is applying in common to the scan electrodes 53 in the wall charge elimination period T15 provided between the scan period T3 and the sustain period T4.

Because of the reason explained in the thirteenth embodiment of FIG. 30, there is an additional advantage that unintended or error light-emission is prevented in the unselected cells 61.

Variations

In the above-described seventh to twelfth embodiments and the nineteenth to twenty-fourth embodiments, the secondary or sub scan pulse 14 is commonly applied to the sustain electrodes 54 in the scan period T3. However, it is sufficient for the pulse 14 to be applied to the electrodes 54 within the period to which the scan pulse 8 (i.e., the pulse for causing writing discharge) is applied.

Figure 44A:
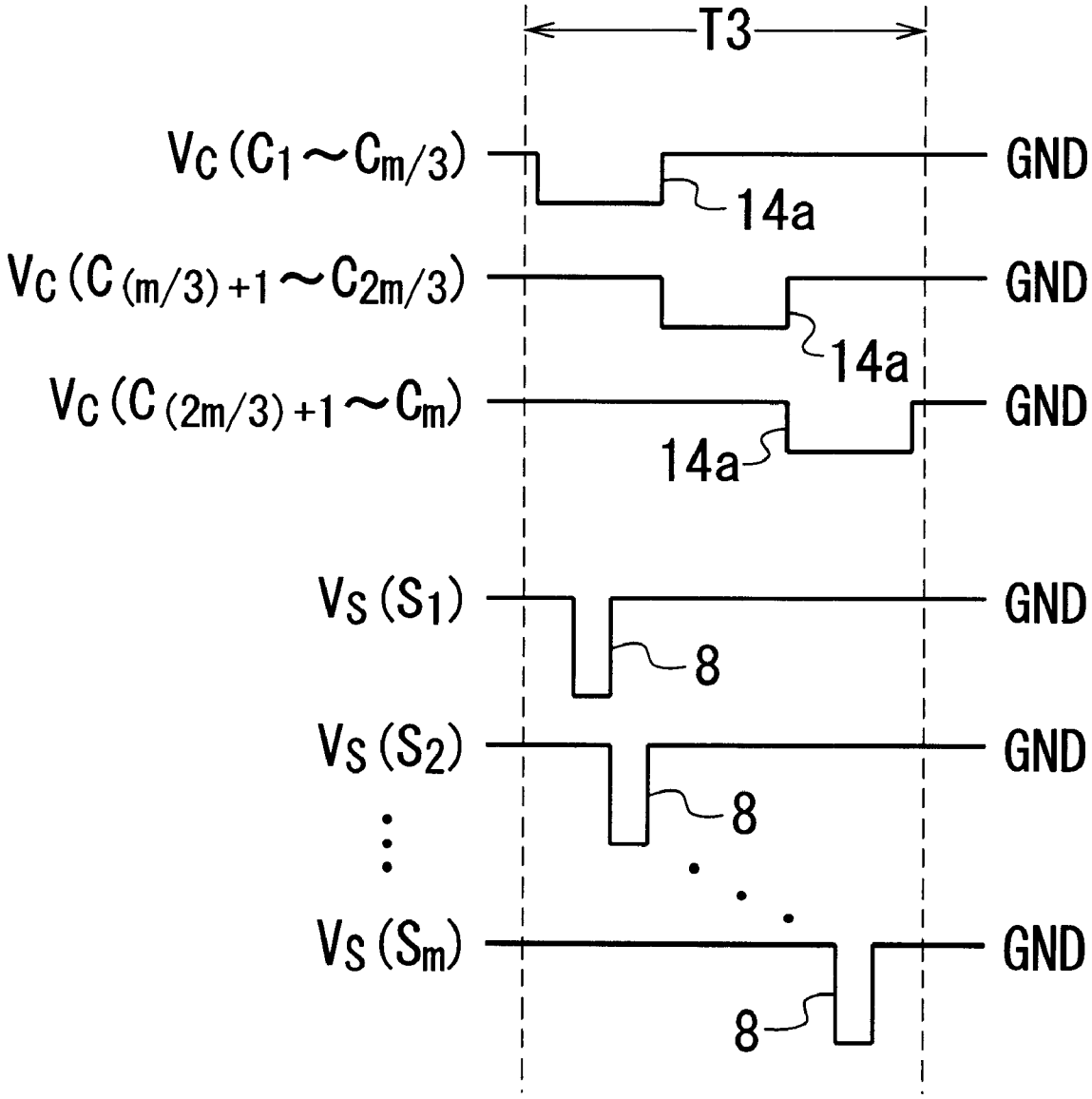
FIG. 44A is a schematic waveform diagram showing a variation of the waveform of the driving voltage pulses applied to the respective electrodes in each of the methods according to the seventh to twelfth embodiments and the nineteenth to twenty-fourth embodiments.

Therefore, for example, three different pulses 14*a* as shown in FIG. 44A may be used instead of the pulse 14. In this case, the sustain electrodes 54 are divided into three groups, i.e., $C_1$ to $C_{(m/3)}$, $C_{(m/3)+1}$ to $C_{(2m/3)}$, and $C_{(2m/3)+1}$ to $C_m$. The first pulse 14*a* is commonly applied to the group of the electrodes $C_1$ to $C_{(m/3)}$, the second pulse 14*a* is commonly applied to the group of the electrodes $C_{(m/3)+1}$ to $C_{(2m/3)}$, and the third pulse 14*a* is commonly applied to the group of the electrodes $C_{(2m/3)+1}$ to $C_m$.

In the above-described thirteenth to twenty-fourth embodiments, the elimination pulse 16 is applied to the scan electrodes 53 once in the wall-charge elimination period T15. However, if the same effect is given, any pulse may be used for the pulse 16.

Figure 44B:
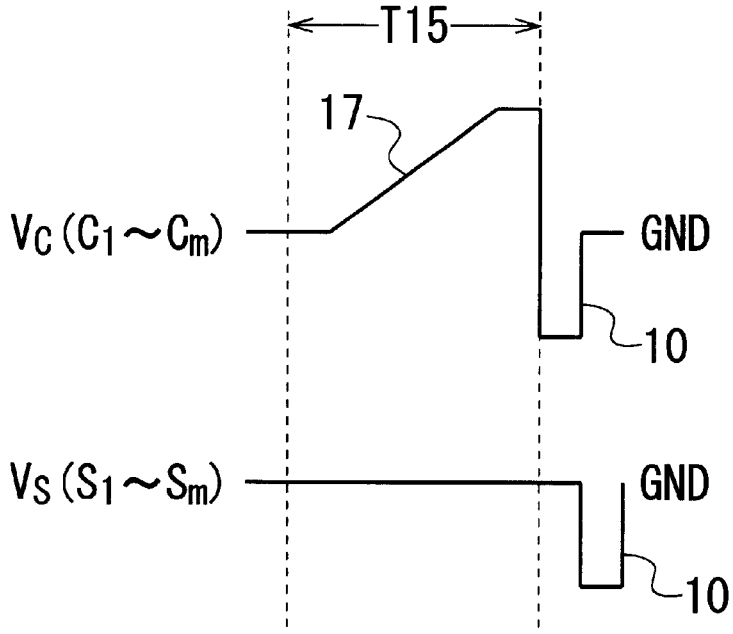
FIG. 44B is a schematic waveform diagram showing a variation of the waveform of the driving voltage applied to the respective electrodes in each of the methods according to the thirteenth to twenty-fourth embodiments.

For example, as shown in FIG. 44B, a positive elimination pule 17 may be applied to the sustain electrodes 54 ($C_1$ to $C_m$) instead of the scan electrodes 53 while no pulse is applied to the scan electrodes 53 ($S_1$ to $S_m$). The amplitude of the pulse 17 increases linearly from zero to a specific positive value.

Figure 44C:
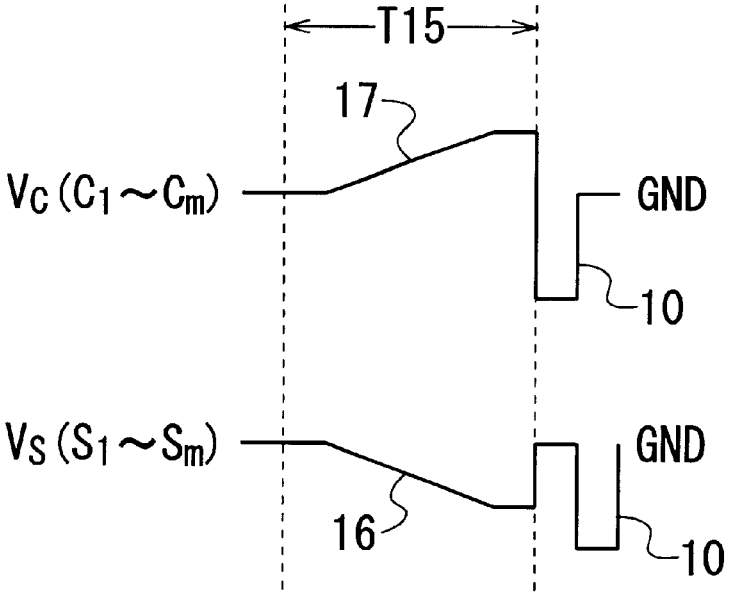
FIG. 44C is a schematic waveform diagram showing a variation of the waveform of the driving voltage applied to the respective electrodes in each of the methods according to the thirteenth to twenty-fourth embodiments.
Figure 45:
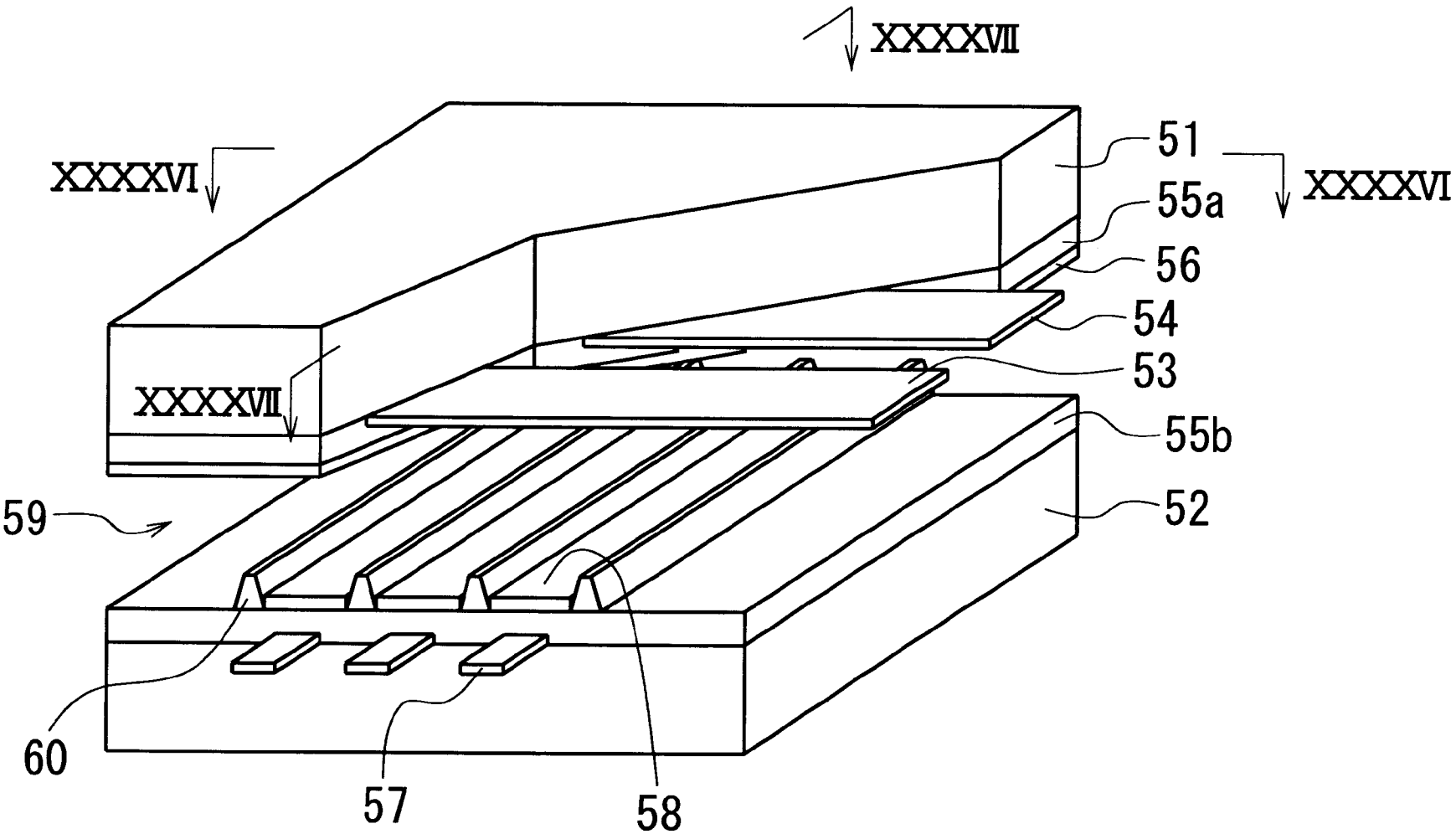
FIG. 45 is a partially cutaway, perspective view showing the main elements of the typical ac-type color PDP.
Figure 46:
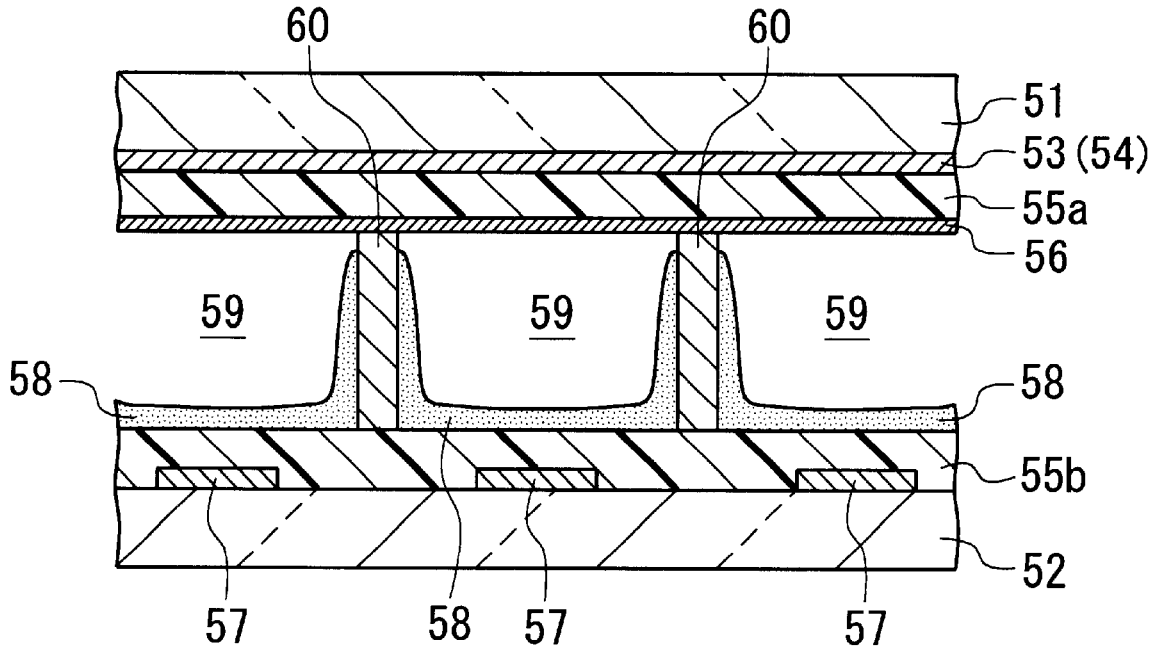
FIG. 46 is a cross-sectional view along the line XXXXVI—XXXXVI in FIG. 45.
Figure 47:
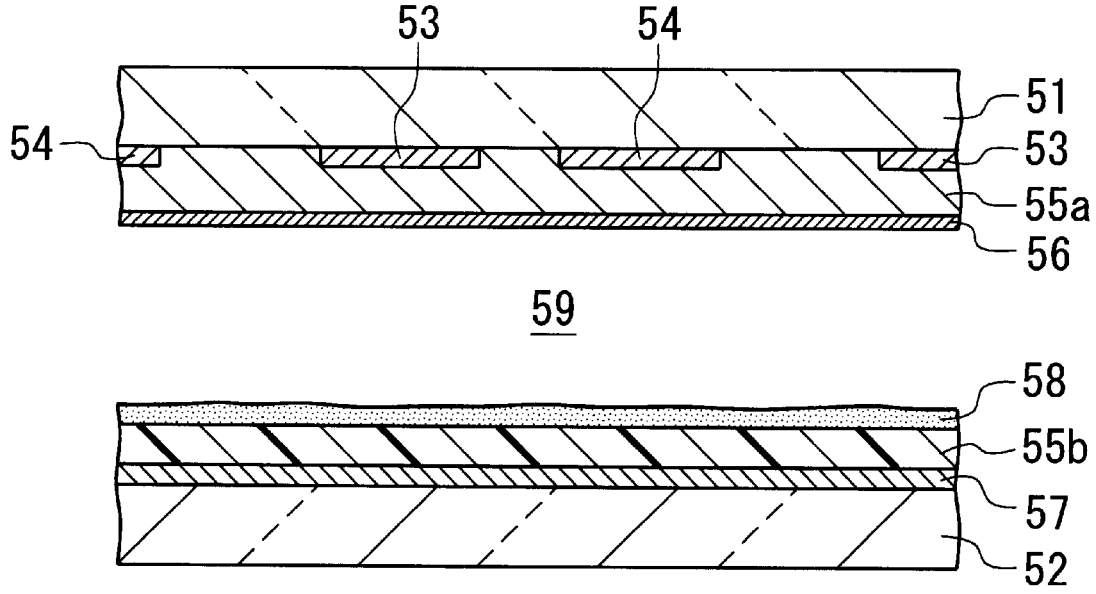
FIG. 47 is a cross-sectional view along the line XXXXVII—XXXXVII in FIG. 45.
Figure 48:
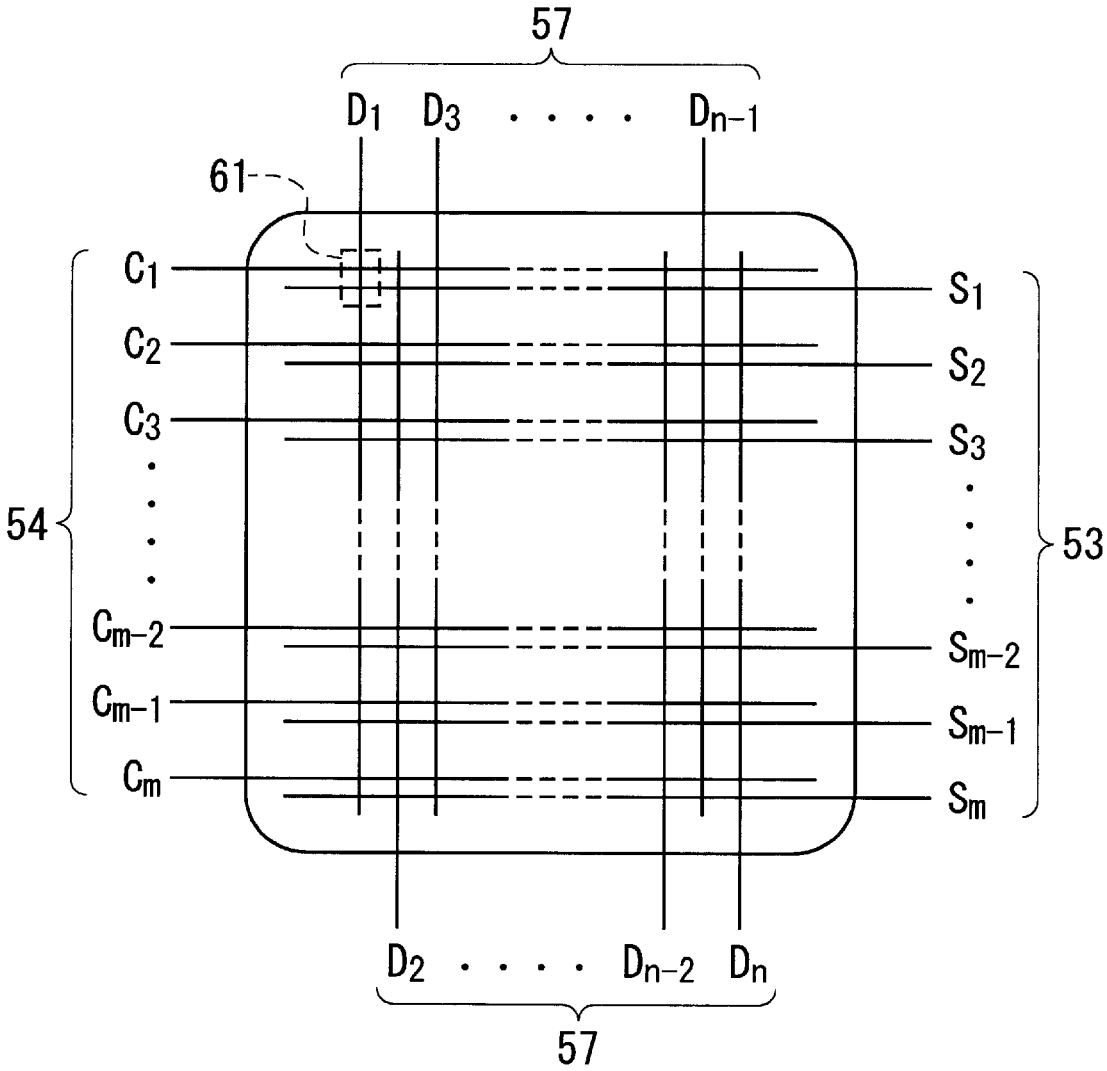
FIG. 48 is a plan view showing the electrode structure of the typical color PDP shown in FIGS. 45 to 47.

Alternately, as shown in FIG. 44C, the positive elimination pulse 17 maybe applied to the sustain electrodes 54 ($C_1$ to $C_m$) instead of the scan electrodes 53 while the negative elimination pulse 16 is applied to the scan electrodes 53 ($S_1$ to $S_m$).

Each of the pulses 16 and 17 may have any other waveform, such as a rectangular waveform, and the leading edge of the pulse 16 or 17 may be dull.

A set of elimination pulses maybe successively used instead of the pulse 16 or 17 if the same effect as the pulse 16 and/or 17 is given.

In the above-described first to twenty-fourth embodiments of the invention, the negative scan pulse 8 and the negative sustain pulse 10 and the positive data pulse 9 are used. This is to explain with reference to the conventional method shown in FIG. 1. However, it is needless to say that the same advantages are given even if the scan and sustain pulses 8 and 10 are positive and the data pulses 9 are negative. This is due to the fact that discharge is caused by the voltage (i.e., potential difference) between the electrodes 8, 9, and 10.

In the above-described first to seventh embodiments of the invention, discharge is caused in such a way that the scan electrodes 53 serve as the anode in the wall-charge elimination period T11 or the preliminary discharge period T2. This is because desired writing discharge is caused in such a way that the scan electrodes 53 serve as the cathode in the scan period T3 in these embodiments. Therefore, if desired writing discharge is caused in such a way that the scan electrodes 53 serve as the anode in the scan period T3, the discharge needs to be caused in such a way that the scan electrodes 53 serve as the cathode in the period T11 or T2.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A method of driving an ac-discharge PDP;

the PDP comprising scan electrodes and sustain electrodes extending in parallel in a first direction and data electrodes extending in a second direction;

the scan electrodes, the sustain electrodes, and the data electrodes forming cells arranged regularly for displaying images using discharge-induced emission;

the method comprising:

(a) a wall-charge adjustment step of storing first wall-charge of a first polarity near the respective scan electrodes and second wall-charge of a second polarity near the respective sustain electrodes, where the second polarity is opposite to the first polarity;

the first wall-charge of the first polarity stored near the respective scan electrodes generating an associate electric-field in the cells;

the wall-charge adjustment step being performed by common application of at least one of a first wall-charge adjustment voltage pulse to the scan electrodes and a second wall-charge adjustment voltage pulse to the sustain electrodes; and (b) a writing discharge generating step of generating writing discharge in the desired cells;

the writing discharge generation step being performed after the wall-charge adjustment step by applying successively a scan voltage pulse to the scan electrodes and applying a data voltage pulse to the data electrodes according to desired image data;

the scan voltage pulse and the data voltage pulse generating a main electric-field in the cells;

the main electric-field cooperating with the associate electric-field, thereby generating a writing voltage in the cells; and (c) a step of commonly applying a secondary scan voltage pulse to the sustain electrodes in the writing discharge generation step;

wherein the secondary scan voltage pulse serves to decrease or eliminate the second wall-charge stored near the respective sustain electrodes in the cells, preventing error discharge.

2. The method according to claim 1, wherein at least one of the first and second wall-charge adjustment voltage pulses is prepared independent of a preliminary discharge pulse for generating preliminary discharge;

and wherein the at least one of the first and second wall-charge adjustment voltage pulses is applied after the preliminary discharge pulse is applied.

3. The method according to claim 1, wherein at least one of the first and second wall-charge adjustment voltage pulses is prepared to be combined with a preliminary discharge pulse for generating preliminary discharge;

and wherein the at least one of the first and second wall-charge adjustment voltage pulses is applied after the preliminary discharge pulse is applied.

4. The method according to claim 1, wherein at least one of the first and second wall-charge adjustment voltage pulses has a part whose amplitude varies.

5. The method according to claim 4, wherein at least one of the first and second wall-charge adjustment voltage pulses has a part whose amplitude varies approximately linearly.

6. A method of driving an ac-discharge PDP;

the PDP comprising scan electrodes and sustain electrodes extending in parallel in a first direction and data electrodes extending in a second direction;

the scan electrodes, the sustain electrodes, and the data electrodes forming cells arranged regularly for displaying images using discharge-induced emission;

the method comprising:

(a) a wall-charge adjustment step of storing first wall-charge of a first polarity near the respective scan electrodes and second wall-charge of a second polarity near the respective sustain electrodes, where the second polarity is opposite to the first polarity;

the first wall-charge of the first polarity stored near the respective scan electrodes generating an associate electric-field in the cells;

the wall-charge adjustment step being performed by common application of at least one of a first wall-charge adjustment voltage pulse to the scan electrodes and a second wall-charge adjustment voltage pulse to the sustain electrodes; and (b) a writing discharge generating step of generating writing discharge in the desired cells;

the writing discharge generation step being performed after the wall-charge adjustment step by applying successively a scan voltage pulse to the scan electrodes and applying a data voltage pulse to the data electrodes according to desired image data;

the scan voltage pulse and the data voltage pulse generating a main electric-field in the cells;

the main electric-field cooperating with the associate electric-field, thereby generating a writing voltage in the cells, and (c) a step of commonly applying a wall-charge elimination voltage pulse to the scan electrodes after the writing discharge generation step is finished;

wherein the wall-charge elimination voltage pulse serves to decrease or eliminate the first and second wall-charge left near the respective scan and sustain electrodes in the cells where no writing discharge has occurred, preventing light from being emitted in error.

7. The method according to claim 6, wherein at least one of the first and second wall-charge adjustment voltage pulses is prepared independent of a preliminary discharge pulse for generating preliminary discharge;

and wherein the at least one of the first and second wall-charge adjustment voltage pulses is applied after the preliminary discharge pulse is applied.

8. The method according to claim 6, wherein at least one of the first and second wall-charge adjustment voltage pulses is prepared to be combined with a preliminary discharge pulse for generating preliminary discharge;

and wherein the at least one of the first and second wall-charge adjustment voltage pulses is applied after the preliminary discharge pulse is applied.

9. The method according to claim 6, wherein at least one of the first and second wall-charge adjustment voltage pulses has a part whose amplitude varies.

10. The method according to claim 9, wherein at least one of the first and second wall-charge adjustment voltage pulses has a part whose amplitude varies approximately linearly.

* * * * *